US008413728B2

(12) United States Patent
Ledbetter et al.

(10) Patent No.: US 8,413,728 B2
(45) Date of Patent: Apr. 9, 2013

(54) BREAK-OUT ASSEMBLY FOR A DRILLING MACHINE

(75) Inventors: Timothy W. Ledbetter, Sachse, TX (US); Steven B. Tweedie, Plano, TX (US); James M. Benson, Rowlett, TX (US); Maureen A. Bohac, Fort Worth, TX (US); Iain A. Peebles, Murphy, TX (US)

(73) Assignee: Atlas Copco Drilling Solutions LLC, Garland, TX (US)

( * ) Notice: Subject to any disclaimer, the term of this patent is extended or adjusted under 35 U.S.C. 154(b) by 290 days.

(21) Appl. No.: 12/537,991

(22) Filed: Aug. 7, 2009

(65) Prior Publication Data

US 2011/0030970 A1 Feb. 10, 2011

(51) Int. Cl.
*E21B 19/18* (2006.01)
*B25B 13/50* (2006.01)

(52) U.S. Cl.
USPC ..... 166/377; 166/77.51; 166/85.5; 166/78.1; 81/57.34; 81/57.35

(58) Field of Classification Search ..... 166/377–381, 166/77.1, 77.51, 85.1, 85.5, 78.1; 81/57.34, 81/57.35
See application file for complete search history.

(56) References Cited

U.S. PATENT DOCUMENTS 2,737,839 A 3/1956 Paget
3,245,180 A 4/1966 Bules et al.
3,463,247 A 8/1969 Klein
3,622,124 A 11/1971 Sidles et al.
3,692,123 A 9/1972 Gyongyosi
3,708,024 A 1/1973 Back
3,771,389 A 11/1973 Coyne
3,778,940 A 12/1973 Blecken
3,815,690 A 6/1974 Cooper
3,833,072 A 9/1974 Back
3,905,168 A 9/1975 Nelmark et al.
3,968,845 A 7/1976 Chaffin
3,992,831 A 11/1976 Bukovitz et al.
4,020,909 A 5/1977 Airaudo
4,030,542 A 6/1977 Poe et al.
4,246,809 A 1/1981 Keast et al.
4,279,850 A 7/1981 Lynch
4,295,758 A 10/1981 Yashima
4,380,347 A 4/1983 Sable
4,487,229 A 12/1984 Dreyfuss et al.
4,492,666 A 1/1985 Dreyfuss et al.
4,595,065 A 6/1986 Wada et al.
4,624,447 A 11/1986 Richmeier
4,715,180 A 12/1987 Rosman
4,724,930 A 2/1988 VanLierop
4,900,187 A 2/1990 Uchida et al.
(Continued)

OTHER PUBLICATIONS

International Search Report for PCT/US2009/068076 mailing date Sep. 13, 2010.

*Primary Examiner* — Kenneth L Thompson
*Assistant Examiner* — Catherine Loikith
(74) *Attorney, Agent, or Firm* — Schmeiser, Olsen & Watts LLP

(57) ABSTRACT

A break-out assembly includes a slide wrench assembly, and a slide wrench rotator assembly which rotates the slide wrench assembly in response to actuating first and second rotator assembly cylinders. The first and second rotator assembly cylinders are actuated in opposed directions. The break-out assembly includes a clamp assembly having opposed arm assemblies which are rotatable about separate pivot points.

34 Claims, 44 Drawing Sheets

U.S. PATENT DOCUMENTS

| | | | | |
|---|---|---|---|---|
| 5,020,777 | A | 6/1991 | Yocum | |
| 5,740,703 | A | 4/1998 | Perry | |
| 5,791,206 | A | 8/1998 | Daigle et al. | |
| 5,988,299 | A | 11/1999 | Hansen et al. | |
| 6,230,590 | B1 | 5/2001 | Guse | |
| 6,298,926 | B1 | 10/2001 | Dalkert et al. | |
| 6,374,706 | B1 | 4/2002 | Newman | |
| 6,672,410 | B2 | 1/2004 | Smith | |
| 6,675,915 | B2 | 1/2004 | Smith | |
| 6,817,271 | B2 | 11/2004 | Gouws | |
| 7,086,474 | B1 * | 8/2006 | Trevithick et al. | 166/379 |
| 7,117,938 | B2 * | 10/2006 | Hamilton et al. | 166/77.53 |
| 7,325,634 | B2 | 2/2008 | Law et al. | |
| 7,347,285 | B2 | 3/2008 | Hammer | |
| 7,413,036 | B2 | 8/2008 | Law et al. | |
| 2003/0056989 | A1 | 3/2003 | Smith | |
| 2003/0221871 | A1 * | 12/2003 | Hamilton et al. | 175/85 |
| 2010/0025046 | A1 * | 2/2010 | Francis et al. | 166/380 |
| 2010/0200258 | A1 * | 8/2010 | Tarnowski et al. | 173/164 |

* cited by examiner

BREAK-OUT ASSEMBLY FOR A DRILLING MACHINE

BACKGROUND OF THE INVENTION

1. Field of the Invention

This invention relates generally to tools for drilling machines.

2. Description of the Related Art

There are many different types of drilling machines for drilling through a formation. Some of these drilling machines are mobile and others are stationary. Examples of mobile and stationary drilling machines are disclosed in U.S. Pat. Nos. 3,245,180, 3,692,123, 3,708,024, 3,778,940, 3,815,690, 3,833,072, 3,905,168, 3,968,845, 3,992,831, 4,020,909, 4,595,065, 5,988,299, 6,672,410, 6,675,915, 7,325,634, 7,347,285 and 7,413,036. Some drilling machines, such as the one disclosed in U.S. Pat. No. 4,295,758, are designed to float and are useful for ocean drilling.

One type of drilling machine includes a tower and a rotary head movable along the tower, as well as a platform. The platform has a generally horizontal upper surface with an opening through which a drill string is moveable. The rotary head is movable along the tower and engageable with the drill string. A drill string includes one or more drill pipes connected together, and allows the borehole to be formed to a depth greater than the length of a single drill pipe. One of the drill pipes of the drill string is attached to an earth bit to facilitate its ability to drill through the formation. Hence, the drill string includes drill pipes which are capable of being attached to an earth bit. The borehole is formed in response to rotating the drill string and earth bit with the rotary head, and forcing them downwardly through the formation.

The drill pipes of the drill string can be connected together in many different ways. For example, in one situation, a first drill pipe is connected at opposed ends to the rotary earth bit and rotary head, respectively. The borehole is formed to a first depth in response to rotating the first drill pipe and earth bit with the rotary head, and forcing them downwardly through the formation. The rotary head is lowered along the tower as the first drill pipe and earth bit move downwardly through the formation.

The rotary head is disconnected from the first drill pipe and raised upwardly so a second drill pipe can be connected thereto at one end, and threaded to the first drill pipe at an opposed end to form a pipe interface. The borehole is formed to a second depth in response to rotating the first and second drill pipes and the earth bit with the rotary head, and forcing them downwardly through the formation. The rotary head is lowered along the tower as the first and second drill pipes and the earth bit move through the formation. It should be noted that the second depth is greater than the first depth. The borehole is formed to a desired depth by repeating these steps with more drill pipes.

The drill string is removed from the borehole by raising the drill string with the rotary head and disconnecting the drill pipes from each other. For example, in one situation, the first and second drill pipes and the earth bit are raised by the rotary head so that the second drill pipe extends through the tower. The first and second drill pipes are disconnected from each other by "breaking" the pipe interface and removing the second drill pipe from the tower. The rotary head is lowered through the tower and connected to the first drill pipe. The rotary head is raised through the tower and the first drill pipe moves upwardly in response. The drill string is removed from the borehole by repeating these steps for a desired number of drill pipes.

There are many different systems used to disconnect the drill pipes of the drill string from each other. For example, the drill pipes can be disconnected from each other using impact and non-impact break-out systems which "break" a pipe interface between the drill pipes. Examples of break-out systems are disclosed in U.S. Pat. Nos. 5,791,206 and 6,817,271. However, these systems fail to consistently break the pipe interface so the drill pipes can be disconnected from each other. Oftentimes, multiple attempts are needed to break the pipe interface, which wastes time and increases costs.

BRIEF SUMMARY OF THE INVENTION

The present invention is directed to a break-out assembly for a drill string, as well as a method of manufacturing and using the break-out assembly. The novel features of the invention are set forth with particularity in the appended claims. The invention will be best understood from the following description when read in conjunction with the accompanying drawings.

DETAILED DESCRIPTION OF THE INVENTION

Figure 1A:
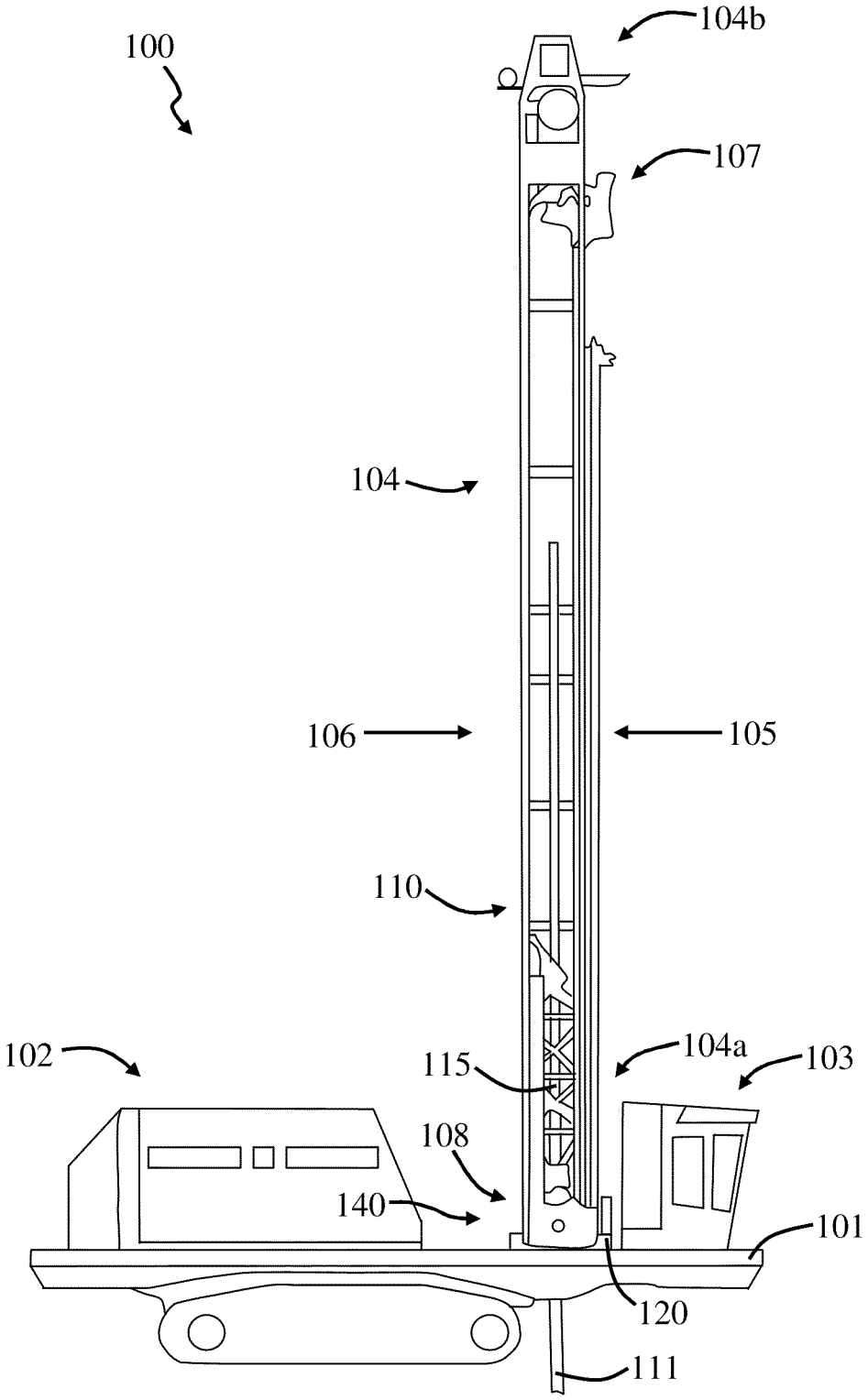
FIG. 1*a* is a side view of a drilling machine which includes a break-out assembly.
Figure 1B:
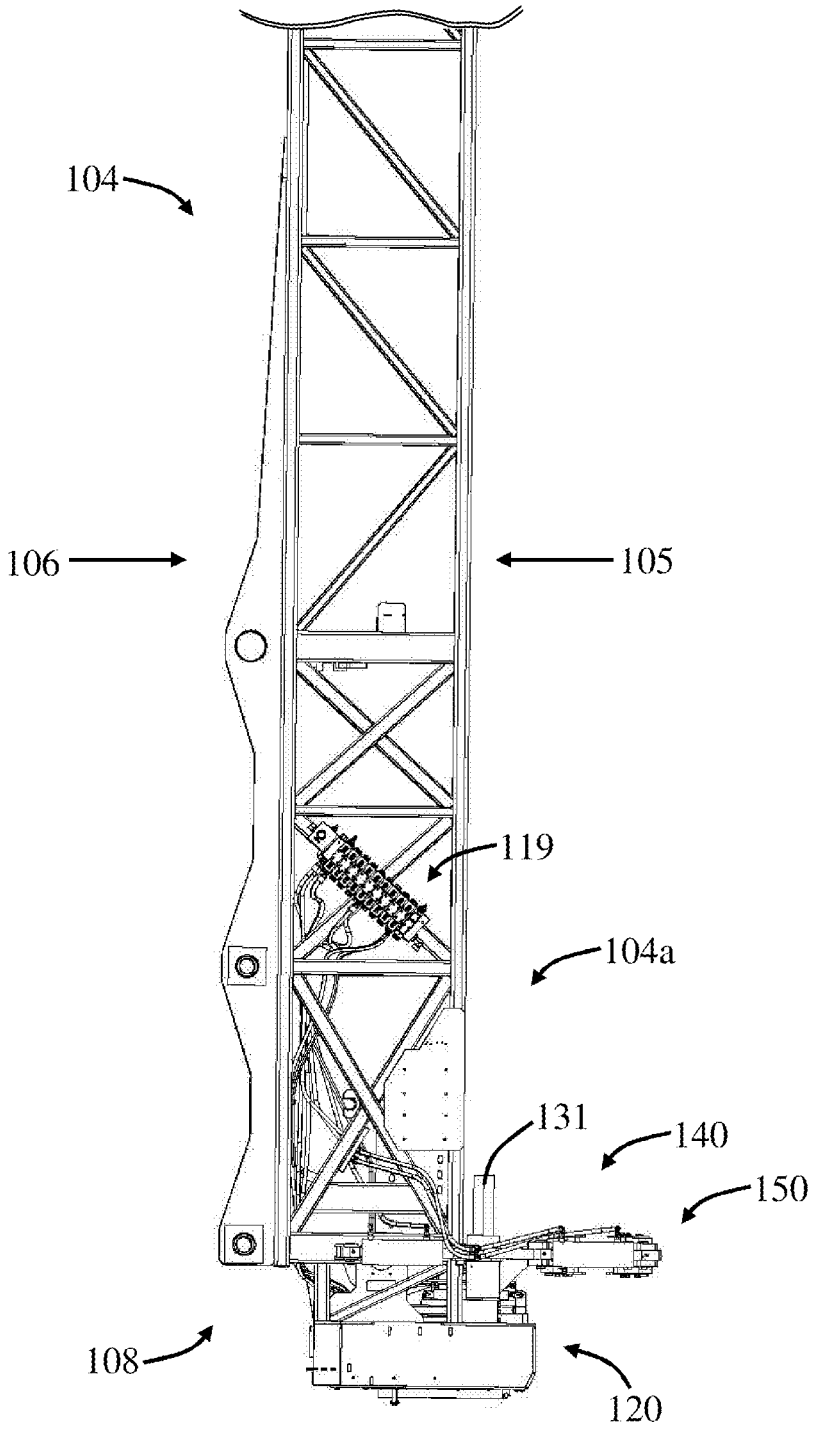
FIG. 1*b* is a close-up side view of a tower of the drilling machine of FIG. 1*a*.

FIG. 1*a* is a side view of a drilling machine 100, and FIG. 1*b* is a close-up side view of a tower 104 of drilling machine 100. In this embodiment, drilling machine 100 includes a platform 101 which carries a prime mover 102 and cab 103. Drilling machine 100 includes a table 120 which is positioned between prime mover 102 and cab 103, and a tower coupler carried by table 120. A tower base 104*a* of tower 104 is coupled to table 120 by tower coupler 108, which allows tower 104 to be repeatably moved between raised and lowered positions. In the raised position, which is shown in FIG. 1*a*, a tower crown 104*b* of tower 104 is away from platform 101. In the raised position, a front 105 of tower 104 faces cab 103 and a back 106 of tower 104 faces prime mover 102. In the lowered position, tower crown 104*b* is towards platform 101, and back 106 of tower 104 is towards platform 101 and prime mover 102.

Tower 104 generally carries a feed cable system (not shown) attached to a rotary head 107, wherein the feed cable system allows rotary head 107 to move between raised and lowered positions along tower 104. The feed cable system moves rotary head 107 to the raised and lowered positions by moving it towards tower crown 104*b* and tower base 104*a*, respectively.

Rotary head 107 is moved between the raise and lowered positions to raise and lower, respectively, a drill string 110 through a borehole. Further, rotary head 107 is used to rotate drill string 110, wherein drill string 110 extends through tower 104. Drill string 110 generally includes one or more drill pipes connected together in a well-known manner. The drill pipes of drill string 110 are capable of being attached to an earth bit, such as a tri-cone rotary earth bit.

In this embodiment, drill string 110 includes drill pipes 111 and 115 connected together, wherein drill pipe 111 is in a lower position and drill pipe 115 is in an upper position. Drill pipe 111 is in the lower position because it extends through platform 101 and below drilling machine 100. Drill pipe 115 is in the upper position because it is above drill pipe 111 and extends upwardly from platform 101 and through tower 104. In this way, drill pipe 111 is a lower drill pipe and drill pipe 115 is an upper drill pipe.

It should be noted that drill pipes 111 and 115 can be moved between the upper and lower positions. Drill pipe 115 is moved from the upper position to the lower position when drill string 110 is being inserted into the borehole, as described in more detail in the Background. Further, drill pipe 111 is moved from the lower position to the upper position when drill string 110 is removed from the borehole, as described in more detail in the Background. However, to move drill pipe 111 from the lower position to the upper position, it is desirable to disconnect drill pipe 115 from drill pipe 111, as will be discussed in more detail presently.

Figure 1C:
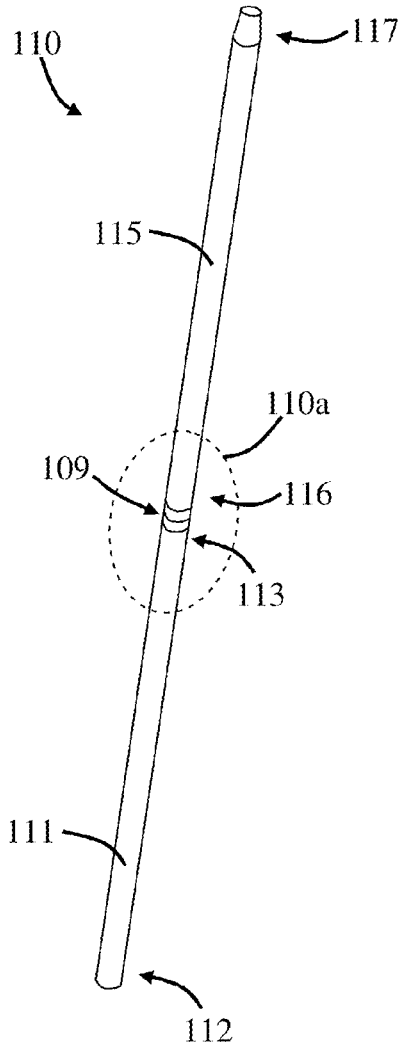
FIG. 1*c* is a perspective view of one embodiment of a drill string of FIG. 1*a*.
Figure 1D:
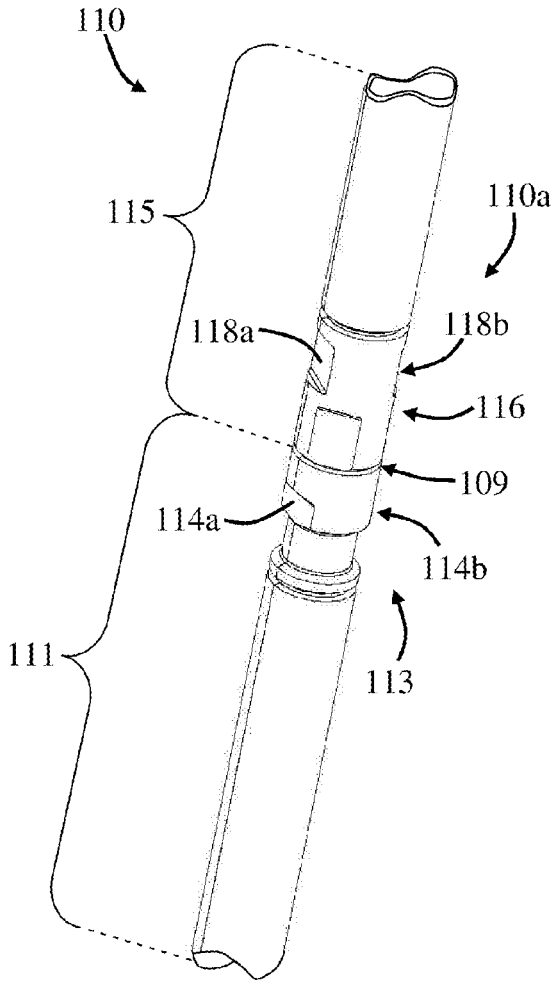
FIG. 1*d* is a close-up perspective view of an interface region of the drill string of FIG. 1*a*.

FIG. 1*c* is a perspective view of one embodiment of drill string 110, and FIG. 1*d* is a close-up perspective view of an interface region 110*a* of drill string 110. In this embodiment, drill pipe 111 includes a female tool joint 112 and male tool joint 113 at opposed ends, and drill pipe 115 includes a female tool joint 116 and male tool joint 117 at opposed ends. More information regarding drill strings, drill pipes and tool joints can be found in U.S. Pat. Nos. 4,279,850, 4,380,347, 4,487,229 and 4,492,666. In FIGS. 1*c* and 1*d*, male tool joint 113 is connected to female tool joint 116 to form a pipe interface 109 between drill pipes 111 and 115. In this way, drill pipes 111 and 115 are connected together.

In this embodiment, male tool joint 113 includes flats 114*a* and 114*b*, and female tool joint 116 includes flats 118*a* and 118*b*, as shown in FIG. 1*d*. The flats of a tool joint are generally positioned on opposed sides of the corresponding drill pipe, and are used to engage the drill pipe to facilitate its rotation. It is desirable to rotate a drill pipe in many different situations, such as when connecting it with and disconnecting it from another drill pipe. The drill pipe can be rotated in many different ways, such as that disclosed in U.S. Patent Application No. 20030056989, which is incorporated by reference as though fully set forth herein. In this embodiment, however, a drill pipe of drill string 110 is rotated using a break-out assembly 140, as discussed in more detail with FIGS. 12*a*-12*f*. Break-out assembly 140 will be discussed in more detail presently.

Figure 2A:
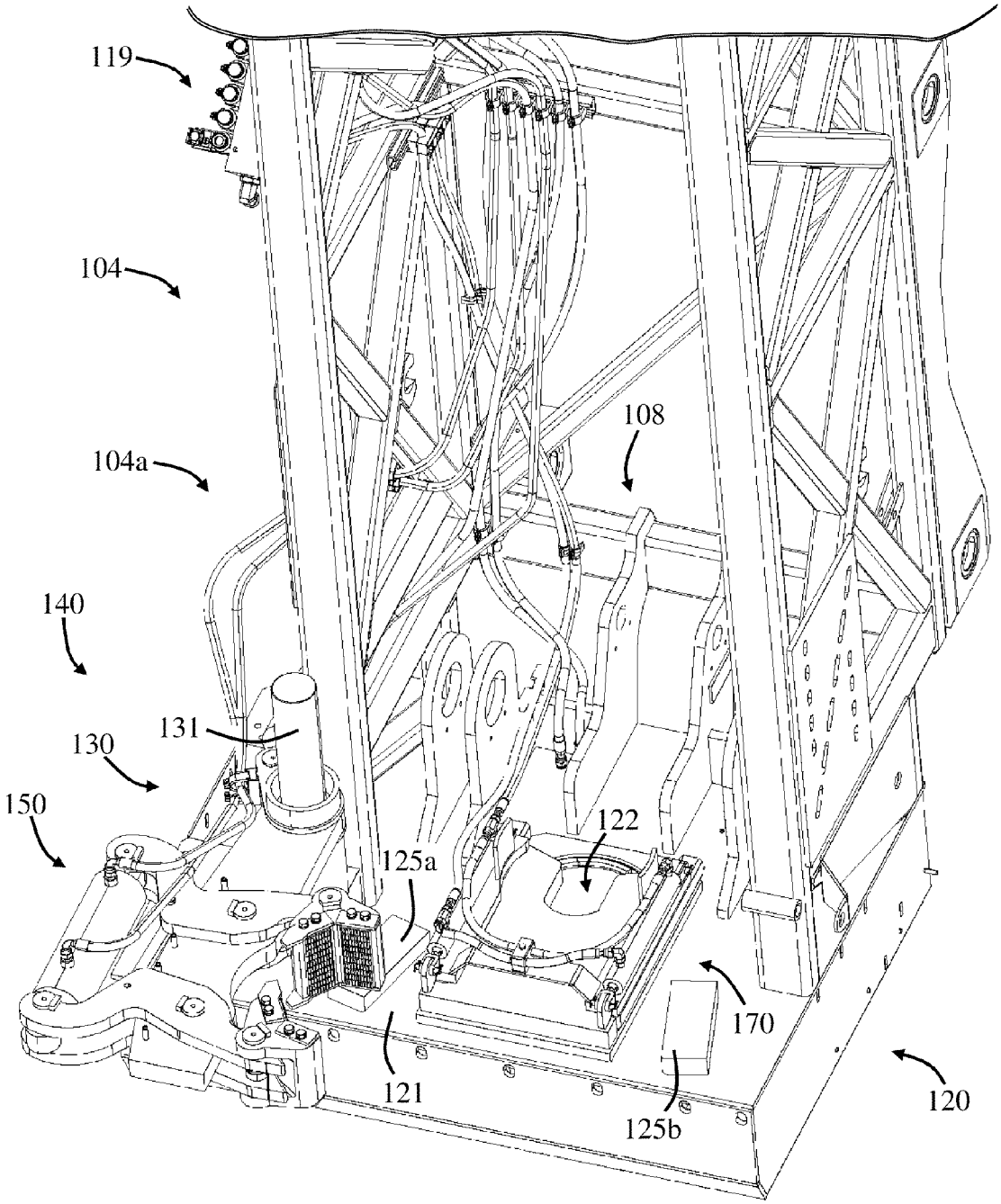
FIGS. 2*a* and 2*b* are top and bottom perspective views, respectively, of the tower base and break-out assembly of FIG. 1*a*.
Figure 2B:
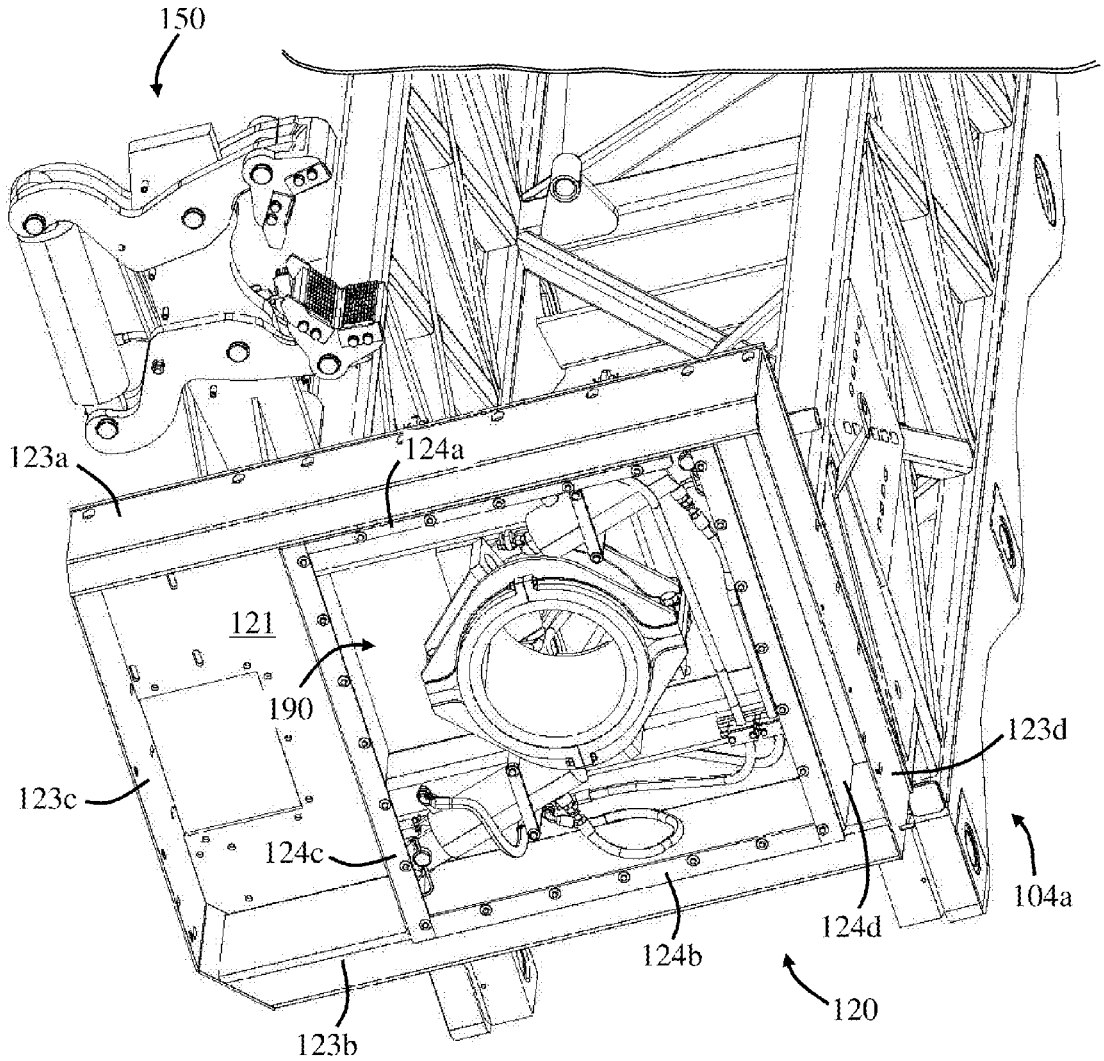
Figure 3A:
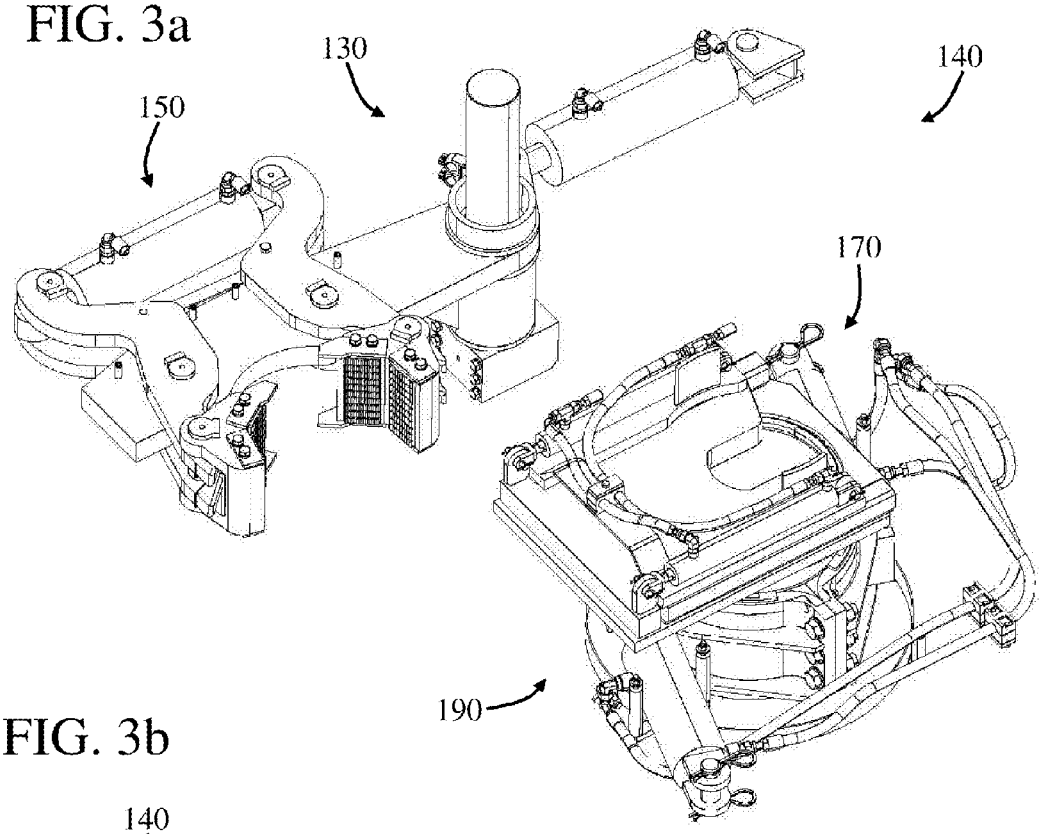
FIGS. 3*a* and 3*b* are top and bottom perspective views, respectively, of the break-out assembly of FIG. 1*a*.
Figure 3B:
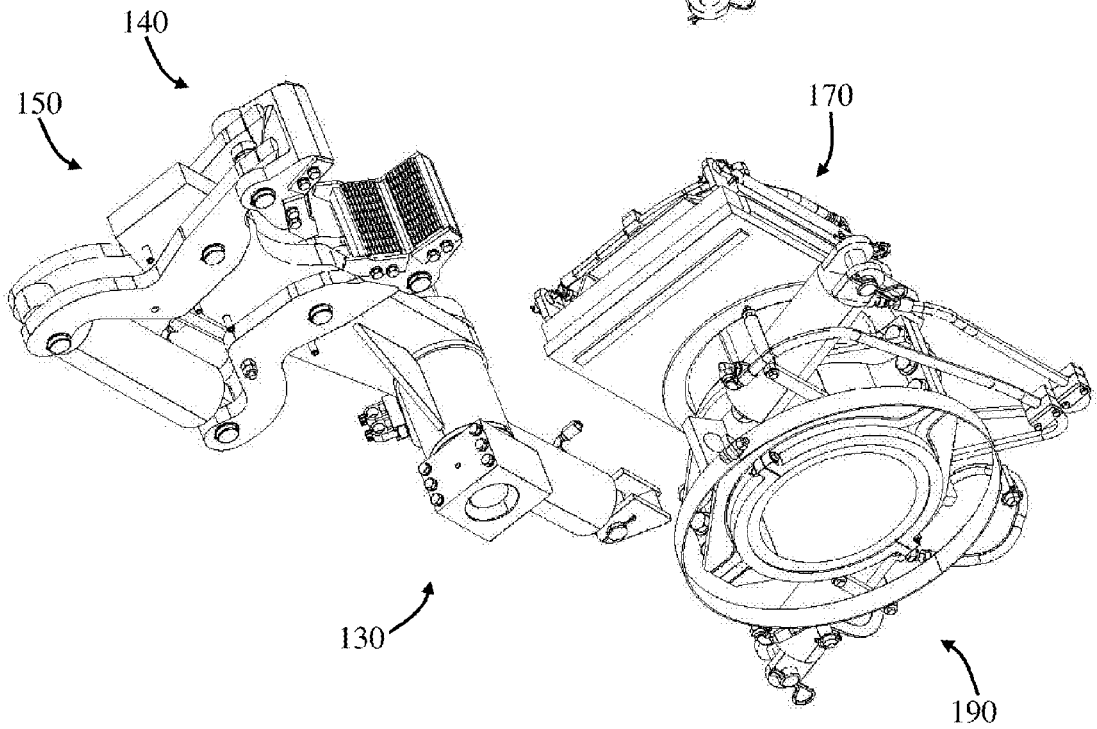

FIGS. 2*a* and 2*b* are top and bottom perspective views, respectively, of tower base 104*a* and break-out assembly 140. In this embodiment, break-out assembly 140 is carried by table 120 (FIGS. 1*a* and 1*b*), and tower 104 extends upwardly from, and is connected to, table 120 through tower coupler 108. Break-out assembly 140 is shown in top and bottom perspective views in FIGS. 3*a* and 3*b*, and table 120 is shown in a top perspective view in FIG. 4*a*, and in bottom perspective views in FIGS. 4*b* and 4*c*. Break-out assembly 140 includes a clamp pivot assembly 130, which is shown in FIGS. 5*a* and 5*b* and is carried by table 120. Clamp pivot assembly 130 is repeatably moveable between extended and retracted positions, as will be discussed in more detail below.

In this embodiment, break-out assembly 140 includes a clamp assembly 150, which is shown in FIGS. 6*a*-6*e*. Clamp assembly 150 is carried by clamp pivot assembly 130, as shown in FIGS. 7*a*-7*d*. Clamp assembly 150 is moved towards drill string 110 when clamp pivot assembly 130 is moved to the extended position. In particular, clamp assembly 150 is moved towards the upper drill pipe (i.e. drill pipe 115) when clamp pivot assembly 130 is moved to the extended position. Clamp assembly 150 is moved away from drill string 110 when clamp pivot assembly 130 is moved to the retracted position. In particular, clamp assembly 150 is moved away from the upper drill pipe when clamp pivot assembly 130 is moved to the retracted position. The movement of clamp pivot assembly 130 and clamp assembly 150 will be discussed with FIGS. 11*a*-11*f*.

Figure 7A:
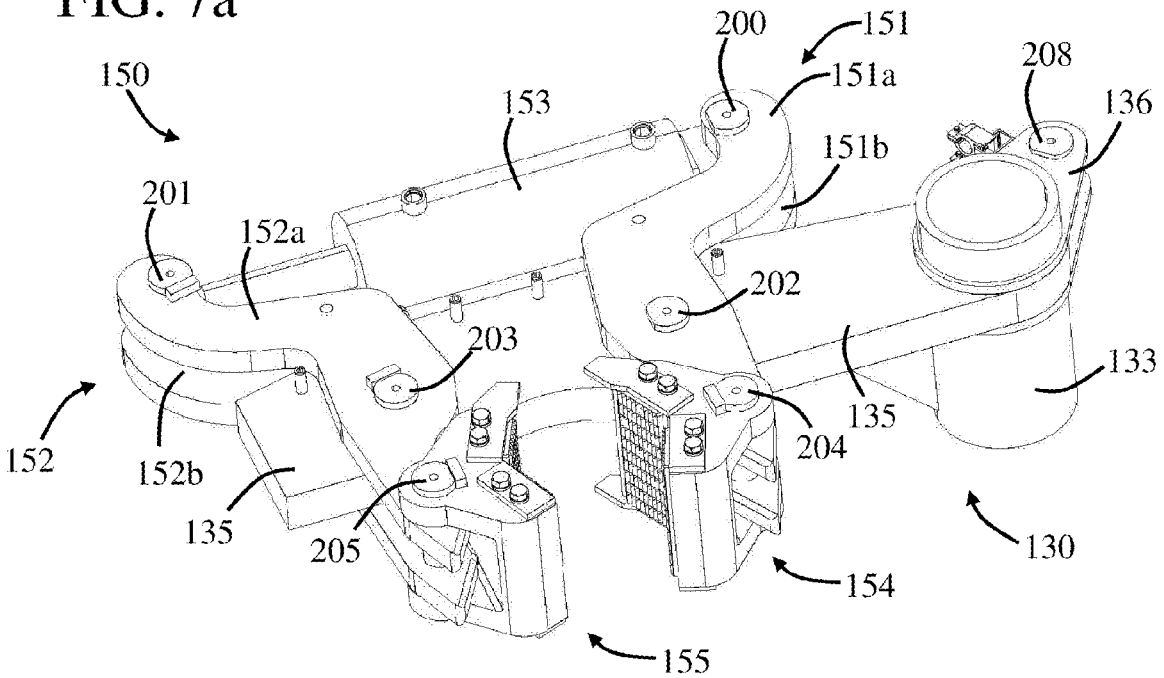
FIGS. 7*a* and 7*b* are perspective views of the clamp assembly of FIGS. 6*a* and 6*b* being carried by the clamp pivot assembly of FIGS. 5*a* and 5*b*.
Figure 7B:
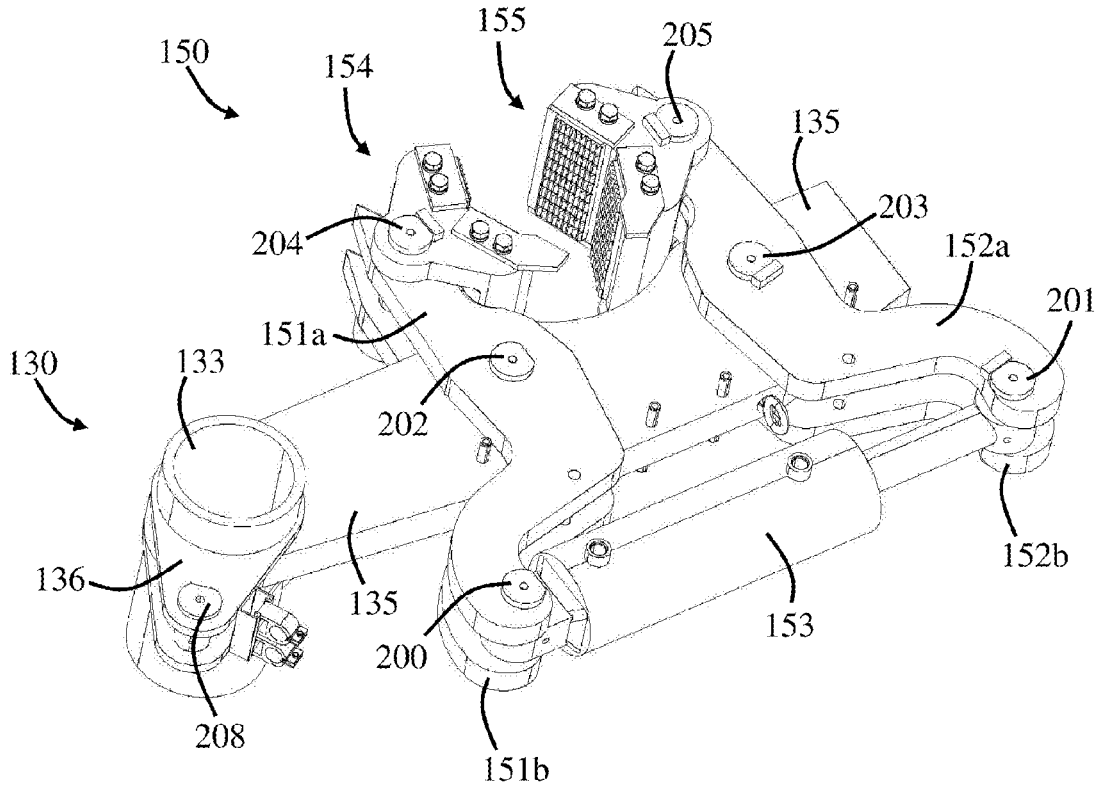
Figure 7C:
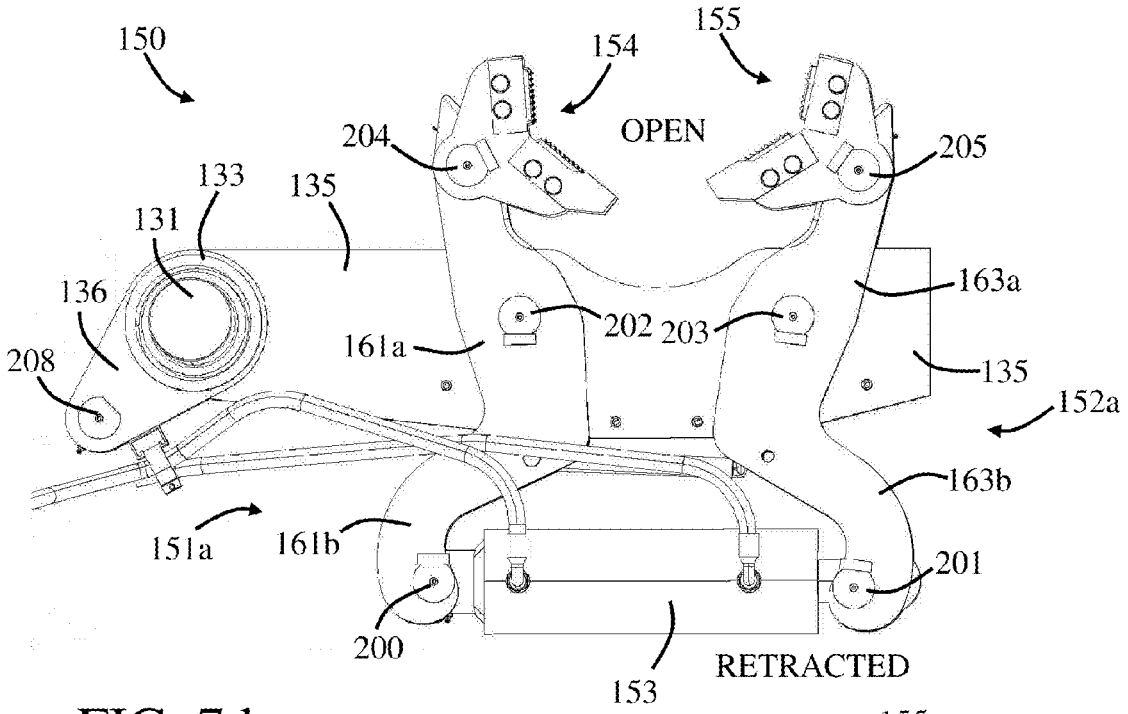
FIGS. 7*c* and 7*d* are top views of the clamp assembly of FIGS. 6*a* and 6*b* in open and closed conditions, respectively.
Figure 7D:
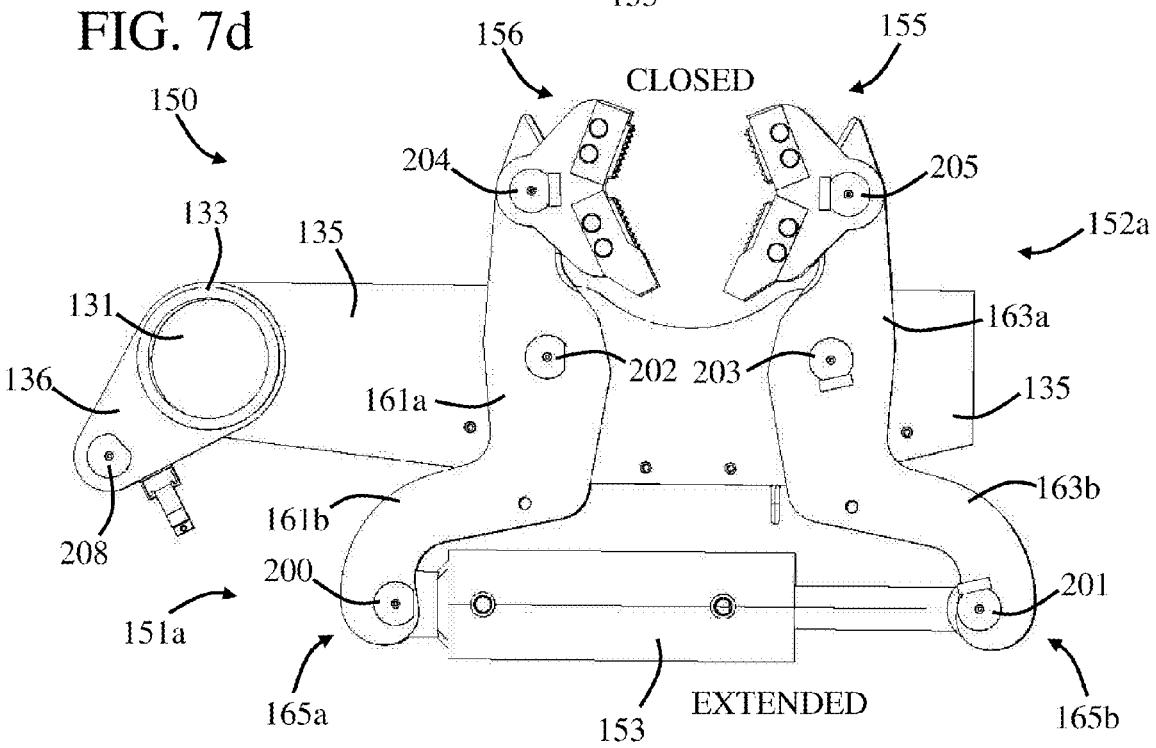

Clamp assembly 150 is repeatably moveable between open and closed positions, as shown in FIGS. 7*c* and 7*d*. Clamp assembly 150 clamps drill pipe 115 in the closed position and clamp assembly 150 unclamps the upper drill pipe in the open position. Clamp assembly 150 clamps the upper drill pipe to restrict its ability to rotate, as will be discussed in more detail with FIGS. 11*d* and 11*e*.

Figure 8A:
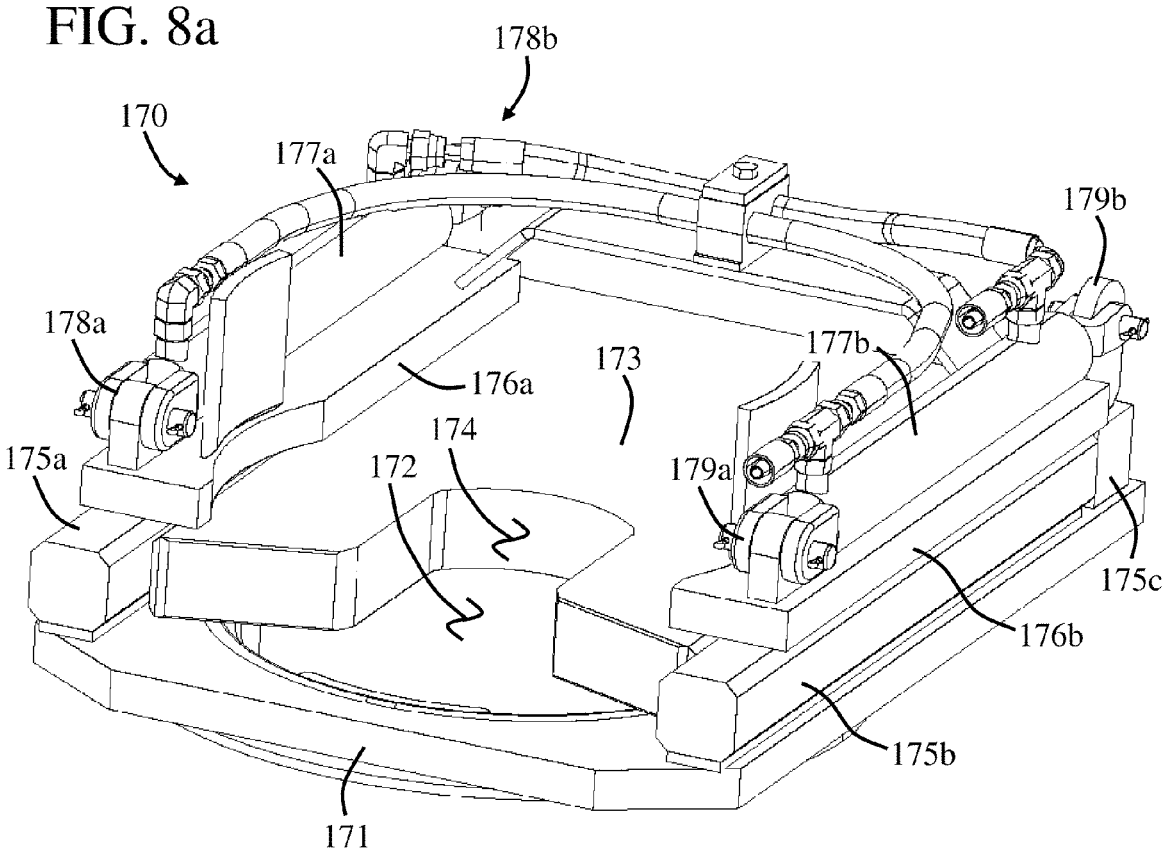
FIGS. 8*a* and 8*b* are front and back perspective views, respectively, of a slide wrench assembly of the break-out assembly of FIG. 1*a*.
Figure 8B:
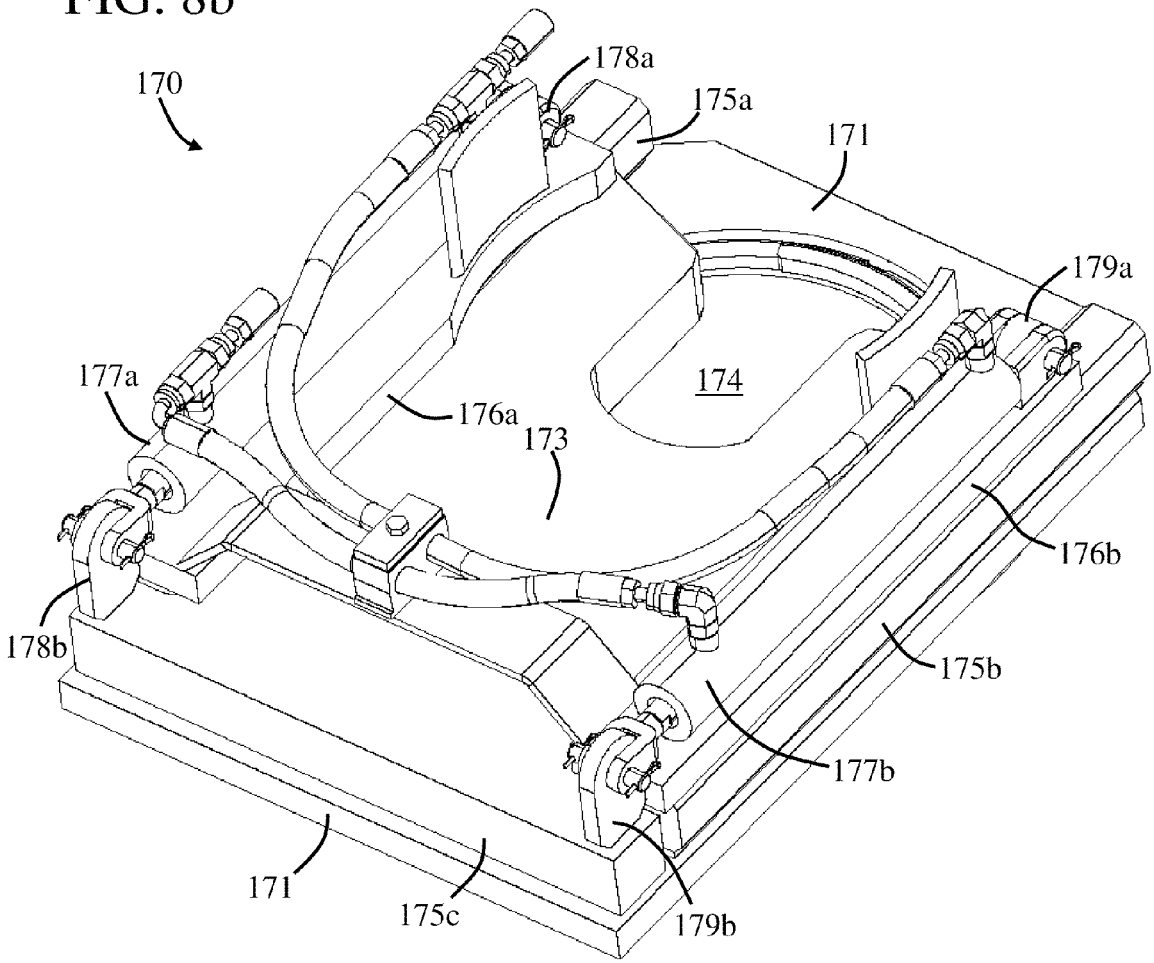

Break-out assembly 140 includes a slide wrench assembly 170, which is shown in FIGS. 8*a* and 8*b*. Slide wrench assembly 170 is repeatably moveable between engaged and disengaged positions with the lower drill pipe (i.e. drill pipe 111), as discussed in more detail with FIGS. 8*c* and 8*d*. Slide wrench assembly 170 is carried by a slide wrench rotator assembly 190 of break-out assembly 140, as discussed in more detail with FIGS. 9*a*-9*n*. Slide wrench rotator assembly 190 is used to rotate slide wrench assembly 170, as discussed in more detail with FIGS. 11*a*-11*f* and FIGS. 12*a*-12*f*. Slide wrench assembly 170 engages the lower drill pipe in the engaged position and disengages the lower drill pipe in the disengaged position. Slide wrench assembly 170 engages the lower drill pipe so that the lower drill pipe is rotated relative to the upper drill pipe (i.e. drill pipe 115) in response to the rotation of slide wrench rotator assembly 190. Clamp assembly 150 clamps the upper drill pipe to restrict its ability to rotate relative to the lower drill pipe.

In one particular example, slide wrench assembly 170 engages flats 114*a* and 114*b* of male tool joint 113 (FIG. 1*d*) so that drill pipe 111 is rotated relative to drill pipe 115 in response to the rotation of slide wrench rotator assembly 190. Further, clamp assembly 150 clamps drill pipe 115 to restrict its ability to rotate relative to drill pipe 111. Slide wrench rotator assembly 190 rotates in a direction in which drill pipe 111 is disconnected from drill pipe 115. In particular, slide wrench rotator assembly 190 rotates in a direction in which male tool joint 113 is disconnected from female tool joint 116 (FIGS. 1*c* and 1*d*). Slide wrench rotator assembly 190 rotates in a direction chosen to break pipe interface 109 (FIGS. 1*c* and 1*d*).

It should be noted that clamp assembly 150 is positioned above slide wrench rotator assembly 190. Further, slide wrench rotator assembly 190 is positioned below clamp assembly 150. Clamp assembly 150 and slide wrench rotator assembly 190 are positioned on opposed sides of table top 121. Further, clamp assembly 150 and slide wrench rotator assembly 190 are positioned on opposed sides of a table top opening 122, which is shown in FIG. 2*a*.

Slide wrench assembly 170 is positioned above slide wrench rotator assembly 190. Further, slide wrench rotator assembly 190 is positioned below slide wrench assembly 170. Slide wrench assembly 170 and slide wrench rotator assembly 190 are positioned on opposed sides of table top 121. Further, slide wrench assembly 170 and slide wrench rotator assembly 190 are positioned on opposed sides of table top opening 122.

Figure 4A:
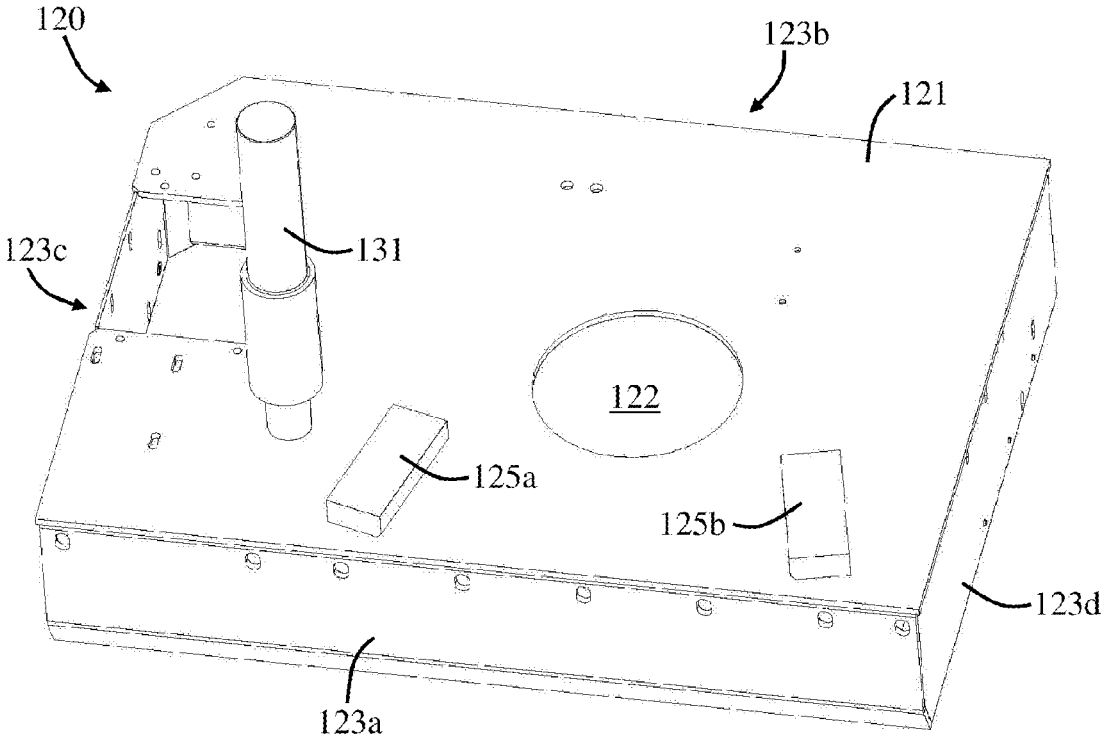
FIG. 4*a* is a top perspective view of a table of FIG. 1*a*.
Figure 4B:
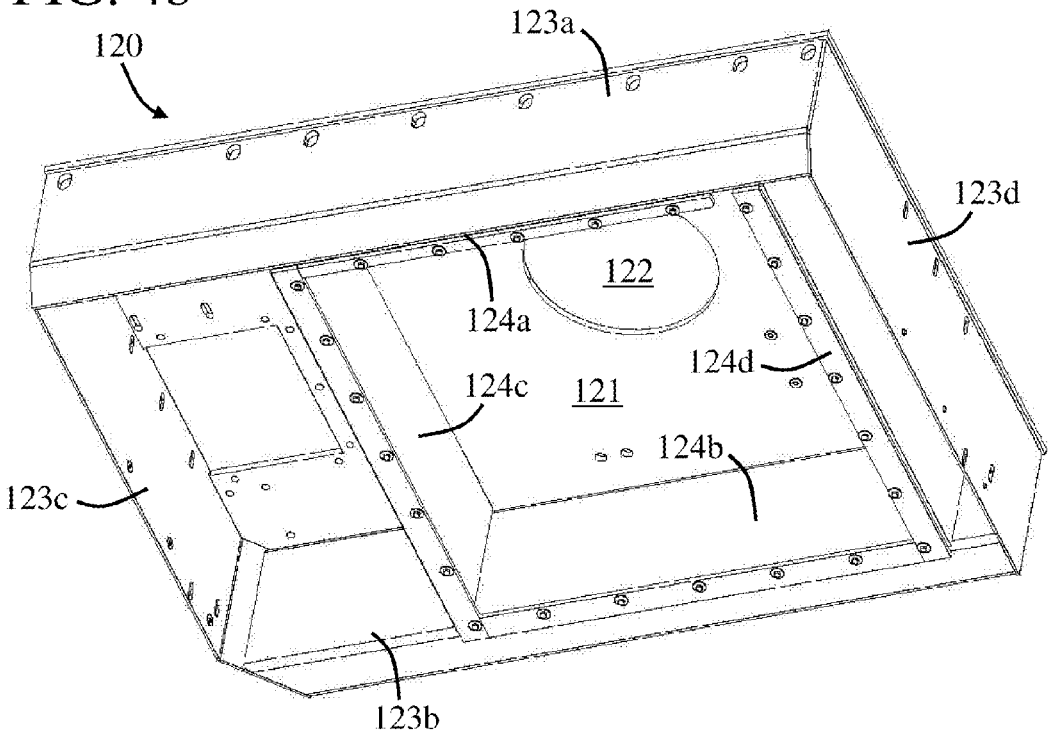
FIGS. 4*b* and 4*c* are bottom perspective views of the table of FIG. 4*a*.
Figure 4C:
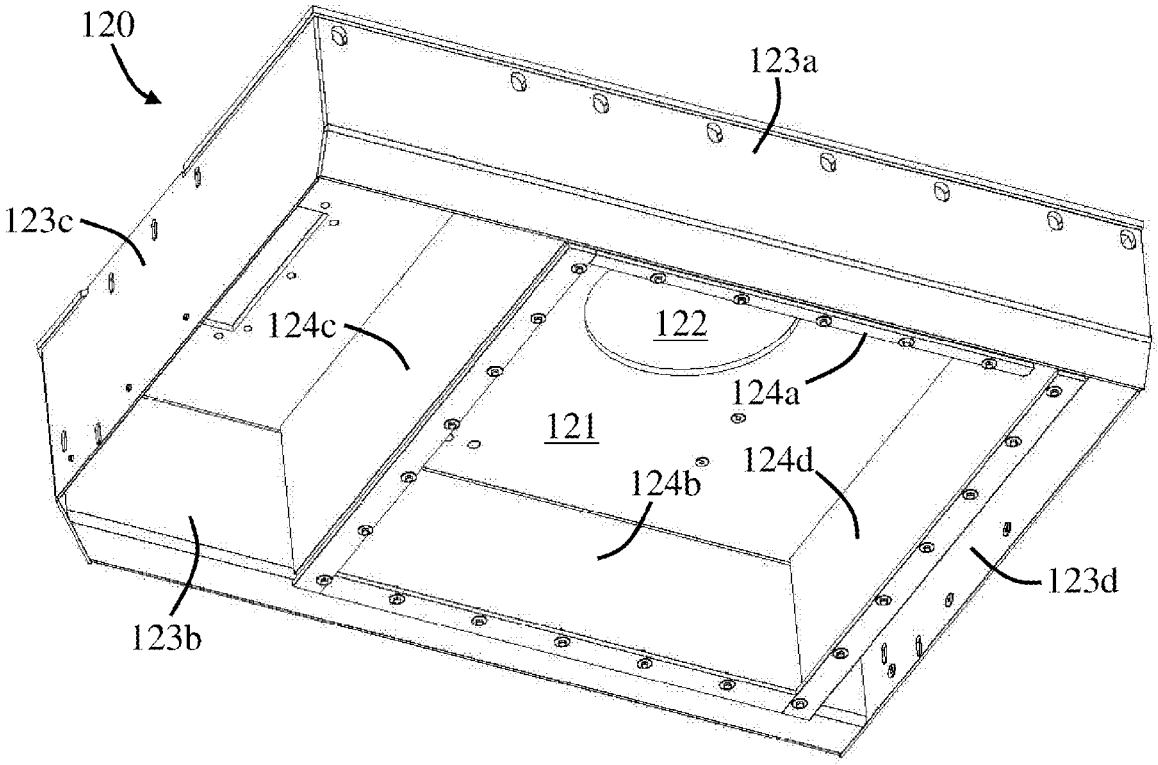
Figure 5A:
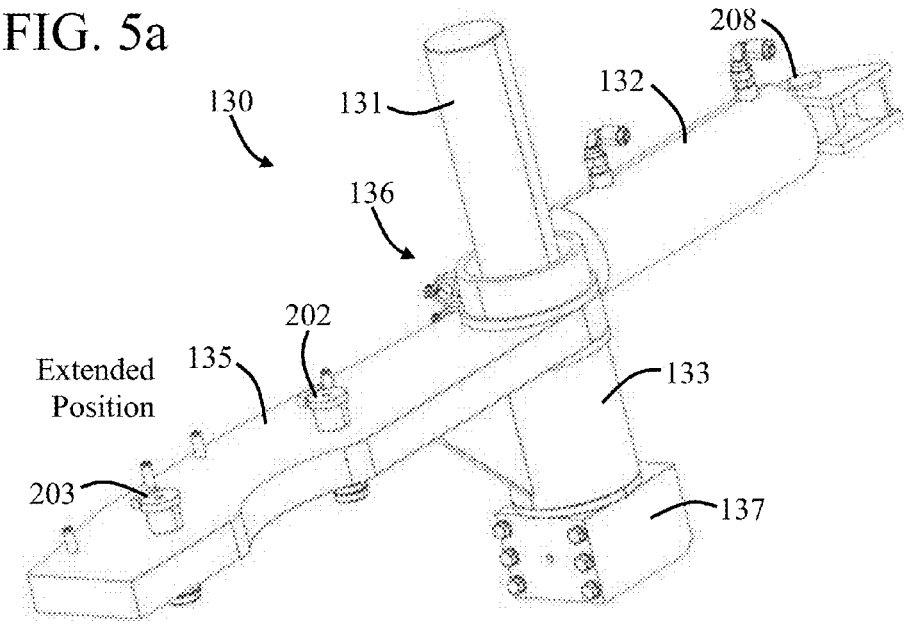
FIGS. 5*a* and 5*b* are perspective views of a clamp pivot assembly in extended and refracted positions, respectively.
Figure 5B:
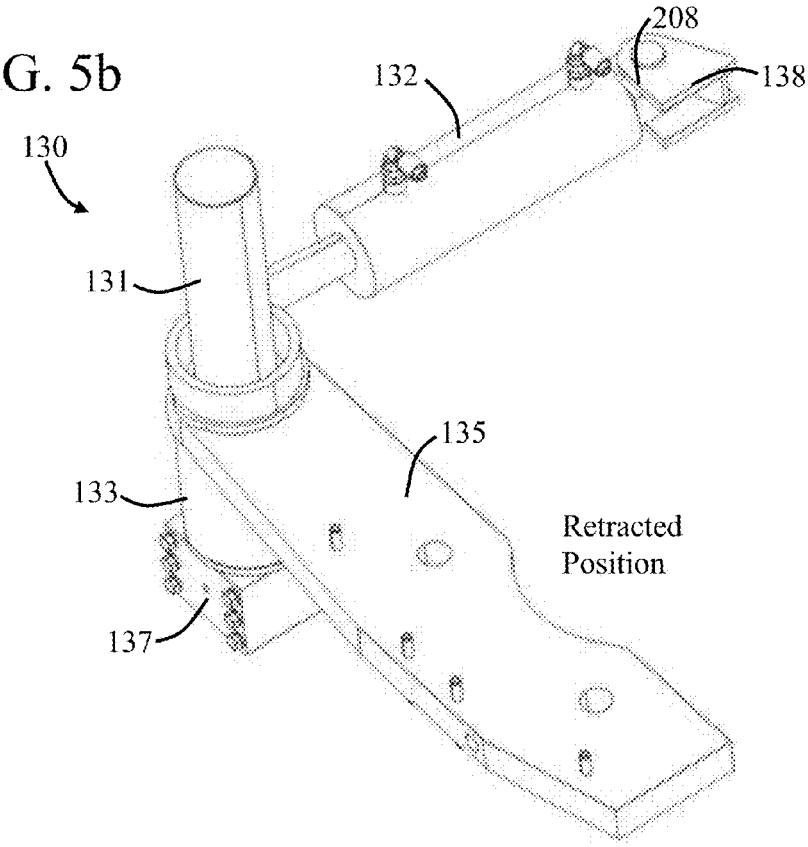

FIG. 4*a* is a top perspective view of table 120, and FIGS. 4*b* and 4*c* are bottom perspective views of table 120. In this embodiment, table 120 includes a table top 121 (FIGS. 2*a* and 2*b*) and downwardly extending outer front and back sidewalls 123*a* and 123*b* (FIGS. 4*b* and 4*c*). Outer front sidewall 123*a* is a front sidewall because it is positioned towards cab 103, and outer back sidewall 123*b* is a back sidewall because it is positioned away from cab 103 (FIG. 1*a*). Table 120 includes downwardly extending outer distal and proximal sidewalls 123*c* 123*d*. Outer distal sidewall 123*c* is a distal sidewall because it is positioned away from cab 103, and outer proximal sidewall 123*d* is a proximal sidewall because it is positioned towards cab 103. Outer distal sidewall 123*c* and outer proximal sidewall 123*d* extend between outer front sidewall 123*a* and outer back sidewall 123*b*. Sidewalls 123*a*, 123*b*, 123*c* and 123*d* are outer sidewalls because they extend around the outer periphery of table top 121. Outer sidewalls 123*a*, 123*b*, 123*c* and 123*d* extend downwardly because they extend away from table top 121 and towards platform 101 (FIG. 1*a*).

In this embodiment, table 120 includes downwardly extending inner front and back sidewalls 124*a* and 124*b* (FIGS. 4*b* and 4*c*). Inner front sidewall 124*a* is a front sidewall because it is positioned towards cab 103, and inner back sidewall 124*b* is a back sidewall because it is positioned away from cab 103 (FIG. 1*a*). Table 120 includes downwardly extending inner distal and proximal sidewalls 124*c* and 124*d* (FIGS. 4*b* and 4*c*). Inner distal sidewall 124*c* is a distal sidewall because it is positioned away from cab 103, and inner proximal sidewall 124*d* is a proximal sidewall because it is positioned towards cab 103 (FIG. 1*a*). Inner distal sidewall 124*c* and inner proximal sidewall 124*d* extend between inner front sidewall 124*a* and inner back sidewall 124*b*. Sidewalls 124*a*, 124*b*, 124*c* and 124*d* are inner sidewalls because they extend around the inner periphery of table top 121. The inner periphery of table top 121 is bounded by outer sidewalls 123*a*, 123*b*, 123*c* and 123*d*. Inner sidewalls 124*a*, 124*b*, 124*c* and 124*d* extend downwardly because they extend away from table top 121 and towards platform 101 (FIG. 1*a*).

In this embodiment, table 120 includes table top opening 122, which extends through table top 121. Table top opening 122 is sized to receive drill string 110, as will be discussed in more detail below. Table top opening 122 is positioned so that it is bounded by inner sidewalls 124*a*, 124*b*, 124*c* and 124*d*, as shown in FIGS. 4*b* and 4*c*. Pivot post 131 extends upwardly from table top 121, and is shown in FIG. 4*a* so that table 120 can be more easily correlated with the top view of tower base 104*a* of FIG. 2*a*.

Figure 11A:
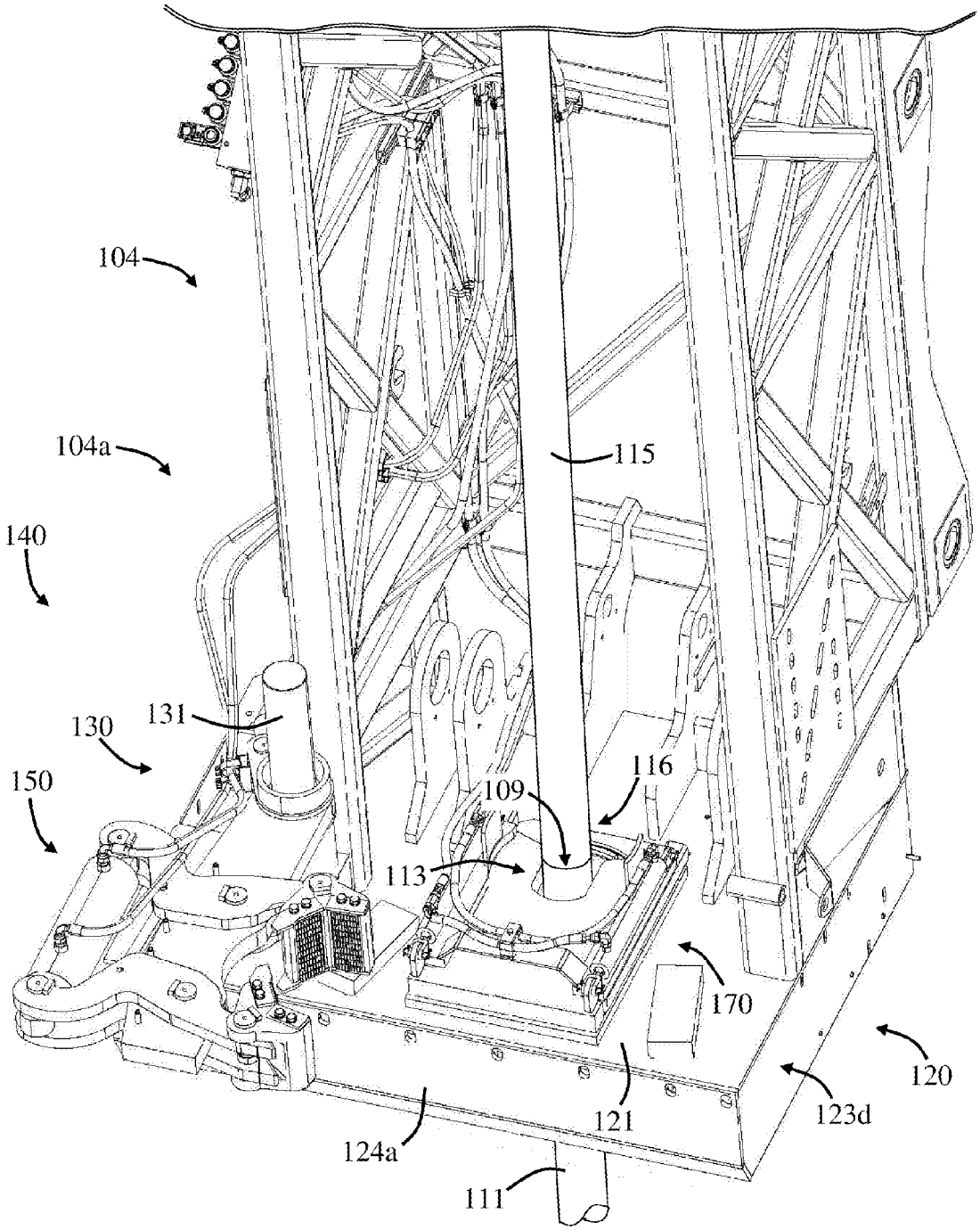
FIG. 11*a* is a perspective view of the tower base and break-out assembly of FIG. 1*a*, wherein the clamp pivot assembly of FIGS. 5*a* and 5*b* is in the retracted position so that the clamp assembly of FIGS. 6*a* and 6*b* is away from the drill string of FIGS. 1*a*, 1*c* and 1*d*.
Figure 11B:
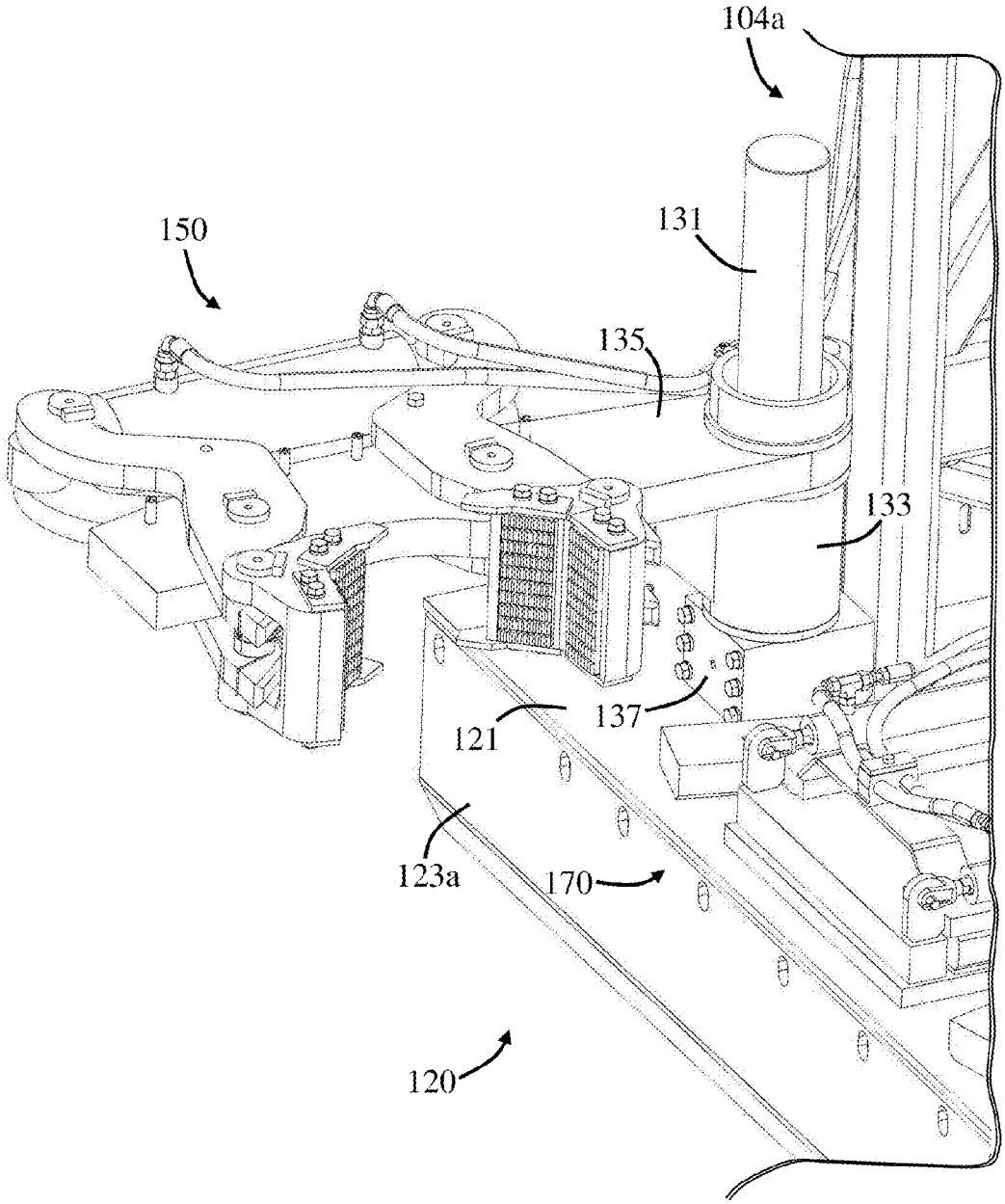
FIGS. 11*b* and 11*c* are close-up front and back perspective views of the clamp assembly of FIG. 11*a*.
Figure 11C:
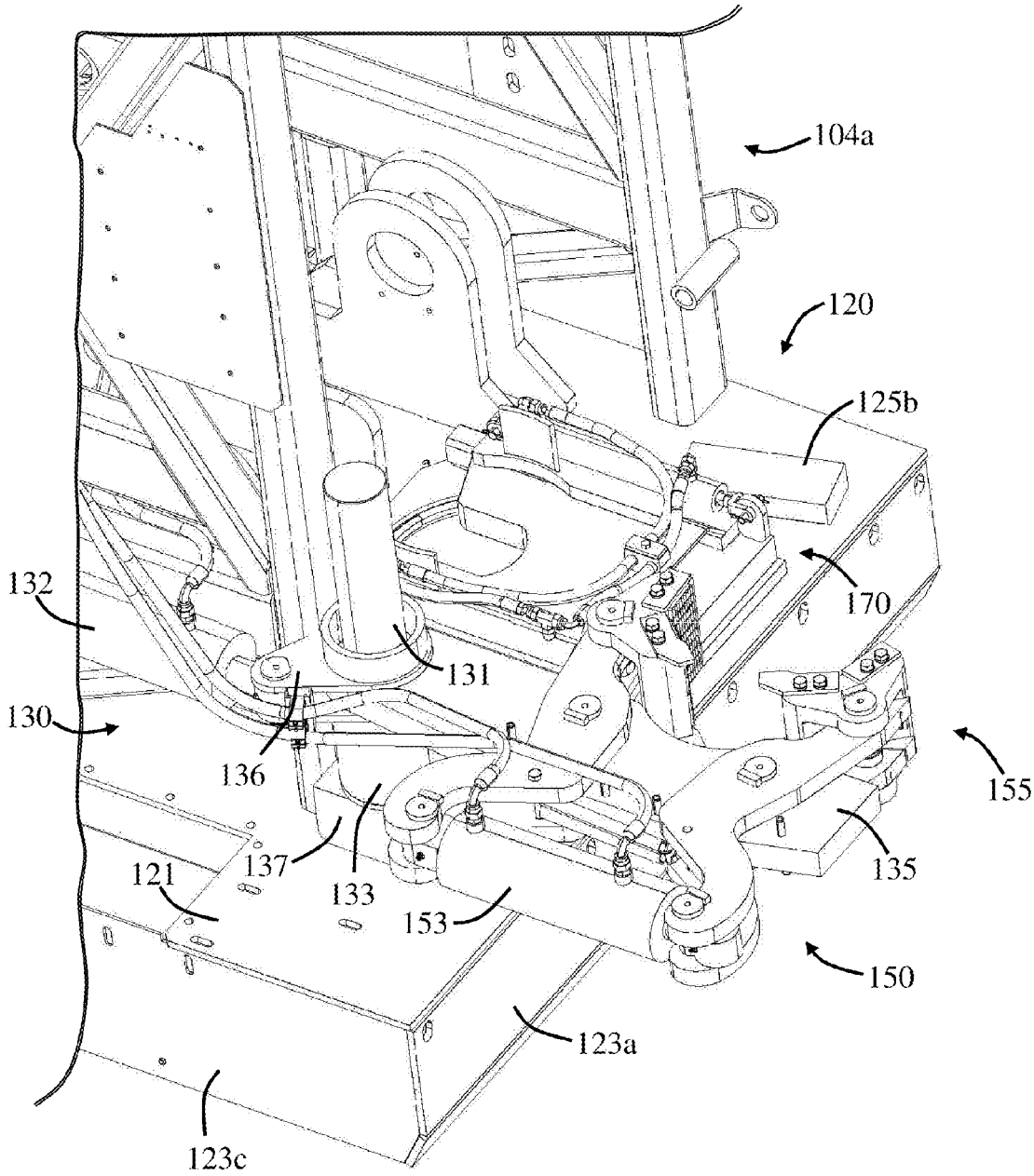

FIGS. 5*a* and 5*b* are perspective views of clamp pivot assembly 130 in extended and refracted positions, respectively. In this embodiment, clamp pivot assembly 130 includes a pivot post sleeve 133 rotatably mounted to pivot post 131 (FIGS. 1*b*, 2*a* and 4*a*). In this embodiment, pivot post 131 extends upwardly from a pivot post stand 137, and pivot post stand 137 is attached to table top 121. Clamp pivot assembly 130 includes a pivot post sleeve bracket 136 coupled to the pivot post sleeve 133. Clamp pivot assembly 130 includes a clamp assembly rotation cylinder 132 coupled at one end to pivot post sleeve bracket 136. Clamp assembly rotation cylinder 132 is repeatably moveable between extended and retracted positions. A bracket 138 is coupled to the other end of clamp assembly rotation cylinder 132. Bracket 138 is attached to tower base 104*a* of tower 104, as shown in FIG. 11*e*. Clamp pivot assembly 130 includes a clamp assembly rotation arm 135 coupled to pivot post sleeve 133. As will be discussed in more detail below, clamp assembly rotation arm 135 carries clamp assembly 150.

In operation, clamp assembly rotation cylinder 132 rotates pivot post sleeve 133 about pivot post 131 in response to moving between the extended and retracted positions. Clamp assembly rotation arm 135 rotates in response to the rotation of pivot post sleeve 133. In this embodiment, clamp assembly rotation arm 135 rotates towards table top opening 122 in response to clamp assembly rotation cylinder 132 moving to the extended position. Further, clamp assembly rotation arm 135 rotates away from table top opening 122 in response to clamp assembly rotation cylinder 132 moving to the retracted position. In this way, clamp pivot assembly 130 is moved between extended and retracted positions, and clamp assembly 150 is moved towards and away from table top opening 122.

It should be noted that clamp assembly rotation cylinder 132, as well as the other cylinders discussed herein, can be moved between extended and retracted positions in many different ways. For example, the cylinders can be pneumatically or hydraulically driven. In this embodiment, drilling machine 100 includes a break-out assembly hydraulic system 119 carried by tower 104, as shown in FIGS. 1*b* and 2*a*. Break-out assembly hydraulic system 119 is operatively coupled to the cylinders discussed herein, and provides, in a well-known manner, energy to move them between extended and retracted positions.

Figure 6A:
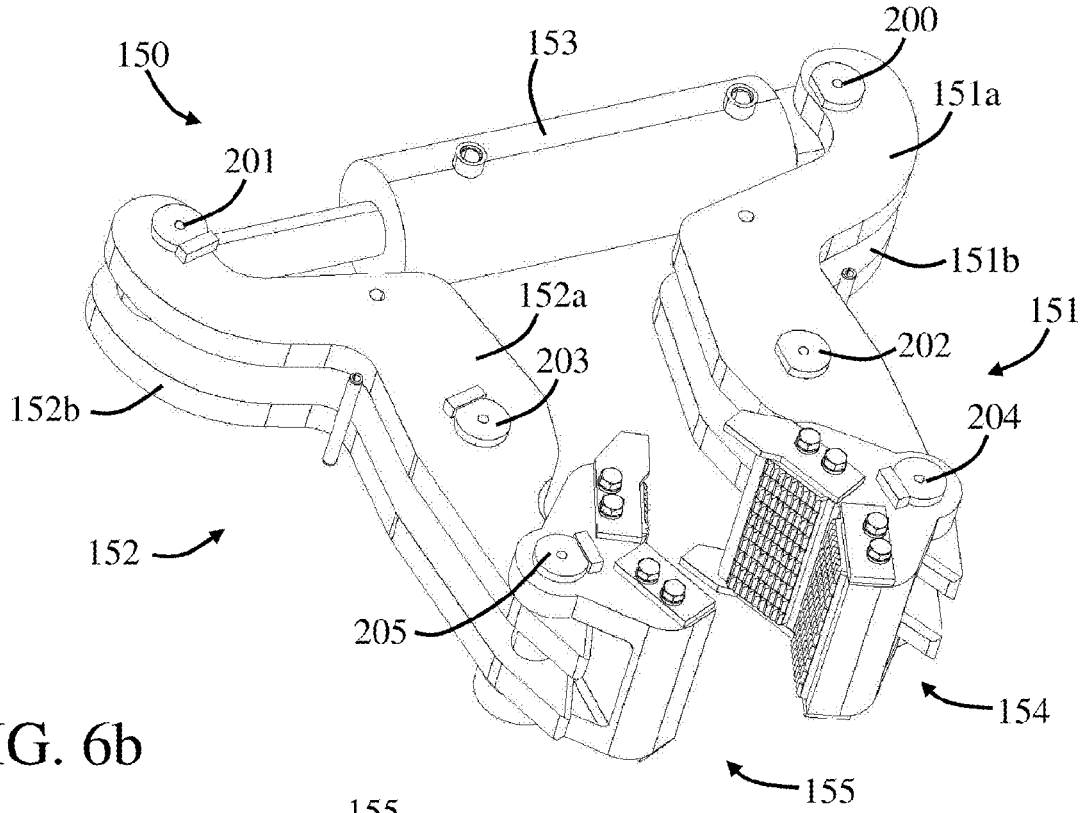
FIGS. 6*a* and 6*b* are front and back perspective views, respectively, of a clamp assembly of the break-out assembly of FIG. 1*a*.
Figure 6B:
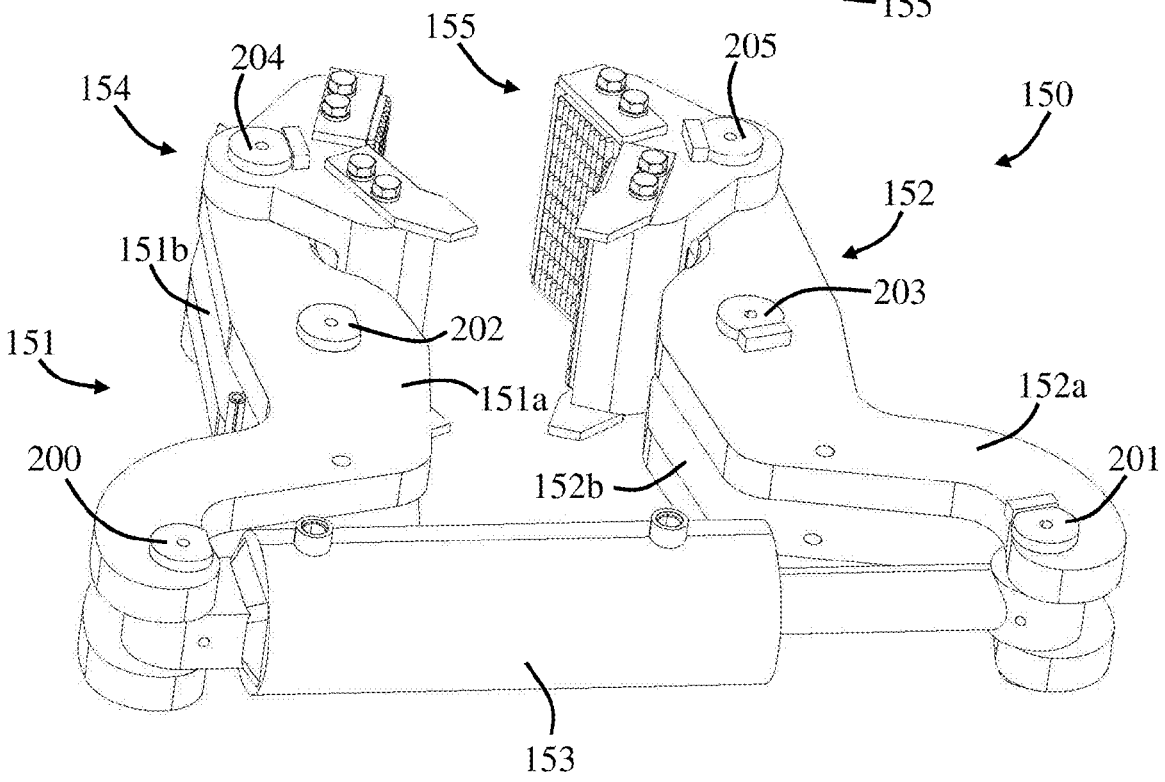

FIGS. 6*a* and 6*b* are front and back perspective views, respectively, of clamp assembly 150. In this embodiment, clamp assembly 150 includes proximal and distal arm assemblies 151 and 152. Arm assembly 151 is a proximal arm assembly because it is positioned towards pivot post 131, and arm assembly 152 is a distal arm assembly because it is positioned away from pivot post 131, as discussed in more detail with FIGS. 7*a*-7*d*. Proximal and distal arm assemblies 151 and 152 rotate about separate pivot points, which are on opposed sides of drill string 110 when clamp assembly 150 clamps drill string 110. In this way, proximal and distal arm assemblies 151 and 152 rotate about opposed pivot points, which are on opposed sides of drill string 110 when clamp assembly 150 clamps drill string 110. Proximal and distal arm assemblies 151 and 152 rotate about separate pivot points on opposed sides of drill string 110 so that they can clamp drill string 110 at opposed sides. The separate pivot points on opposed sides of drill string 110 allow clamp assembly 150 to apply a larger force to drill string 110 to break pipe interface 109.

In this embodiment, proximal arm assembly 151 includes an upper proximal arm 151*a* and lower proximal arm 151*b*. Arm assembly 151 includes upper proximal arm 151*a* and lower proximal arm 151*b* to provide it with a greater strength. Further, distal arm assembly 152 includes an upper distal arm 152*a* and lower distal arm 152*b*. Arm assembly 152 includes upper proximal arm 152*a* and lower proximal arm 152*b* to provide it with a greater strength.

It is desirable to increase the strength of arm assemblies 151 and 152 so they can apply a greater force to drill string 110 to facilitate the breaking of pipe interface 109. In general, the strength of an arm assembly increases and decreases as the number of arms included therein increases and decreases, respectively. Further, the amount of force an arm assembly can apply to drill string 110 to break pipe interface 109 increases and decreases as the number of arms included therein increases and decreases, respectively. It should be noted, however, that in some embodiments, arm assembly 151 includes upper proximal arm 151*a* or lower proximal arm 151*b*. Further, in some embodiments, arm assembly 152 includes upper proximal arm 152*a* or lower proximal arm 152*b*.

Upper proximal arm 151*a* and lower proximal arm 151*b* are spaced apart from each other, wherein arm 151*a* is above arm 151*b*. Upper proximal arm 151*a* and lower proximal arm 151*b* are spaced apart from each other so that a proximal gripper can be attached thereto. Further, upper distal arm 152*a* and lower distal arm 152*b* are spaced apart from each other, wherein arm 152*a* is above arm 152*b*. Upper distal arm 152*a* and lower distal arm 152*b* are spaced apart from each other so that a distal gripper can be attached thereto. Arms 151*a*, 151*b*, 152*a* and 152*b* can have many different shapes, one of which will be discussed in more detail presently.

Figure 6C:
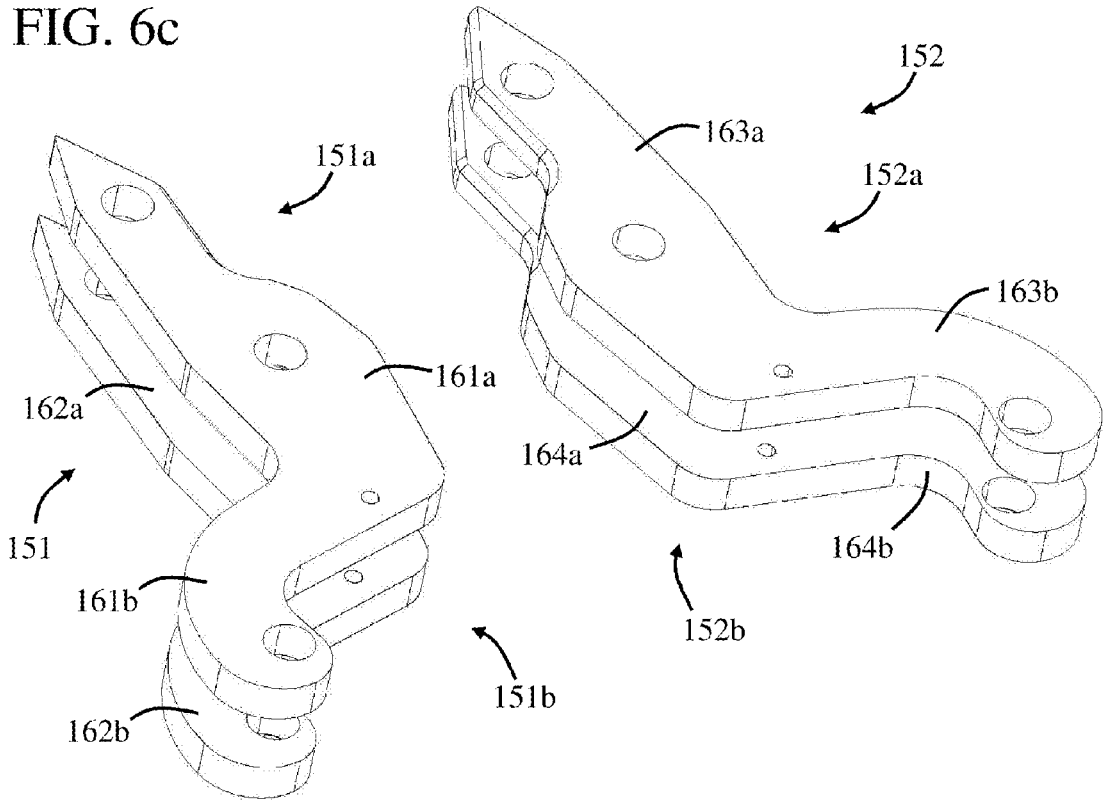
FIG. 6*c* is a top perspective view of arm assemblies of the clamp assembly of FIGS. 6*a* and 6*b*.

FIG. 6*c* is a top perspective view of upper proximal arm 151*a*, lower proximal arm 151*b*, upper distal arm 152*a* and lower distal arm 152*b*. In this embodiment, upper proximal arm 151*a* includes a straightened arm portion 161*a* and a curved arm portion 161*b*, and lower proximal arm 151*b* includes a straightened arm portion 162*a* and a curved arm portion 162*b*. Further, upper distal arm 152*a* includes a straightened arm portion 163*a* and curved arm portion 163*b*, and lower distal arm 152*b* includes a straightened arm portion 164*a* and curved arm portion 164*b*. Arm portions 161*a*, 162*a*, 163*a* and 164*a* are straightened arm portions because they are substantially straight compared to curved arm portion 161*b*, 162*b*, 163*b* and 164*b*, respectively. Arm portions 161*b*, 162*b*, 163*b* and 164*b* are curved arm portions because they are substantially curved compared to straightened arm portions 161*a*, 162*a*, 163*a* and 164*a*, respectively. It should be noted that lower proximal arm 151*b* and lower distal arm 152*b* generally have the same shape as upper proximal arm 151*a* and upper distal arm 152*a*, respectively.

It should also be noted that curved arm portions 161*b* and 162*b* curve outwardly from straightened arm portions 161*a* and 162*a*, respectively, and curved arm portions 163*b* and 164*b* curve outwardly from straightened arm portions 163*a* and 164*a*, respectively. Further, curved arm portions 161*b* and 163*b* curve outwardly away from each other, and curved arm portions 162*b* and 164*b* curve outwardly away from each other. Proximal arm assembly 151 includes curved arm portions 161*b* and 162*b* and distal arm assembly 152 includes curved arm portions 163*b* and 164*b* so that clamp assembly 150 can apply a larger clamping force to the upper drill pipe, as will be discussed in more detail with FIGS. 11*a*-11*f* and FIGS. 12*a*-12*f*. Clamp assembly 150 can apply a larger clamping force to the upper drill pipe because the curved arm portions of proximal arm assembly 151 and distal arm assembly 152 allow more leverage to be applied to the corresponding straightened arm portions.

As shown in FIGS. 6*a* and 6*b*, clamp assembly 150 includes a proximal gripper 154 carried by proximal arm assembly 151, and a distal gripper 155 carried by distal arm assembly 152. Proximal gripper 154 is connected to straightened arm portions 161*a* and 162*a* with a fastener 204, and distal gripper 155 is connected to straightened arm portions 163*a* and 164*a* with a fastener 205. Proximal gripper 154 and distal gripper 155 can have many different designs, one of which will be discussed in more detail with FIGS. 6*d* and 6*e*. It should be noted that the fasteners disclosed herein can be of many different types, such as nuts and bolts, pins, etc.

In this embodiment, clamp assembly 150 includes a clamp assembly cylinder 153 which extends between proximal arm assembly 151 and distal arm assembly 152, as shown in FIGS. 6*a* and 6*b*. Clamp assembly cylinder 153 is positioned so it extends between curved arm portions 161*b* and 163*b*. Clamp assembly cylinder 153 is positioned so it extends between curved arm portions 162*b* and 164*b*. Clamp assembly cylinder 153 is positioned so that proximal gripper 154 and distal gripper 155 move towards and away from each other in response to moving clamp assembly cylinder 153 between extended and retracted positions, respectively, as will be discussed in more detail with FIGS. 7*c* and 7*d*. It should be noted that clamp assembly cylinder 153 is operatively coupled to break-out assembly hydraulic system 119, which is shown in FIGS. 1*b* and 2*a*. Break-out assembly hydraulic system 119 provides energy to clamp assembly cylinder 153 so that it can move between the extended and retracted positions.

Clamp assembly cylinder 153 can be coupled to proximal arm assembly 151 and distal arm assembly 152 in many different ways. In this embodiment, an end of clamp assembly cylinder 153 extends between curved arm portions 161*b* and 162*b*, and an opposed end of clamp assembly cylinder 153 extends between curved arm portions 163*b* and 164*b*. A fastener 200 (FIGS. 6*a* and 6*b*) extends through curved arm portions 161*b* and 162*b* and the end of clamp assembly cylinder 153 between curved arm portions 161*b* and 162*b*, and a fastener 201 (FIGS. 6*a* and 6*b*) extends through curved arm portions 163*b* and 164*b* and the opposed end of clamp assembly cylinder 153 between curved arm portions 163*b* and 164*b*. In this way, opposed ends of clamp assembly cylinder 153 are coupled to proximal arm assembly 151 and distal arm assembly 152, respectively.

Figure 6D:
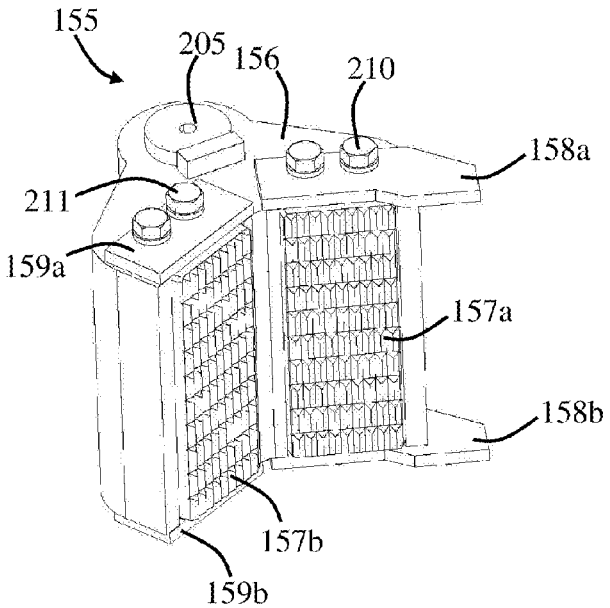
FIGS. 6*d* and 6*e* are front and back perspective views, respectively, of a distal gripper of the clamp assembly of FIGS. 6*a* and 6*b*.
Figure 6E:
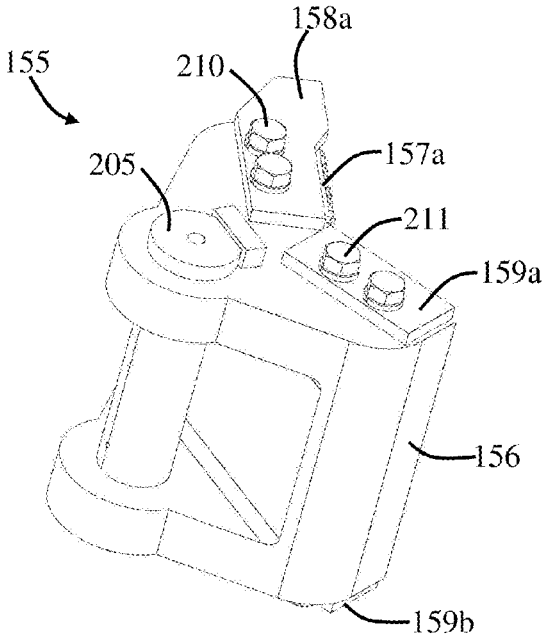

FIGS. 6*d* and 6*e* are front and back perspective views, respectively, of distal gripper 155. It should be noted that proximal gripper 154 generally includes the same components as distal gripper 155. In this embodiment, distal gripper 155 includes a gripper body 156, which carries an inner grip pad 157*a* and outer grip pad 157*b*. Inner grip pad 157*a* and outer grip pad 157*b* can include many different types of material. For example, in some embodiments, the material of inner grip pad 157*a* and outer grip pad 157*b* is resilient material, such as rubber. In other embodiments, the material of inner grip pad 157*a* and outer grip pad 157*b* is non-resilient material, such as metal. The material of inner grip pad 157*a* and outer grip pad 157*b* is chosen so that pads 157*a* and 157*b* can grip a drill pipe of a drill string and restrict it from rotating. For example, as discussed in more detail below with FIGS. 12*a*-12*f*, drill pipe 115 of drill string 110 is gripped by pads 157*a* and 157*b* to restrict it from rotating.

Inner grip pad 157*a* and outer grip pad 157*b* are positioned on gripper body 156 so that their outwardly facing major surfaces are at a non-zero angle relative to each other. Inner grip pad 157*a* and outer grip pad 157*b* are positioned on gripper body 156 so that they can grip a drill pipe with a circular cross-section when clamp assembly 150 is in the closed condition.

Inner grip pad 157*a* and outer grip pad 157*b* can be held to gripper body 156 in many different ways. In this embodiment, inner grip pad 157*a* is held to gripper body 156 by an upper grip pad bracket 158*a* and lower grip pad bracket 158*b*. Further, outer grip pad 157*b* is held to gripper body 156 by an upper grip pad bracket 159*a* and lower grip pad bracket 159*b*. Brackets 158*a*, 158*b*, 159*a* and 159*b* can be held to gripper body 156 in many different ways, such as by using fasteners. In this embodiment, brackets 158*a* and 158*b* are held to gripper body 156 using a fastener 210, and brackets 159*a* and 159*b* are held to gripper body 156 using a fastener 211. It should be noted that inner grip pad 157*a* and outer grip pad 157*b* are generally held to gripper body 156 in a repeatably removable manner so that they can be easily removed from gripper body 156 and replaced, such as when they wear down.

In this embodiment, proximal gripper 154 is carried by proximal arm assembly 151 by attaching it thereto with a pin 204, as shown in FIGS. 6*a* and 6*b*. Pin 204 extends through straightened arm portion 161*a* and straightened arm portion 162*a*, as well as through gripper body 156 of gripper 154. Further, proximal gripper 155 is carried by proximal arm assembly 152 by attaching it thereto with a pin 205. Pin 205 extends through straightened arm portion 163*a* and straightened arm portion 164*a*, as well as through gripper body 156 of gripper 155.

FIGS. 7*a* and 7*b* are perspective views of clamp assembly 150 being carried by clamp pivot assembly 130. Clamp assembly 150 can be carried by clamp pivot assembly 130 in many different ways. In this embodiment, a proximal pivot pin 202 extends between upper proximal arm 151*a* and lower proximal arm 151*b* and through clamp assembly rotation arm 135. Proximal pivot pin 202 allows proximal arm assembly 151 to rotate in response to clamp assembly cylinder 153 moving between the extended and retracted positions. Proximal pivot pin 202 allows proximal arm assembly 151 to rotate relative to clamp assembly rotation arm 135 in response to clamp assembly cylinder 153 moving between the extended and retracted positions.

Further, a distal pivot pin 203 extends between upper distal arm 152*a* and lower distal arm 152*b* and through clamp assembly rotation arm 135. Distal pivot pin 203 allows distal arm assembly 152 to rotate in response to clamp assembly cylinder 153 moving between the extended and retracted positions. Proximal pivot pin 203 allows distal arm assembly 152 to rotate relative to clamp assembly rotation arm 135 in response to clamp assembly cylinder 153 moving between the extended and retracted positions. Clamp assembly 150 moves between open and closed conditions in response to moving clamp assembly cylinder 153 between extended and retracted positions, respectively.

As mentioned above, proximal and distal arm assemblies 151 and 152 rotate about separate pivot points, which correspond to proximal and distal pivot pins 202 and 203, respectively. Proximal and distal pivot pins 202 and 203 are on opposed sides of drill string 110 when clamp assembly 150 clamps drill string 110. Proximal and distal arm assemblies 151 and 152 rotate about proximal and distal pivot pins 202 and 203 on opposed sides of drill string 110 so that they can clamp opposed sides of drill string 110. Proximal and distal pivot pins 202 and 203 are on opposed sides of drill string 110 to allow clamp assembly 150 to apply a larger force to drill string 110 to break pipe interface 109.

FIGS. 7*c* and 7*d* are top views of clamp assembly 150 in open and closed conditions, respectively. As shown in FIG. 7*c*, and with reference to FIG. 6*c*, clamp assembly 150 is moved to the open condition when straightened arm portions 161*a* and 163*a* move away from each other. Further, clamp assembly 150 is moved to the open condition when straightened arm portions 162*a* and 164*a* move away from other. As mentioned above, gripper 154 is carried by straightened arm portions 161*a* and 162*a*, and gripper 155 is carried by straightened arm portions 163*a* and 164*a*. Hence, clamp assembly 150 is moved to the open condition when grippers 154 and 155 are moved away from each other. Clamp assembly 150 is moved to the open condition when curved arm portions 161*b* and 163*b* move towards each other. Further, clamp assembly 150 is moved to the open condition when curved arm portions 162*b* and 164*b* move towards each other.

Straightened arm portions 161*a* and 163*a* move away from each other in response to clamp assembly cylinder 153 moving to the retracted position. Further, straightened arm portions 162*a* and 164*a* move away from each other in response to clamp assembly cylinder 153 moving to the retracted position. Curved arm portions 161*b* and 163*b* move towards each other in response to clamp assembly cylinder 153 moving to the retracted position. Further, curved arm portions 162*b* and 164*b* move towards each other in response to clamp assembly cylinder 153 moving to the retracted position. Hence, clamp assembly 150 is moved to the open condition in response to moving clamp assembly rotation cylinder 132 to the retracted position. Clamp assembly 150 is moved to the open condition so that drill string 110 can be positioned between grippers 154 and 155, as will be discussed in more detail with FIGS. 11*a*-11*f* and FIGS. 12*a*-12*f*.

As shown in FIG. 7*d*, and with reference to FIG. 6*c*, clamp assembly 150 is moved to the closed condition when straightened arm portions 161*a* and 163*a* move towards each other. Further, clamp assembly 150 is moved to the closed condition when straightened arm portions 162*a* and 164*a* move towards each other. As mentioned above, gripper 154 is carried by straightened arm portions 161*a* and 162*a*, and gripper 155 is carried by straightened arm portions 163*a* and 164*a*. Hence, clamp assembly 150 is moved to the closed condition when grippers 154 and 155 are moved towards each other. Clamp assembly 150 is moved to the closed condition when curved arm portions 161*b* and 163*b* move away from each other. Further, clamp assembly 150 is moved to the closed condition when curved arm portions 162*b* and 164*b* move away from each other.

Straightened arm portions 161*a* and 163*a* move towards each other in response to clamp assembly cylinder 153 moving to the extended position. Further, straightened arm portions 162*a* and 164*a* move towards each other in response to clamp assembly cylinder 153 moving to the extended position. Curved arm portions 161*b* and 163*b* move away from each other in response to clamp assembly cylinder 153 moving to the extended position. Further, curved arm portions 162*b* and 164*b* move away from each other in response to clamp assembly cylinder 153 moving to the extended position. Hence, clamp assembly 150 is moved to the closed condition in response to moving clamp assembly rotation cylinder 132 to the extended position. Clamp assembly 150 is moved to the closed condition so that drill string 110 can be gripped by grippers 154 and 155, as will be discussed in more detail with FIGS. 12*a*-12*f*.

As mentioned above, clamp assembly 150 can apply a larger clamping force to drill pipe 115 because the curved arm portions of proximal arm assembly 151 and distal arm assembly 152 allow more leverage to be applied to the corresponding straightened arm portions. Curved arm portions of proximal arm assembly 151 and distal arm assembly 152 allow more leverage to be applied to the corresponding straightened arm portions because they allow clamp assembly cylinder 153 to apply a larger force to them when in the extended position. Clamp assembly cylinder 153 can apply a larger force to proximal arm assembly 151 and distal arm assembly 152 when in the extended position because the curved arm portions allow clamp assembly cylinder 153 to be longer in the extended position.

For example, as shown in FIG. 7*d*, clamp assembly cylinder 153 is attached between distal ends 165*a* and 165*b* of proximal arm assembly 151 and distal arm assembly 152, respectively. Clamp assembly cylinder 153 can be longer in the extended condition the further distal ends 165*a* and 165*b* are away from each other. Further, clamp assembly cylinder 153 is shorter in the extended condition the closer distal ends 165*a* and 165*b* are to each other. Hence, curved arm portions 161*b*, 162*b*, 163*b* and 164*b* are useful because they allow clamp assembly cylinder 153 to be longer in the extended position, which allows a larger clamping force to be applied to drill pipe 115.

It should be noted that another advantage of clamp assembly 150 is that it can clamp drill pipes of different diameters. During normal use, a drill pipe wears down in such a way that its diameter changes. Clamp assembly 150 can clamp drill pipes having different diameters due to such wear. Clamp assembly 150 can accommodate drill pipes of different diameters because the distance between grippers 154 and 155 can be controlled by clamp assembly cylinder 153. The distance between grippers 154 and 155 is controlled by clamp assembly cylinder 153 to reduce the likelihood of slippage occurring between grippers 154 and 155 and the drill pipe.

FIGS. 8*a* and 8*b* are front and back perspective views, respectively, of slide wrench assembly 170. An example of a slide wrench assembly is disclosed in the above-referenced U.S. Patent Application No. 20030056989. In this embodiment, slide wrench assembly 170 includes a slide wrench base plate 171 having a base plate opening 172 extending therethrough. Slide wrench assembly 170 includes a slide wrench 173 having a slide wrench opening 174 extending therethrough. Slide wrench 173 is repeatably moveable relative to slide wrench base plate 171 so that slide wrench opening 174 is repeatably moveable relative to base plate opening 172.

In this embodiment, slide wrench assembly 170 includes a slide wrench side rail 175*a* and slide wrench side rail 175*b* attached to opposed sides of slide wrench 173. Slide wrench assembly 170 includes a slide wrench back rail 175*c* attached to slide wrench base plate 171. Slide wrench assembly 170 includes a cylinder support plate 176*a* attached to slide wrench side rail 175*a* and a cylinder support plate 176*b* attached to slide wrench side rail 175*b*. Slide wrench assembly 170 includes a slide wrench cylinder 177*a* with one end attached to slide wrench back rail 175*c* through a fastener 178*b* and an opposed end attached to cylinder support plate 176*a* through a fastener 178*a*. Further, slide wrench assembly 170 includes a slide wrench cylinder 177*b* with one end attached to slide wrench back rail 175*c* through a fastener 179*b* and an opposed end attached to cylinder support plate 176*b* through a fastener 179*a*. Fasteners 178*a*, 178*b*, 179*a* and 179*b* can be of many different types and can include many different components, such as brackets and pins.

Figure 8C:
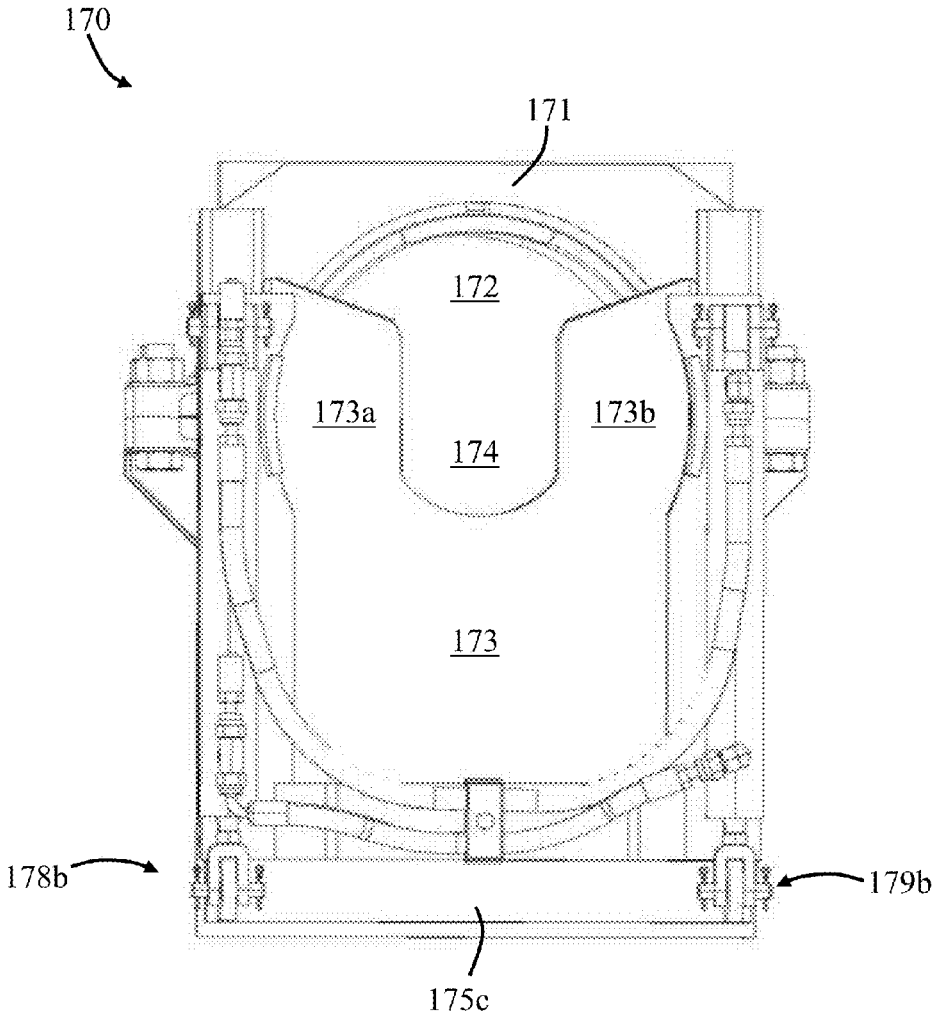
FIGS. 8*c* and 8*d* are top views of the slide wrench assembly of FIGS. 8*a* and 8*b* in engaged and disengaged positions, respectively.
Figure 8D:
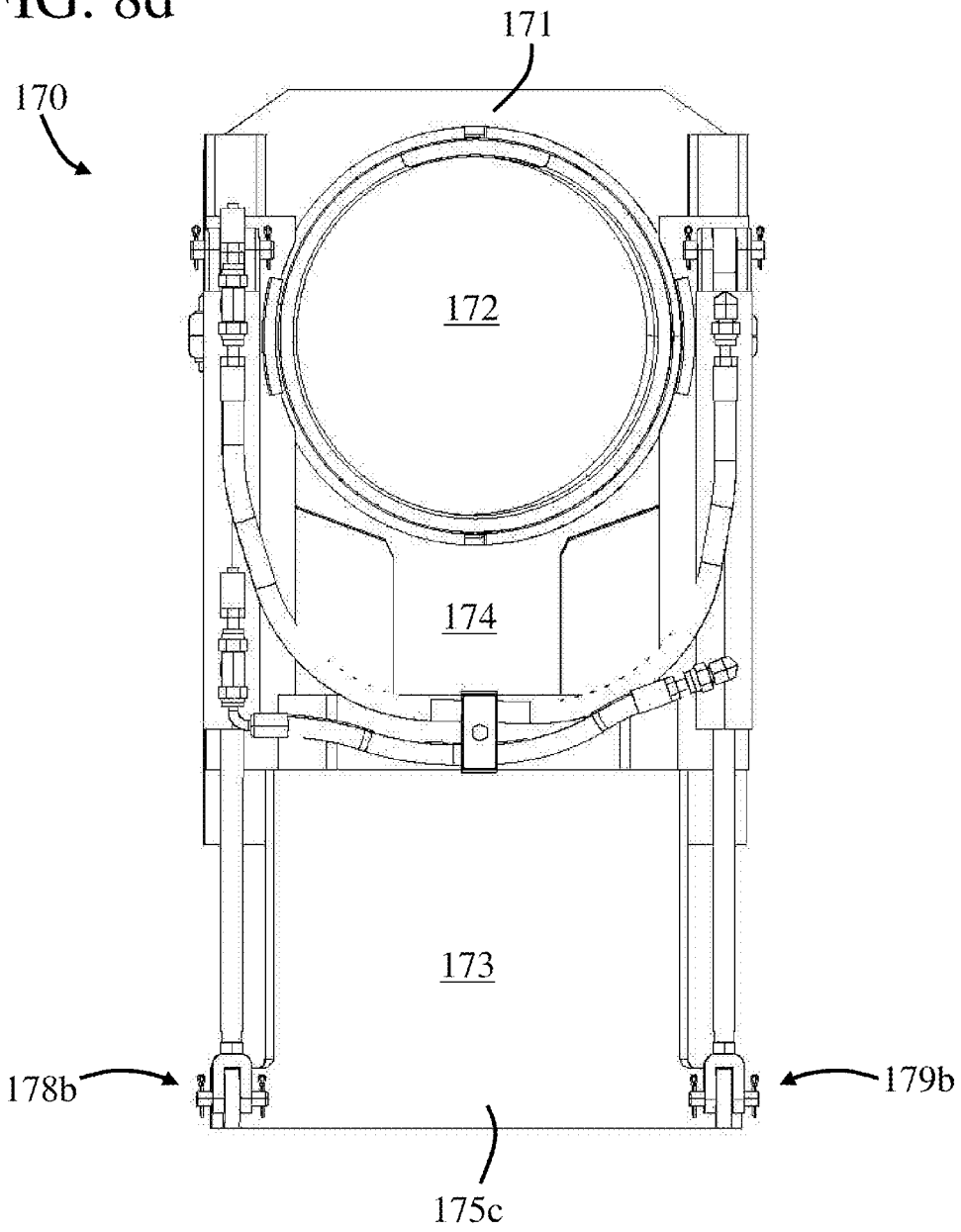

FIGS. 8*c* and 8*d* are top views of slide wrench assembly 170 in engaged and disengaged positions, respectively. In the engaged position, slide wrench assembly 170 engages the lower drill pipe and, in the disengaged position, slide wrench assembly 170 disengages the lower drill pipe. In one particular example, in the engaged position, slide wrench assembly 170 engages drill pipe 111 and, in the disengaged position, slide wrench assembly 170 disengages drill pipe 111, wherein drill pipe 111 is in the lower position.

In operation, cylinder support plates 176*a* and 176*b* move away from slide wrench back rail 175*c* in response to slide wrench cylinders 177*a* and 177*b* moving to extended positions. Cylinder support plate 176*a* moves away from slide wrench back rail 175*c* in response to slide wrench cylinder 177*a* moving to the extended position because, as mentioned above, one end of slide wrench cylinder 177*a* is connected to slide wrench back rail 175*c* through fastener 178*b* and an opposed end of slide wrench cylinder 177*a* is connected to cylinder support plate 176*a* through fastener 178*a*. Further, cylinder support plate 176*b* moves away from slide wrench back rail 175*c* in response to slide wrench cylinder 177*b* moving to the extended position because, as mentioned above, one end of slide wrench cylinder 177*b* is connected to slide wrench back rail 175*c* through fastener 179*b* and an opposed end of slide wrench cylinder 177*b* is connected to cylinder support plate 176*b* through fastener 179*a*.

Slide wrench side rails 175*a* and 175*b* move away from slide wrench back rail 175*c* in response to slide wrench cylinders 177*a* and 177*b* moving to extended positions. Slide wrench side rail 175*a* moves away from slide wrench back rail 175*c* in response to slide wrench cylinder 177*a* moving to the extended position because, as mentioned above, slide wrench side rail 175*a* is connected to cylinder support plate 176*a*. Hence, slide wrench side rail 175*a* moves in response to movement of cylinder support plate 176*a*. Further, slide wrench side rail 175*b* moves away from slide wrench back rail 175*c* in response to slide wrench cylinder 177*b* moving to the extended position because, as mentioned above, slide wrench side rail 175*b* is connected to cylinder support plate 176*b*. Hence, slide wrench side rail 175*b* moves in response to movement of cylinder support plate 176*b*.

Slide wrench 173 moves away from slide wrench back rail 175*c* in response to slide wrench cylinders 177*a* and 177*b* moving to extended positions. Slide wrench 173 moves away from slide wrench back rail 175*c* in response to slide wrench cylinders 177*a* and 177*b* moving to extended positions because, as mentioned above, slide wrench side rails 175*a* and 175*b* are coupled to opposed sides of slide wrench 173. Hence, slide wrench 173 moves in response to movement of slide wrench side rails 175*a* and 175*b*. It should be noted that slide wrench opening 174 moves in response to movement of slide wrench 173. In this embodiment, slide wrench 173 includes opposed slide wrench jaws 173*a* and 173*b*, space apart by slide wrench opening 174. Slide wrench opening 174, and slide wrench jaws 173*a* and 173*b*, are repeatably moveable towards and away from base plate opening 172.

In the engaged position, slide wrench assembly 170 restricts the rotation of drill pipe 111 relative to slide wrench base plate 171. However, slide wrench assembly 170 applies a rotational force to drill pipe 111 in response to rotation of slide wrench assembly 170. Slide wrench assembly 170 can be rotated in many different ways, one of which will be discussed in more detail presently.

Figure 9A:
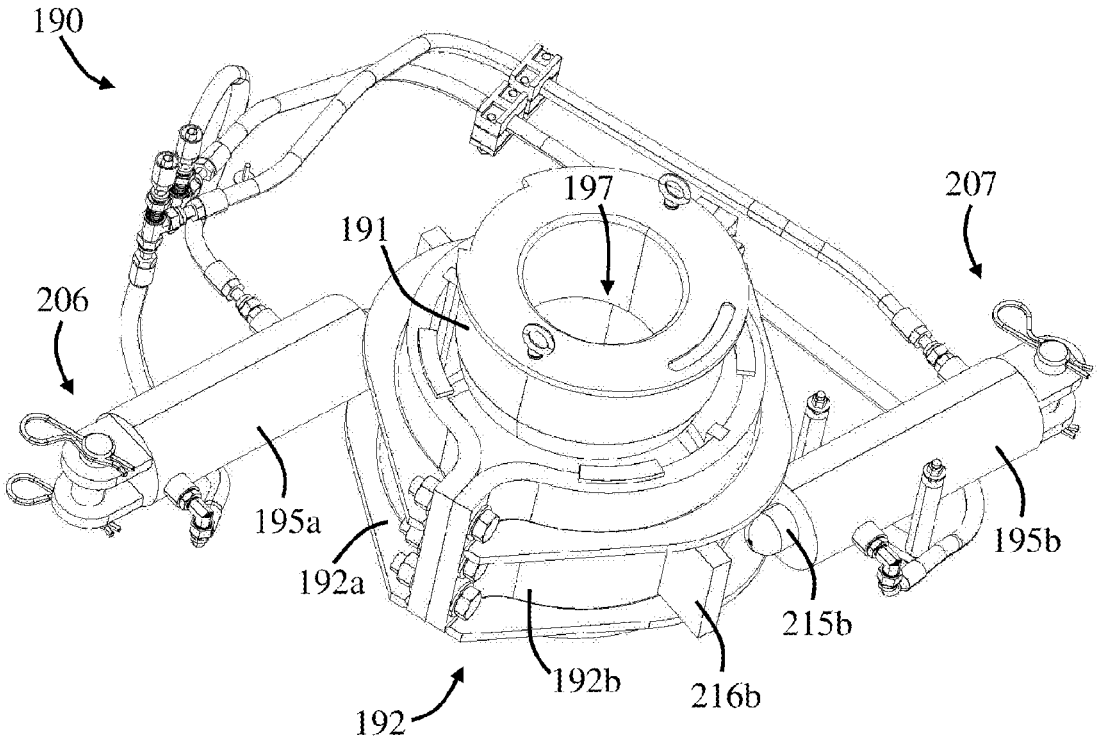
FIGS. 9*a* and 9*b* are top and bottom perspective views, respectively, of a slide wrench rotator assembly.
Figure 9B:
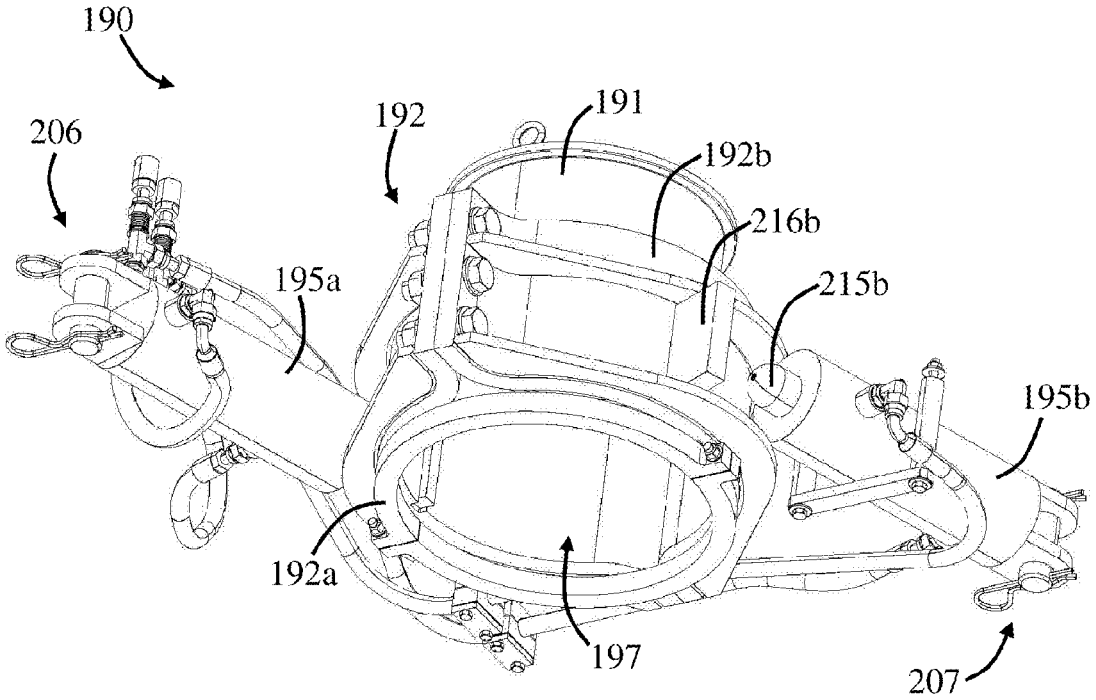
Figure 9C:
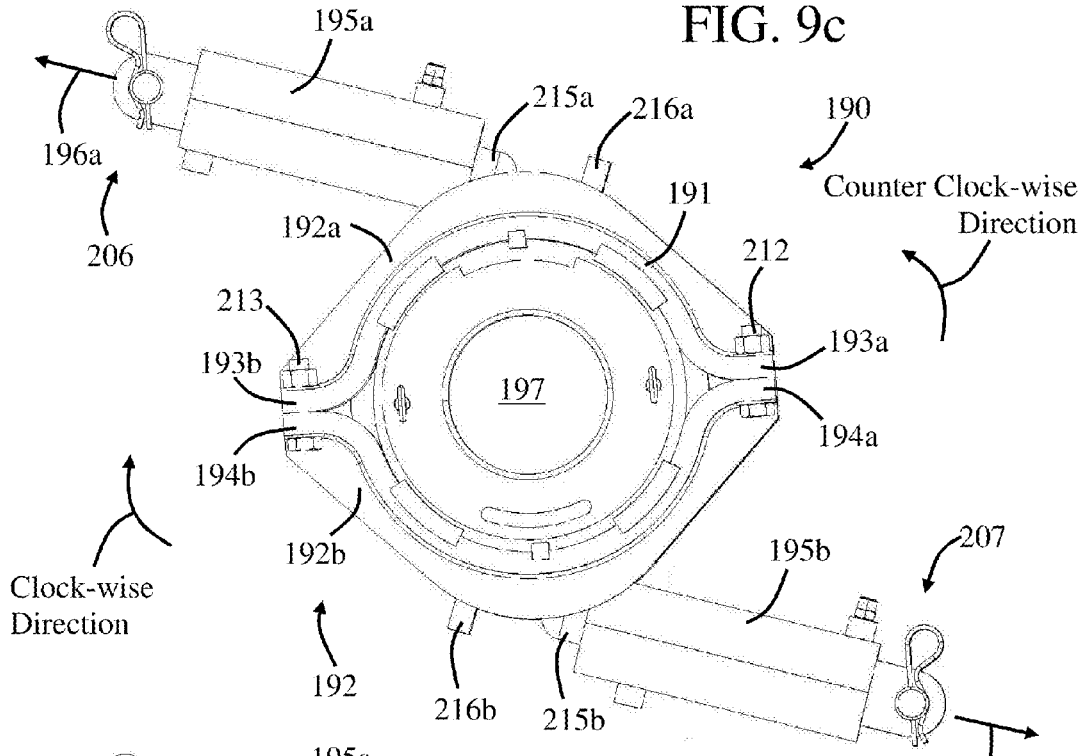
FIGS. 9*c* and 9*d* are top views of the slide wrench rotator assembly of FIGS. 9*a* and 9*b* with cylinders in retracted and extended positions, respectively.
Figure 9D:
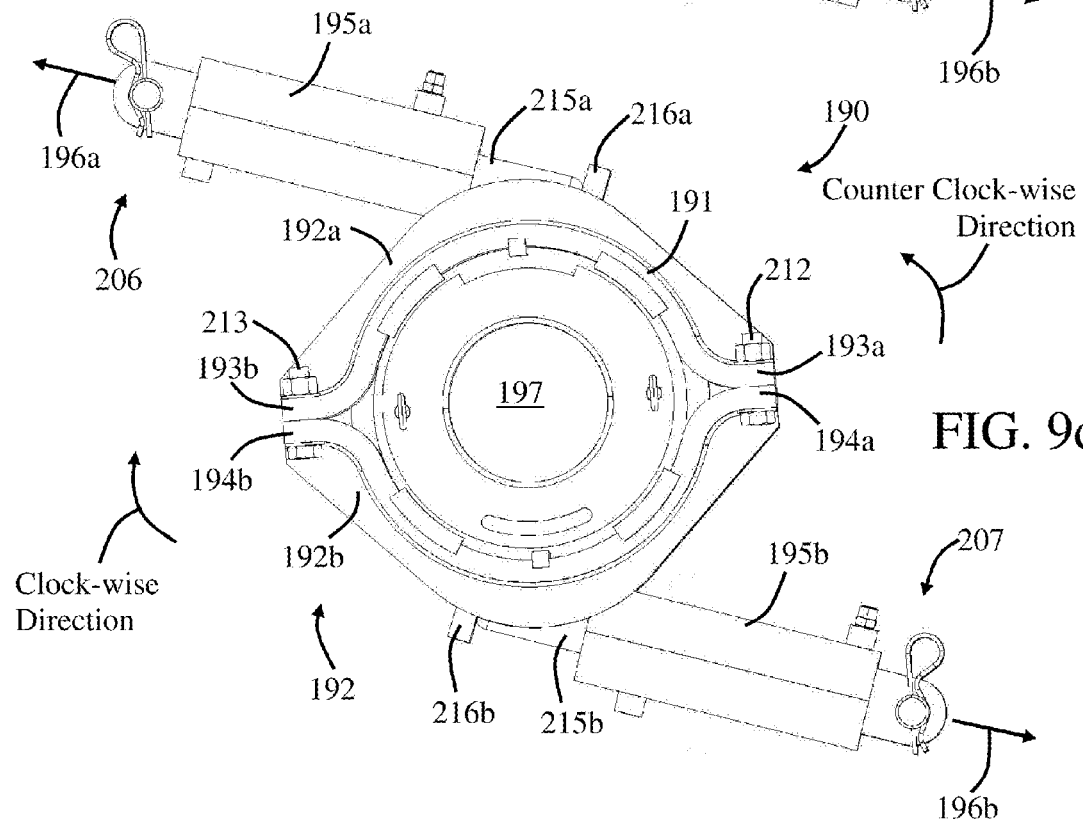

FIGS. 9*a* and 9*b* are top and bottom perspective views, respectively, of slide wrench rotator assembly 190, and FIGS. 9*c* and 9*d* are top views of slide wrench rotator assembly 190. In this embodiment, slide wrench rotator assembly 190 includes a slide wrench coupler and drill string sleeve 191, which is coupled to slide wrench assembly 170, as shown in a bottom perspective view of slide wrench coupler and drill string sleeve 191 and slide wrench assembly 170 in FIG. 9*e*. Slide wrench coupler and drill string sleeve 191 is coupled to slide wrench assembly 170 so that slide wrench assembly 170 rotates in response to rotation of slide wrench coupler and drill string sleeve 191, as discussed in more detail below with FIGS. 10*a*-10*c*.

Figure 9E:
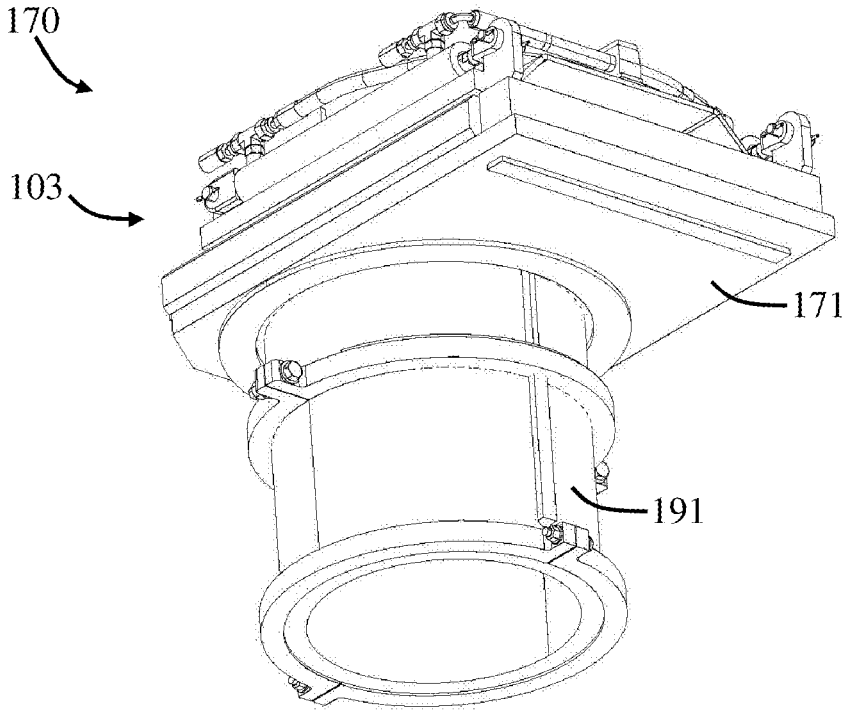
FIG. 9*e* is a bottom perspective view of a slide wrench coupler and drill string sleeve of the slide wrench rotator assembly coupled to the slide wrench assembly of FIGS. 8*a*, 8*b* and 8*c*.

Slide wrench coupler and drill string sleeve 191 can be coupled to slide wrench assembly 170 in many different ways. In this embodiment, slide wrench coupler and drill string sleeve 191 is coupled to slide wrench base plate 171, as shown in FIG. 9*e*. Slide wrench coupler and drill string sleeve 191 is cylindrical in shape with a central opening 197 extending therethrough (FIGS. 9*a*-9*d*). Slide wrench coupler and drill string sleeve 191 is coupled to slide wrench base plate 171 so that central opening 197 faces base plate opening 172 (FIGS. 8*a*, 8*c* and 8*d*). Central opening 197 and base plate opening 172 are dimensioned to receive drill string 110 (FIGS. 11*a*, 12*b* and 12*e*). In this way, drill string 110 can extend through base plate opening 172 and central opening 197.

Figure 10A:
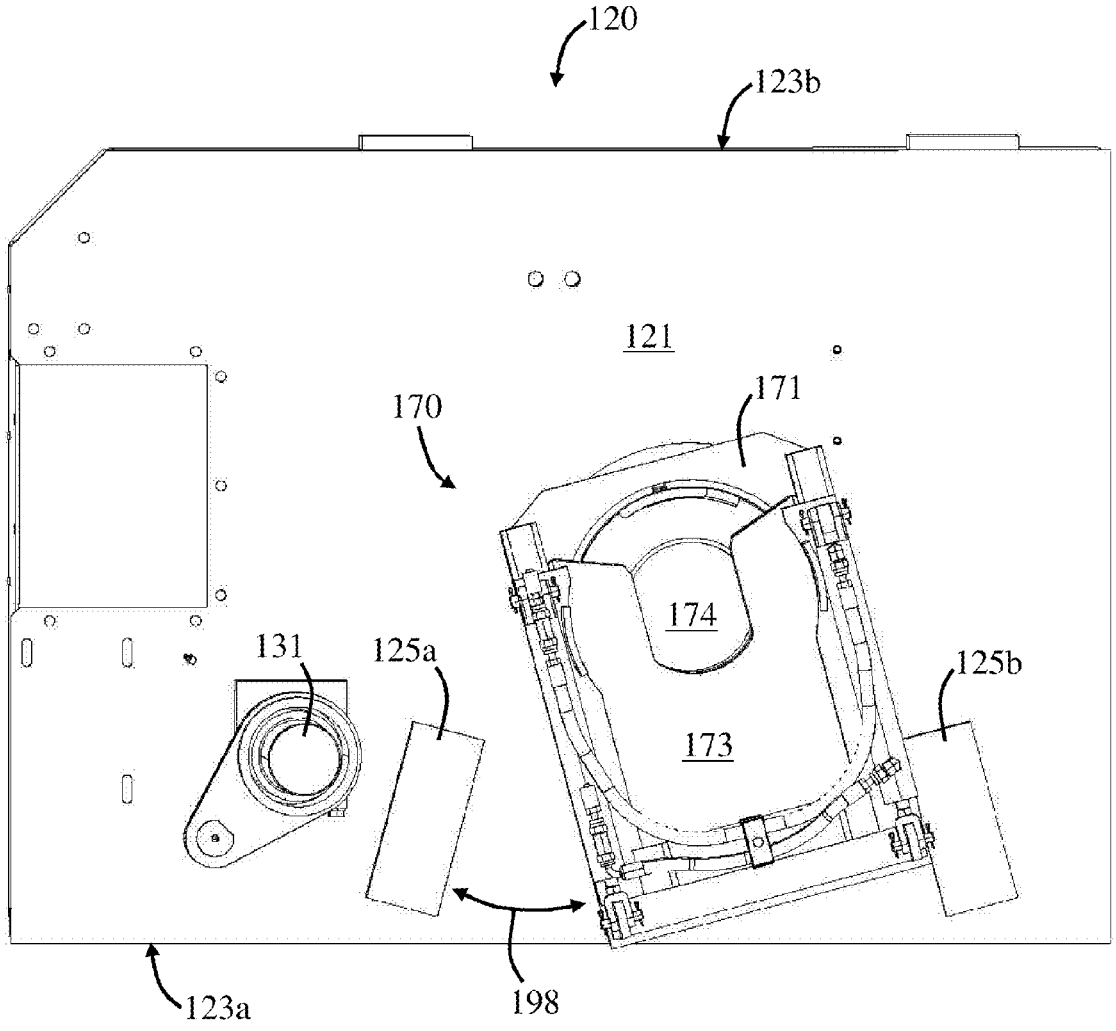
FIG. 10*a* is a top view of the table of FIG. 4*a* and the slide wrench assembly of FIGS. 8*a* and 8*b*, wherein the slide wrench assembly is in a first angled position.
Figure 10B:
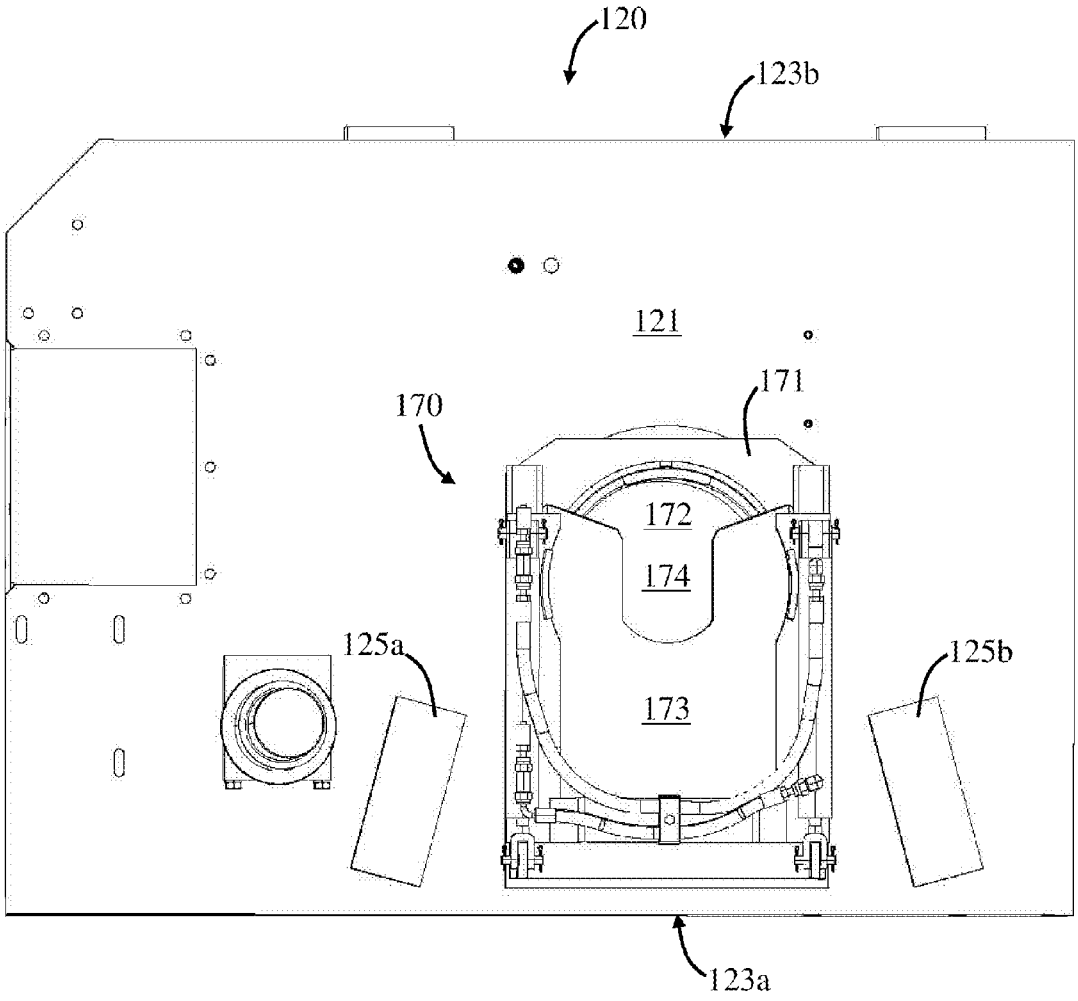
FIG. 10*b* is a top view of the table of FIG. 4*a* and the slide wrench assembly of FIGS. 8*a* and 8*b*, wherein the slide wrench assembly is in a central position.
Figure 10C:
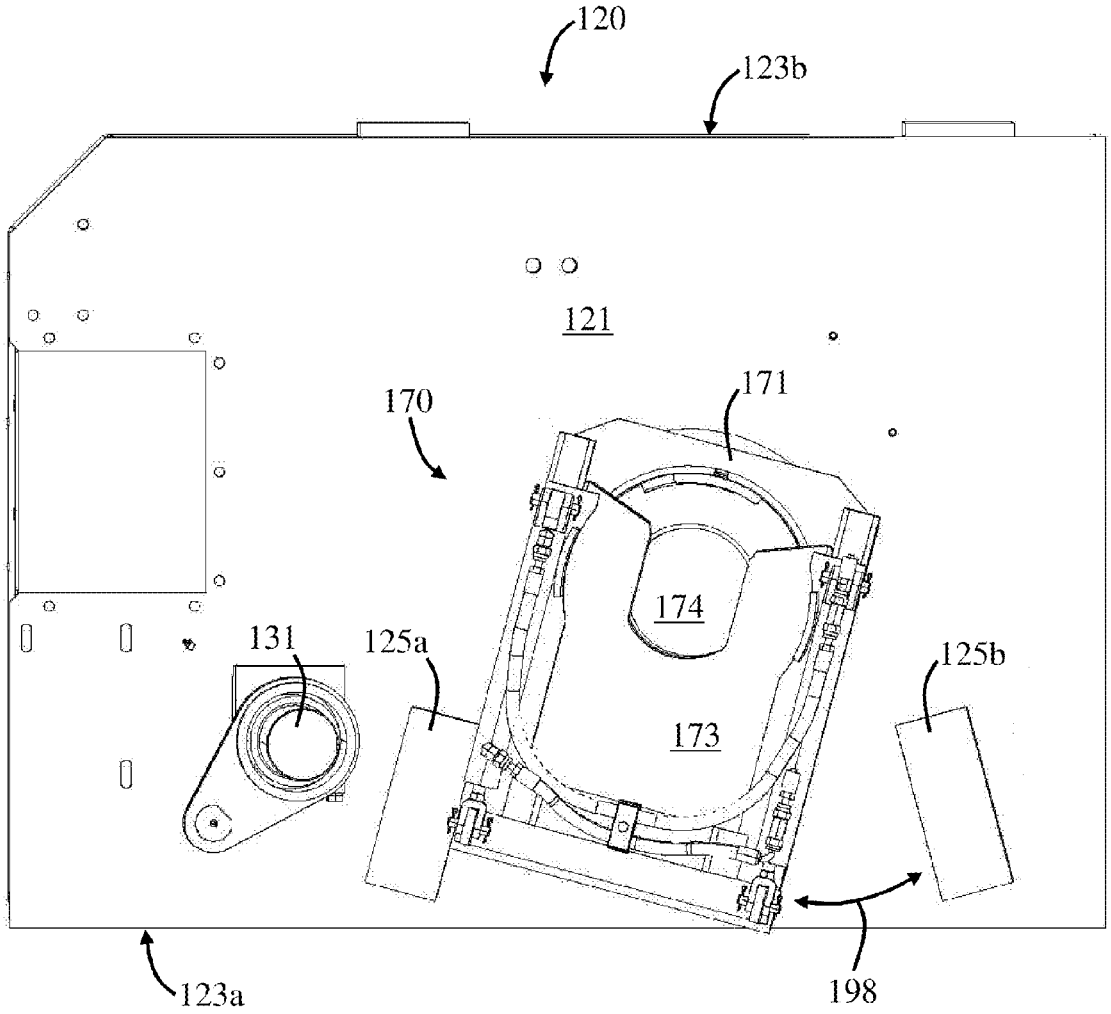
FIG. 10*c* is a top view of the table of FIG. 4*a* and the slide wrench assembly of FIGS. 8*a* and 8*b*, wherein the slide wrench assembly is in a second angled position.
Figure 10D:
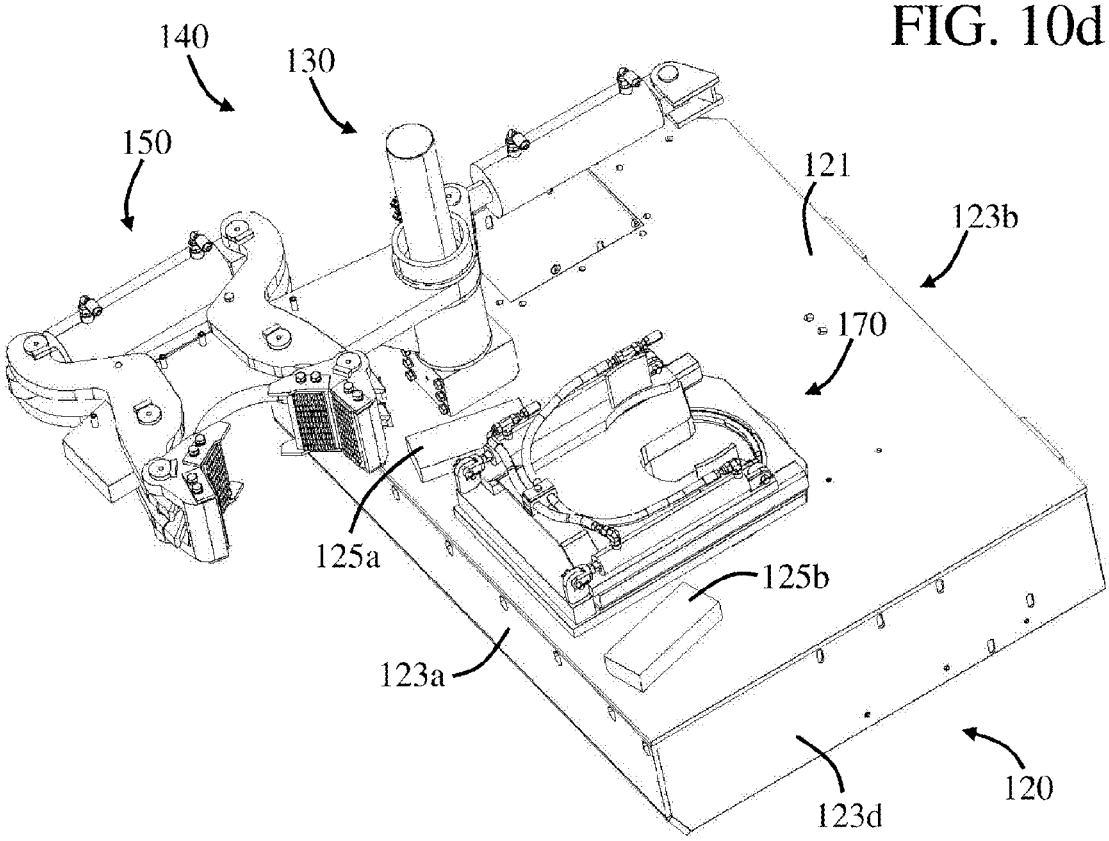
FIGS. 10*d* and 10*e* are top and bottom perspective views of the break-out assembly and table of FIG. 1*a*.
Figure 10E:
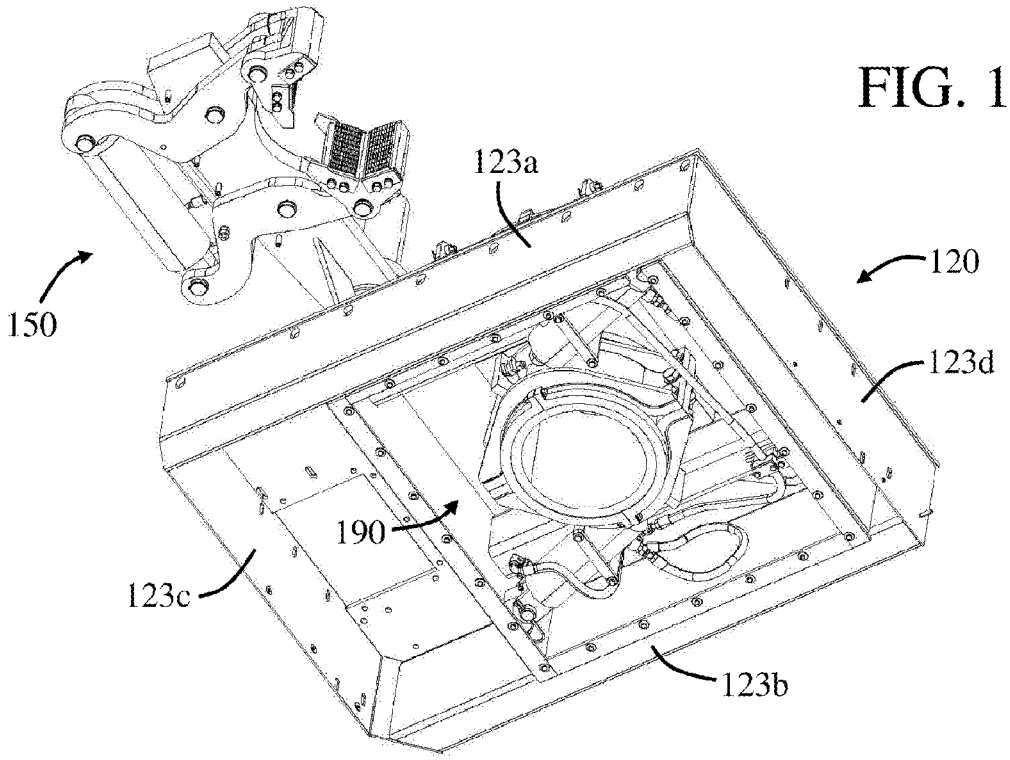

It should be noted that clamp pivot assembly 130, clamp assembly 150 and slide wrench assembly 170 are positioned above table top 121, as shown in FIG. 10*d*, and slide wrench rotator assembly 190 is positioned below table top 121, as shown in FIG. 10*e*. Slide wrench rotator assembly 190 is positioned below table top 121 and is bounded by inner front sidewall 124*a*, inner back sidewall 124*b*, inner distal sidewall 124*c* and inner proximal sidewall 124*d* (FIG. 1*e*). In this way, drill string 110 can extend through the central opening of slide wrench coupler and drill string sleeve 191 and base plate opening 172 and a volume bounded by inner front sidewall 124*a*, inner back sidewall 124*b*, inner distal sidewall 124*c* and inner proximal sidewall 124*d*. In particular, the lower drill pipe extends through the central opening of slide wrench coupler and drill string sleeve 191 and base plate opening 172 and a volume bounded by inner front sidewall 124*a*, inner back sidewall 124*b*, inner distal sidewall 124*c* and inner proximal sidewall 124*d*.

Slide wrench assembly 170 is positioned above slide wrench coupler and drill string sleeve 191. Further, slide wrench coupler and drill string sleeve 191 is positioned below slide wrench assembly 170. Slide wrench assembly 170 and slide wrench coupler and drill string sleeve 191 are positioned on opposed sides of table top 121. Further, slide wrench assembly 170 and slide wrench coupler and drill string sleeve 191 are positioned on opposed sides of table top opening 122.

Slide wrench rotator assembly 190 is coupled to table 120 and slide wrench assembly 170 is coupled to slide wrench rotator assembly 190. Slide wrench rotator assembly 190 can be coupled to table 120 in many different ways, one of which is described in more detail with FIGS. 10*f* and 10*g*. In this embodiment, slide wrench rotator assembly 190 is coupled to table 120 so that a symmetrical rotational force is applied to slide wrench assembly 170 by slide wrench rotator assembly 190, as discussed in more detail with FIGS. 9*c* and 9*d*. The symmetrical rotational force can be applied to slide wrench assembly 170 by slide wrench rotator assembly 190 in many different ways, one of which will be discussed in more detail presently.

Figure 9F:
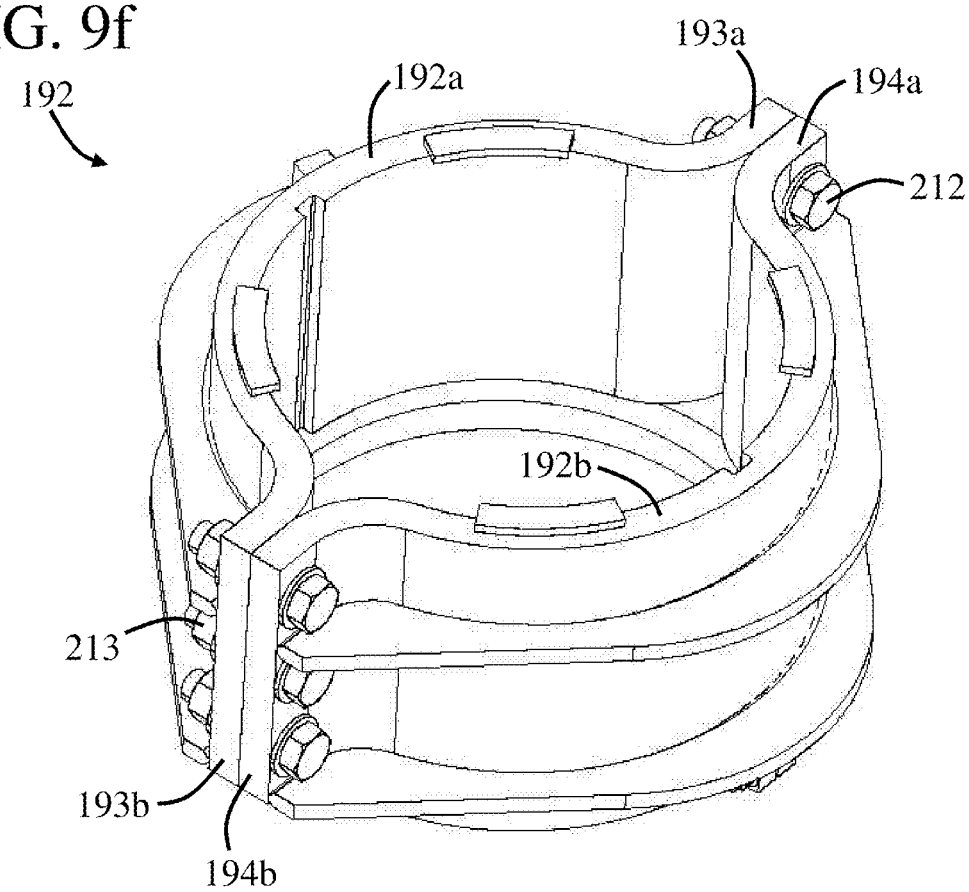
FIG. 9*f* is a top perspective view of a rotator assembly clamp of the slide wrench rotator assembly of FIGS. 9*a* and 9*b*.

In this embodiment, slide wrench rotator assembly 190 includes a rotator assembly clamp 192, as shown in a top perspective view in FIG. 9*f*. Rotator assembly clamp 192 is clamped to slide wrench coupler and drill string sleeve 191, as shown in FIGS. 9*a*-9*d*. Rotator assembly clamp 192 can be clamped to slide wrench coupler and drill string sleeve 191 in many different ways.

In this embodiment, rotator assembly clamp 192 includes a clamp portion 192*a* and clamp portion 192*b* (FIG. 9*f*), which clamp to slide wrench coupler and drill string sleeve 191. In this embodiment, clamp portion 192*a* includes clamp flanges 193*a* and 193*b*, and clamp portion 192*b* includes clamp flanges 194*a* and 194*b*. Clamp flange 193*a* is fastened to clamp flange 194*a* and clamp flange 193*b* is fastened to clamp flange 194*b* so that clamp portions 192*a* and 192*b* are fastened together to form an opening extending therebetween. Clamp flange 193*a* can be fastened to clamp flange 194*a* in many different ways, such as by using a fastener 212. Further, clamp flange 193*b* can be fastened to clamp flange 194*b* in many different ways, such as by using a fastener 213. In this embodiment, fasteners 212 and 213 are embodied as nuts and bolts.

Slide wrench coupler and drill string sleeve 191 extends through the central opening formed by clamp portions 192*a* and 192*b*, and is clamped between clamp portions 192*a* and 192*b*. The clamping force between clamp portions 192*a* and 192*b* and slide wrench coupler and drill string sleeve 191 can be adjusted in many different ways, such as by tightening and loosening fasteners 212 and 213. In this way, rotator assembly clamp 192 is clamped to slide wrench coupler and drill string sleeve 191. Rotator assembly clamp 192 is clamped to slide wrench coupler and drill string sleeve 191 so that slide wrench coupler and drill string sleeve 191 rotates in response to the rotation of rotator assembly clamp 192. Rotator assembly clamp 192 can be rotated in many different ways, one of which will be discussed in more detail presently.

Figure 9G:
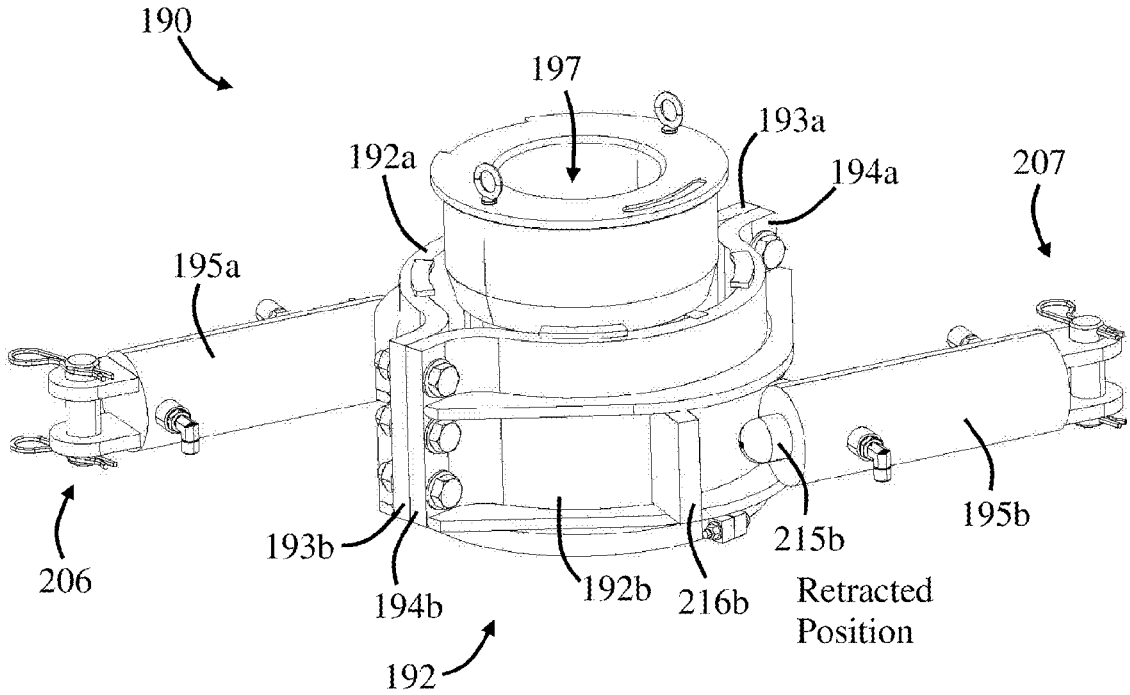
FIGS. 9*g* and 9*h* are perspective views of the slide wrench rotator assembly of FIGS. 9*a* and 9*b* with cylinders in retracted and extended positions, respectively.
Figure 9H:
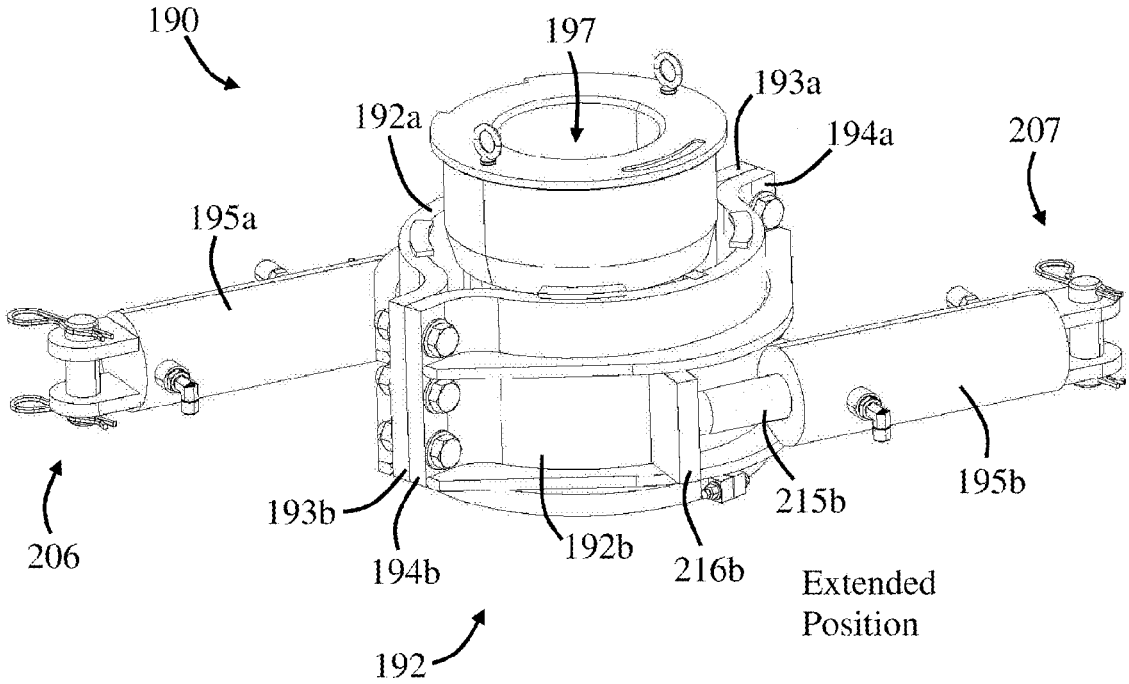

FIGS. 9*g* and 9*h* are side perspective views of one embodiment of slide wrench rotator assembly 190. In this embodiment, slide wrench rotator assembly 190 includes rotator assembly cylinders 195*a* and 195*b*, which include rotator assembly cylinder pins 215*a* and 215*b*, respectively. Rotator assembly cylinder pins 215*a* and 215*b* can be seen in FIGS. 9*c* and 9*d*.

Figure 10F:
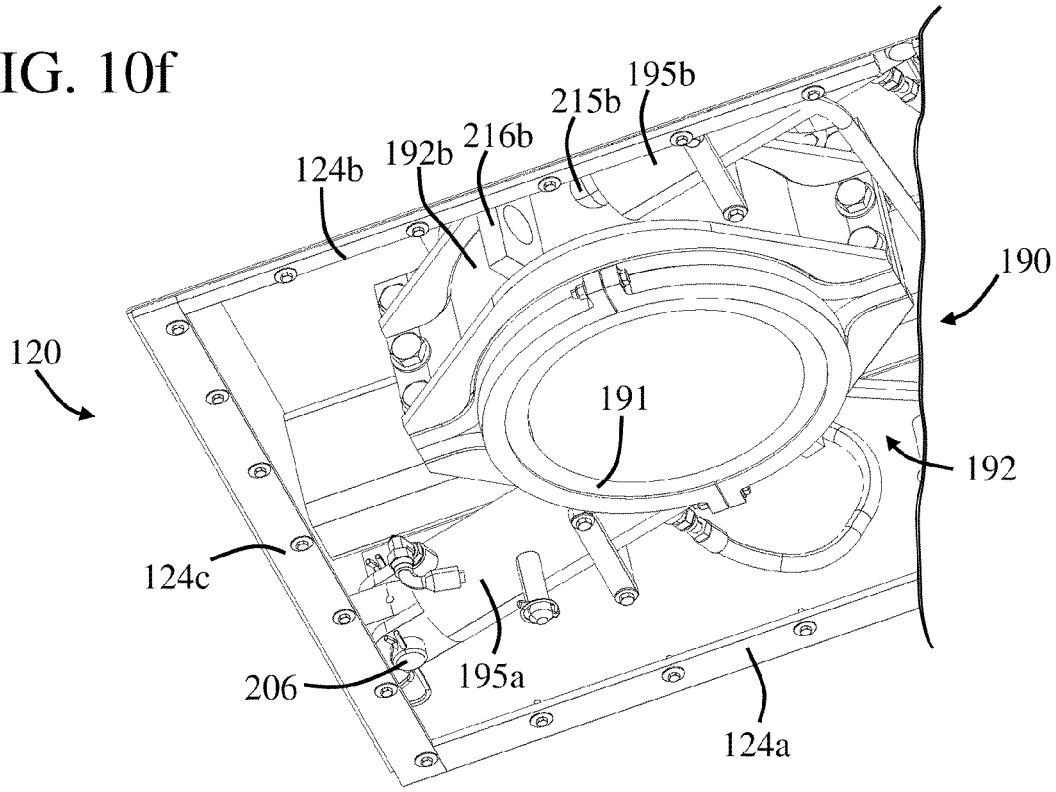
FIGS. 10*f* and 10*g* are bottom perspective views of the table and slide wrench rotator assembly of FIG. 1*a*.
Figure 10G:
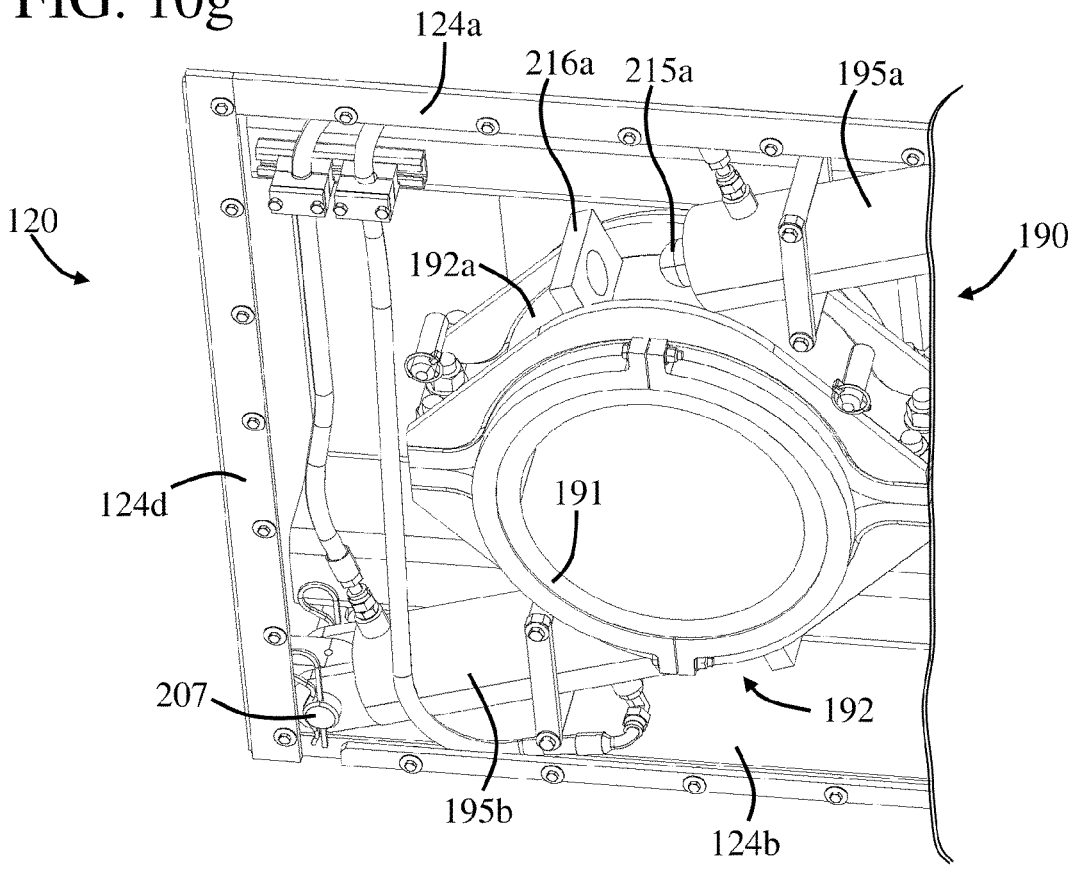

In this embodiment, one end of rotator assembly cylinder 195*a* is coupled to table 120. In particular, one end of rotator assembly cylinder 195*a* is coupled to inner distal sidewall 124*c* with a fastener 206, as shown in FIG. 10*f*. Further, one end of rotator assembly cylinder 195*b* is coupled to table 120. In particular, one end of rotator assembly cylinder 195*b* is coupled to inner distal sidewall 124*d* with a fastener 207, as shown in FIG. 10*g*. It should be noted that FIGS. 10*f* and 10*g* are bottom perspective views of table 120 and slide wrench rotator assembly 190.

It should also be noted that slide wrench assembly 170 is positioned above rotator assembly cylinders 195*a* and 195*b* (FIGS. 10*a*-10*g*). Further, rotator assembly cylinders 195*a* and 195*b* are positioned below slide wrench assembly 170. Slide wrench assembly 170 and rotator assembly cylinders 195*a* and 195*b* are positioned on opposed sides of table top 121. Further, slide wrench assembly 170 and rotator assembly cylinders 195*a* and 195*b* are positioned on opposed sides of table top opening 122.

Rotator assembly cylinders 195*a* and 195*b* are repeatably moveable between extended and retracted positions in response to moving corresponding rotator assembly cylinder pins 215*a* and 215*b* between extended and retracted positions. Rotator assembly cylinder pins 215*a* and 215*b* are shown in the retracted position in FIGS. 9*c* and 9*g*, and rotator assembly cylinder pins 215*a* and 215*b* are shown in the extended position in FIGS. 9*d*, 9*h*, 9*i* and 9*j*. Break-out assembly hydraulic system 119 (FIGS. 1*b* and 2*a*) is operatively coupled to rotator assembly cylinders 195*a* and 195*b*, and provides energy to move them between the extended and retracted positions in a well-known manner.

In this embodiment, slide wrench rotator assembly 190 includes clamp portion levers 216*a* and 216*b*, which are carried by clamp portions 192*a* and 192*b*, respectively. Clamp portion levers 216*a* and 216*b* can be seen in FIGS. 9*c* and 9*d*. Further, clamp portion levers 216*b* and 216*a* can be seen in FIGS. 10*f* and 10*g*, respectively. Clamp portion levers 216*a* and 216*b* extend radially outwardly from clamp portions 192*a* and 192*b*, respectively. Clamp portion levers 216*a* and 216*b* are positioned so they are engaged by rotator assembly cylinder pins 215*a* and 215*b*, respectively, in response to rotator assembly cylinder pins 215*a* and 215*b* moving to the extended position. Rotator assembly cylinder pins 215*a* and 215*b* are repeatably moveable between engaged and disengaged positions with clamp portion levers 216*a* and 216*b*, respectively. Rotator assembly clamp 192 rotates in response to rotator assembly cylinder pins 215*a* and 215*b* engaging clamp portion levers 216*a* and 216*b*, respectively, as will be discussed in more detail presently.

Figure 9I:
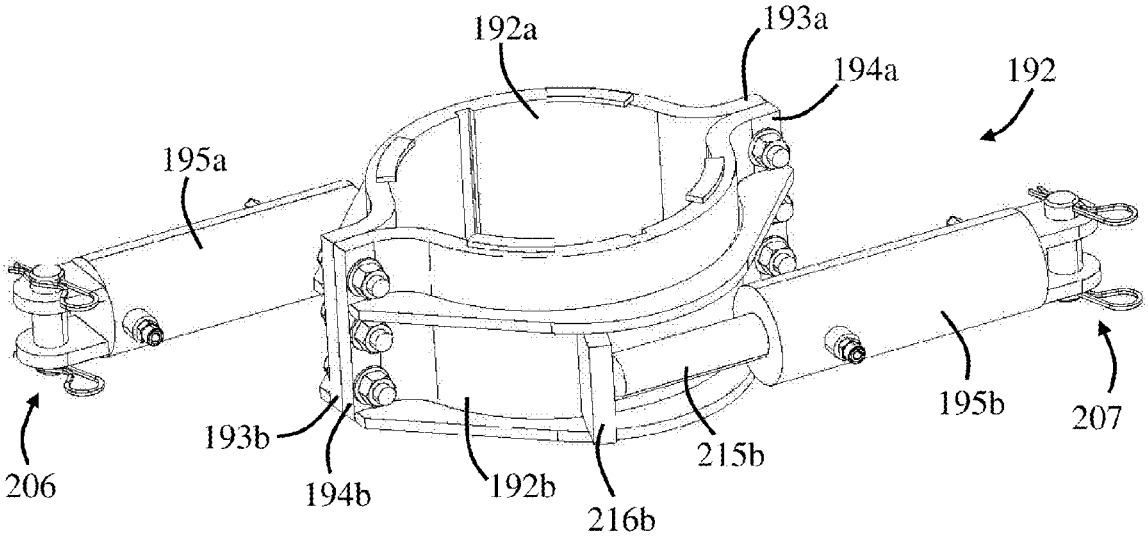
FIGS. 9*i* and 9*j* are perspective and top views, respectively, of the slide wrench rotator assembly of FIGS. 9*a* and 9*b* with cylinders in extended positions.

In this embodiment, rotator assembly cylinders 195*a* and 195*b* are coupled to table 120 so that rotator assembly clamp 192 rotates in a first direction in response to rotator assembly cylinders 195*a* and 195*b* moving to the extended position. In particular, rotator assembly cylinders 195*a* and 195*b* are coupled to table 120 so that rotator assembly clamp 192 rotates in the first direction in response to rotator assembly cylinder pins 215*a* and 215*b* moving to the extended position. Rotator assembly clamp 192 rotates in the first direction in response to rotator assembly cylinder pins 215*a* and 215*b* moving to the extended position because rotator assembly cylinder pins 215*a* and 215*b* engage clamp portion levers 216*a* and 216*b* in response to moving to the extended position, as shown in FIGS. 9*h* and 9*i*. In this way, rotator assembly clamp 192 rotates in response to the movement of rotator assembly cylinder pins 215*a* and 215*b* to the extended position.

Slide wrench assembly 170 rotates in the first direction in response to rotator assembly cylinders 195*a* and 195*b* moving to the extended position because, as mentioned above, slide wrench assembly 170 is coupled to rotator assembly clamp 192 by slide wrench coupler and drill string sleeve 191. Hence, slide wrench assembly 170 rotates in the first direction in response to rotator assembly clamp 192 rotating in the first direction.

Further, slide wrench assembly 170 rotates in the first direction in response to rotator assembly cylinder pins 215*a* and 215*b* engaging clamp portion levers 216*a* and 216*b*, respectively, because, as mentioned above, slide wrench assembly 170 is coupled to rotator assembly clamp 192 by slide wrench coupler and drill string sleeve 191, and clamp portion levers 216*a* and 216*b* are coupled to rotator assembly clamp 192. Hence, slide wrench assembly 170 rotates in the first direction in response to clamp portion levers 216*a* and 216*b* rotating in the first direction.

Slide wrench assembly 170 is shown in angled positions in FIGS. 10*a* and 10*c*, wherein it extends non-perpendicularly to outer front sidewalls 123*a* and 123*b*, and non-parallel to outer distal sidewalls 123*c* and 123*d*. Further, slide wrench assembly 170 is shown in a central position in FIG. 10*b*, wherein it extends perpendicular to outer front sidewalls 123*a* and 123*b*, and parallel to outer distal sidewalls 123*c* and 123*d*. In this embodiment, when slide wrench assembly 170 rotates in the first direction as described above, it rotates from the position of FIG. 10*a* to the position of FIG. 10*b*, and to the position of FIG. 10*c*, if desired.

Figure 9J:
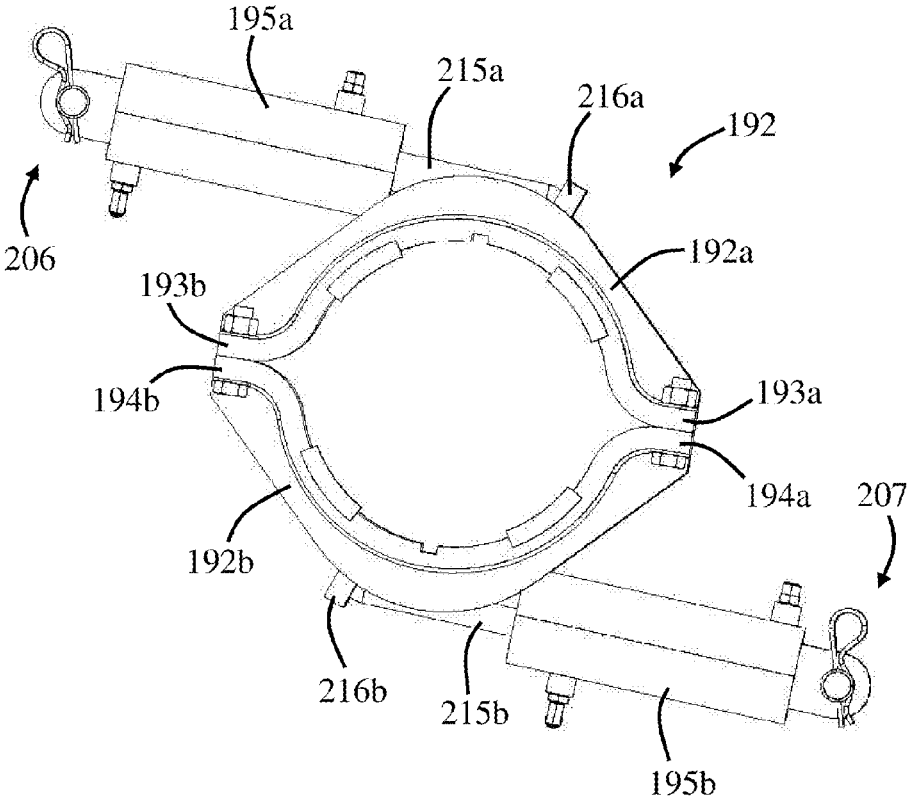

It should be noted that slide wrench assembly 170 is angled towards stop block 125*b*, as shown in FIG. 10*a*, when rotator assembly cylinder pins 215*a* and 215*b* are disengaged from clamp portion levers 216*a* and 216*b*, respectively, as shown in FIGS. 9*a*, 9*b*, 9*c* and 9*g*. Further, slide wrench assembly 170 is rotated from stop block 125*b*, as shown in FIG. 10*a*, towards the central position shown in FIG. 10*b* in response to rotator assembly cylinder pins 215*a* and 215*b* engaging clamp portion levers 216*a* and 216*b*, respectively, as shown in FIGS. 9*d* and 9*h*. Slide wrench assembly 170 is rotated from the central position shown in FIG. 10*b* towards stop block 125*a*, as shown in FIG. 10*c*, in response to rotator assembly cylinder pins 215*a* and 215*b* engaging clamp portion levers 216*a* and 216*b*, respectively, as shown in FIGS. 9*i* and 9*j*. In this way, slide wrench assembly 170 is rotated in a direction 198 from stop block 125*b* towards stop block 125*a*.

It should be noted, however, that slide wrench assembly 170 can be rotated from stop block 125*a* towards stop block 125*b*, if desired. In these embodiments, slide wrench assembly 170 is angled towards stop block 125*a* when rotator assembly cylinder pins 215*a* and 215*b* are disengaged from clamp portion levers 216*a* and 216*b*, respectively. Further, in these embodiments, rotator assembly cylinder pins 215*a* and 215*b* are engaged with clamp portion levers 216*a* and 216*b*, respectively, when slide wrench assembly 170 is rotated from stop block 125*a* towards stop block 125*b*. In general, slide wrench assembly 170 is rotatable between stop blocks 125*a* and 125*b* in direction 198.

It should also be noted that slide wrench assembly 170 is angled towards stop block 125*b* when it is rotated in a clockwise direction when viewing slide wrench rotator assembly from the top view of FIG. 9*a*. Further, slide wrench assembly 170 is angled towards stop block 125*a* when it is rotated in a counter clock-wise direction when viewing slide wrench rotator assembly from the top view of FIG. 9*a*.

In this embodiment, rotator assembly clamp 192 does not rotate in a second direction opposed to the first direction in response to rotator assembly cylinders 195*a* and 195*b* moving to the retracted position. Slide wrench assembly 170 does not rotate in the second direction in response to rotator assembly cylinders 195*a* and 195*b* moving to the retracted position because rotator assembly cylinder pins 215*a* and 215*b* move away from clamp portion levers 216*a* and 216*b*, respectively, in response to rotator assembly cylinders 195*a* and 195*b* moving to the retracted position.

It should be noted that rotator assembly cylinder pins 215*a* and 215*b* move in opposed directions, as indicated in FIGS. 9*c* and 9*d*. In one embodiment, rotator assembly cylinder pins 215*a* and 215*b* move in directions 196*a* and 196*b*, respectively, when moving to the retracted position, wherein direction 196*a* is opposed to direction 196*b*. In this embodiment, rotator assembly cylinder pins 215*a* and 215*b* move in directions 196*b* and 196*a*, respectively, when moving to the extended position. In this way, rotator assembly cylinders 195*a* and 195*b* apply a symmetrical clock-wise rotational force to rotator assembly clamp 192.

An advantage of slide wrench rotator assembly 190 is that rotator assembly cylinders 195*a* and 195*b* apply a symmetrical rotational force to rotator assembly clamp 192 to reduce the amount of torque it experiences. Reducing the amount of torque experienced by rotator assembly clamp 192 is desirable because this torque is often undesirably transferred to other portions of table 120 and break-out assembly 140, as well as to drill pipe 111. For example, torque experienced by rotator assembly clamp 192 can be undesirably transferred to drill string 110 through slide wrench coupler and drill string sleeve 191.

Torque transferred to table 120 and break-out assembly 140 can increase the likelihood of one or more of their components breaking. Further, torque applied to drill pipe 111 by rotator assembly cylinders 195*a* and 195*b* can cause drill string 110 to undesirably bend, which often makes it more difficult to disconnect drill pipes 111 and 115 at pipe interface 109 (FIGS. 1*c* and 1*d*).

Figure 9K:
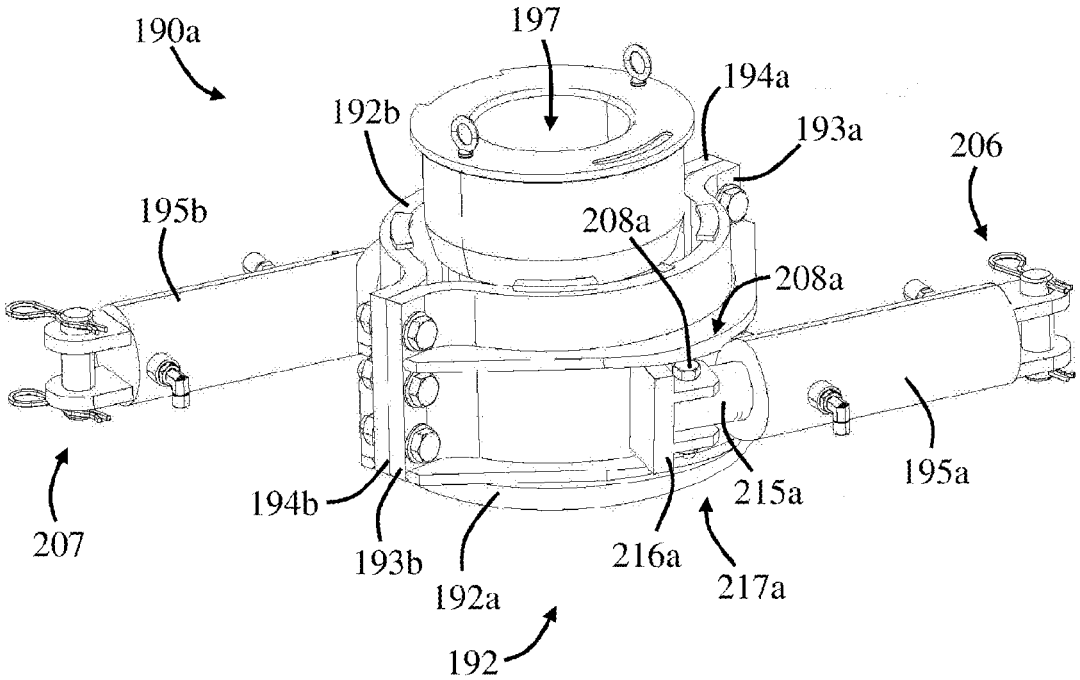
FIGS. 9*k* and 9*l* are perspective views of another embodiment of a slide wrench rotator assembly.
Figure 9L:
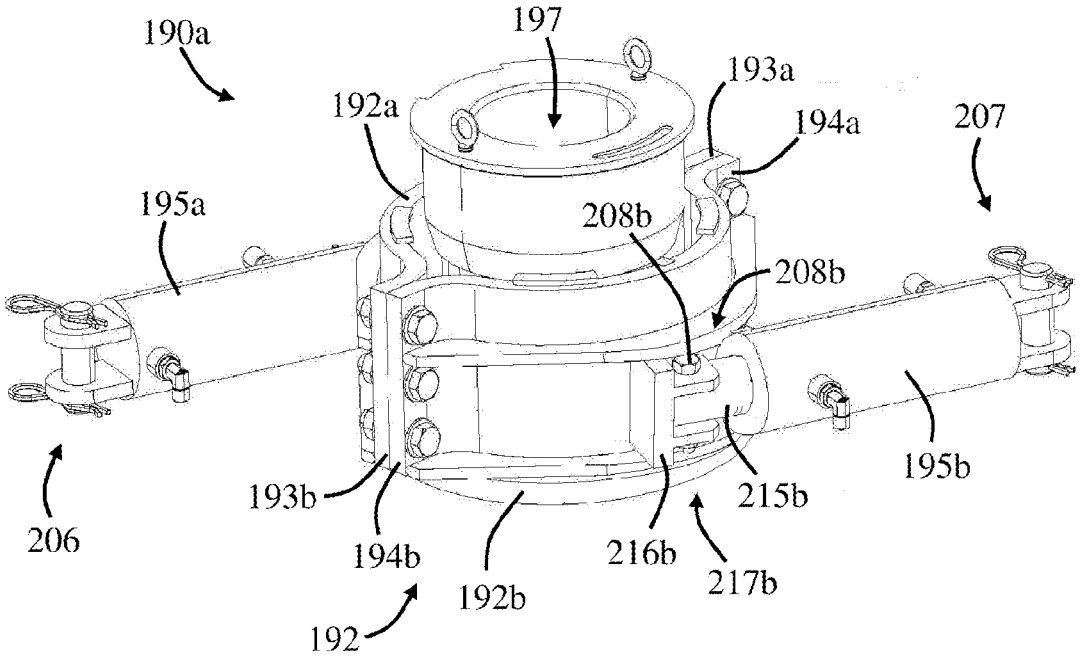
Figure 9M:
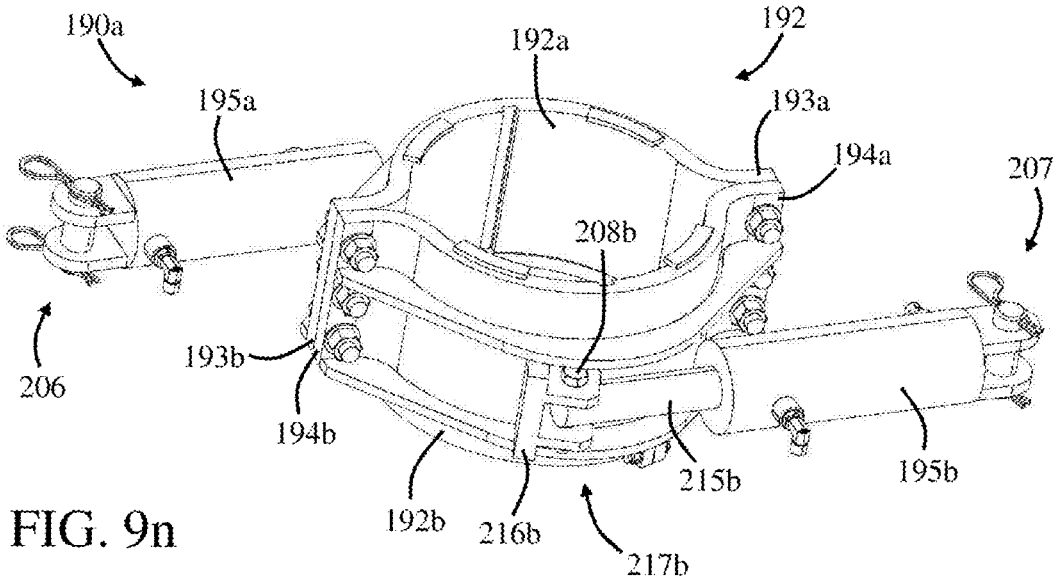
FIGS. 9*m* and 9*n* are perspective and top views, respectively, of the slide wrench rotator assembly of FIGS. 9*k* and 9*l* with cylinders in extended positions.
Figure 9N:
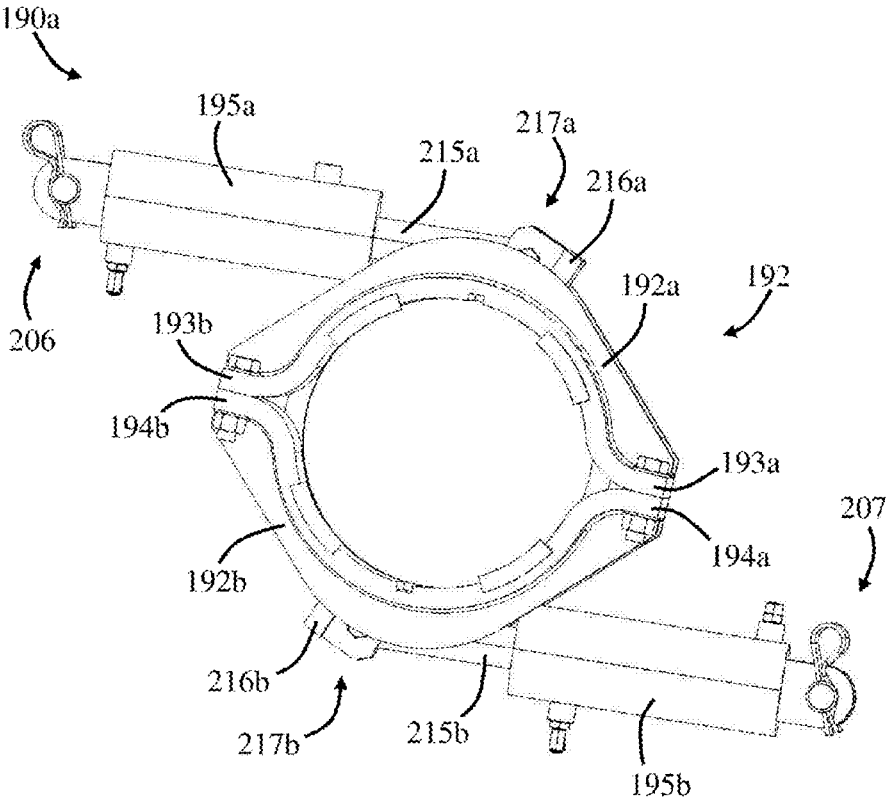

FIGS. 9*k* and 9*l* are side perspective views of another embodiment of a slide wrench rotator assembly, which is denoted as slide wrench rotator assembly 190*a*. FIGS. 9*m* and 9*n* are side perspective and top views, respectively, of slide wrench rotator assembly 190*a*. It should be noted that slide wrench rotator assembly 190*a* can replace slide wrench rotator assembly 190 in break-out assembly 140.

In this embodiment, one end of rotator assembly cylinder 195*a* is coupled to rotator assembly clamp 192 and an opposed end is coupled to table 120. In particular, one end of rotator assembly cylinder 195*a* is coupled to clamp portion 192*a* and an opposed end is coupled to inner distal sidewall 124*c* with fastener 206, as shown in FIG. 10*f*. Rotator assembly cylinder 195*a* can be coupled to clamp portion 192*a* in many different ways. In this embodiment, slide wrench rotator assembly 190*a* includes a lever arm bracket 217*a* attached to clamp portion lever 216*a*. Rotator assembly cylinder pin 215*a* is coupled to lever arm bracket 217*a* with a fastener 208*a*, as shown in FIG. 9*k*, wherein fastener 208*a* is embodied as a bolt and nut. In this way, rotator assembly cylinder 195*a* is coupled to clamp portion 192*a*.

Further, in this embodiment, one end of rotator assembly cylinder 195*b* is coupled to rotator assembly clamp 192 and an opposed end is coupled to table 120. In particular, one end of rotator assembly cylinder 195*b* is coupled to clamp portion 192*b* and an opposed end is coupled to inner distal sidewall 124*d* with fastener 207, as shown in FIG. 10*g*. Rotator assembly cylinder 195*b* can be coupled to clamp portion 192*b* in many different ways. In this embodiment, slide wrench rotator assembly 190*a* includes a lever arm bracket 217*b* attached to clamp portion lever 216*b*. Rotator assembly cylinder pin 215*b* is coupled to lever arm bracket 217*b* with a fastener 208*b*, as shown in FIG. 9*l*, wherein fastener 208*b* is embodied as a bolt and nut. In this way, rotator assembly cylinder 195*b* is coupled to clamp portion 192*b*. It should be noted that FIGS. 10*f* and 10*g* are bottom perspective views of table 120 and slide wrench rotator assembly 190.

In this embodiment, rotator assembly cylinders 195*a* and 195*b* are coupled to rotator assembly clamp 192 and table 120 so that rotator assembly clamp 192 rotates in the first direction, as described above, in response to rotator assembly cylinders 195*a* and 195*b* moving to the extended position. Slide wrench assembly 170 rotates in the first direction in response to rotator assembly cylinders 195*a* and 195*b* moving to the extended position because slide wrench assembly 170 is carried by rotator assembly clamp 192, as shown in FIG. 9*e*.

Further, in this embodiment, rotator assembly cylinders 195*a* and 195*b* are coupled to rotator assembly clamp 192 and table 120 so that rotator assembly clamp 192 rotates in the second direction, as described above, in response to rotator assembly cylinders 195*a* and 195*b* moving to the retracted position. Slide wrench assembly 170 rotates in the second direction in response to rotator assembly cylinders 195*a* and 195*b* moving to the retracted position because slide wrench assembly 170 is carried by rotator assembly clamp 192, as shown in FIG. 9*e*.

As mentioned above, slide wrench assembly 170 is shown in an angled position in FIGS. 10*a* and 10*c*, wherein it extends non-perpendicularly to outer front sidewalls 123*a* and 123*b*, and non-parallel to outer distal sidewalls 123*c* and 123*d*. Further, slide wrench assembly 170 is shown in a central position in FIG. 10*b*, wherein it extends perpendicular to outer front sidewalls 123*a* and 123*b*, and parallel to outer distal sidewalls 123*c* and 123*d*.

It should be noted that slide wrench assembly 170 is angled towards stop block 125*b*, as shown in FIG. 10*a*, when rotator assembly cylinder pins 215*a* and 215*b* are in the retracted position, as shown in FIGS. 9*k* and 9*l*. Further, slide wrench assembly 170 is rotated from stop block 125*b*, as shown in FIG. 10*a*, towards the central position shown in FIG. 10*b* in response to rotator assembly cylinder pins 215*a* and 215*b* moving from the retracted position to the extended position, as shown in FIG. 9*m*. Slide wrench assembly 170 is rotated from the central position shown in FIG. 10*b* towards stop block 125*a*, as shown in FIG. 10*c*, in response to rotator assembly cylinder pins 215*a* and 215*b* moving from the positions of FIG. 9*m* to the positions of FIG. 9*n*. In this way, slide wrench assembly 170 is rotated in direction 198 from stop block 125*b* towards stop block 125*a*.

It should also be noted that slide wrench assembly 170 can be rotated from stop block 125*a* to stop block 125*b*. For example, slide wrench assembly 170 is rotated from stop block 125*a*, as shown in FIG. 10*c*, towards the central position shown in FIG. 10*b* in response to rotator assembly cylinder pins 215*a* and 215*b* moving from the positions of FIG. 9*n* to the extended positions of FIG. 9*m*. Further, slide wrench assembly 170 is rotated from the central position shown in FIG. 10*b* towards stop block 125*b*, as shown in FIG. 10*a*, in response to rotator assembly cylinder pins 215*a* and 215*b* moving from the extended position of FIG. 9*m* to the retracted positions of FIGS. 9*k* and 9*l*. Slide wrench assembly 170 is angled towards stop block 125*b*, as shown in FIG. 10*a*, when rotator assembly cylinder pins 215*a* and 215*b* are in the retracted positions, as shown in FIGS. 9*k* and 9*l*. In this way, slide wrench assembly 170 is rotated in direction 198 from stop block 125*a* towards stop block 125*b*.

FIG. 11*a* is a perspective view of tower base 104 and break-out assembly 140, wherein clamp pivot assembly 130 is in the retracted position so that clamp assembly 150 is away from drill string 110. In particular, clamp pivot assembly 130 is in the retracted position so that clamp assembly 150 is away from drill pipe 115, wherein drill pipe 115 is in the upper position. It should be noted that clamp assembly 150 is in the open position, as shown in close-up views of clamp assembly 150 in FIGS. 11*b* and 11*c*. Clamp assembly 150 is in the open position so that it can receive drill pipe 115, as will be discussed in more detail presently.

Figure 11D:
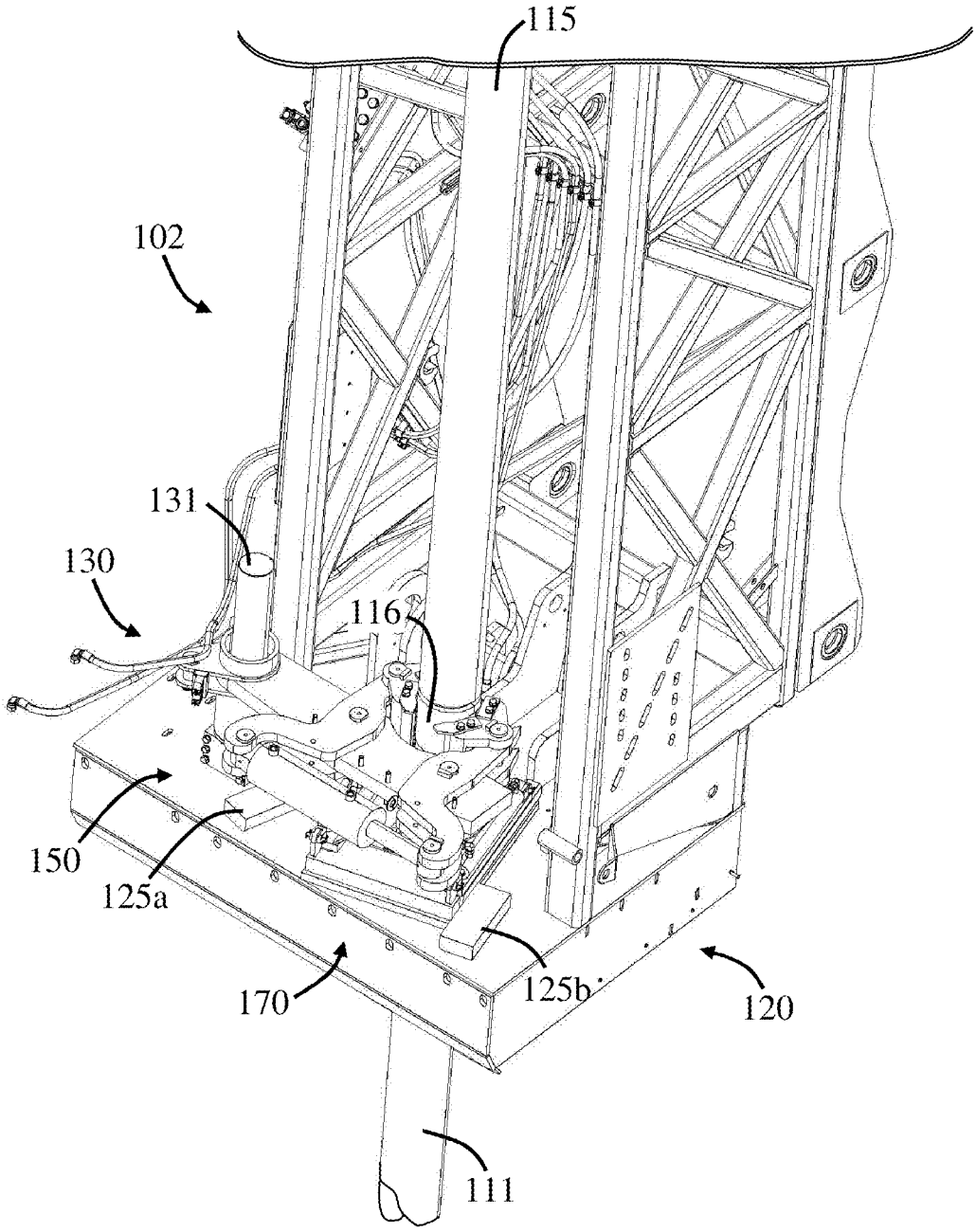
FIGS. 11*d*, 11*e* and 11*f* are perspective views of the clamp assembly and the tower base of FIG. 1*a*, wherein the clamp pivot assembly of FIGS. 5*a* and 5*b* is in the extended position so that the clamp assembly of FIGS. 6*a* and 6*b* is towards the drill string of FIGS. 1*a*, 1*c* and 1*d*.
Figure 11E:
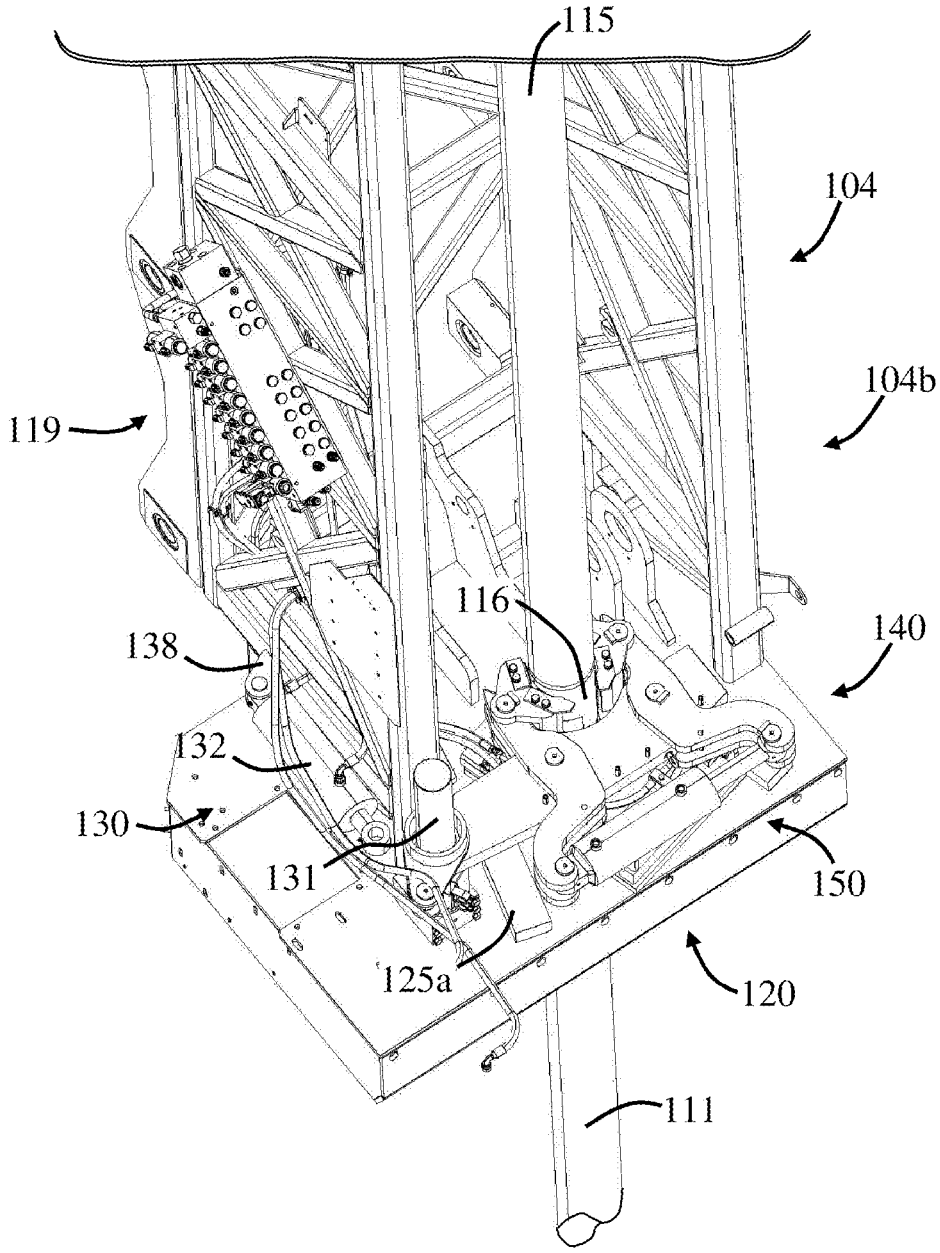
Figure 11F:
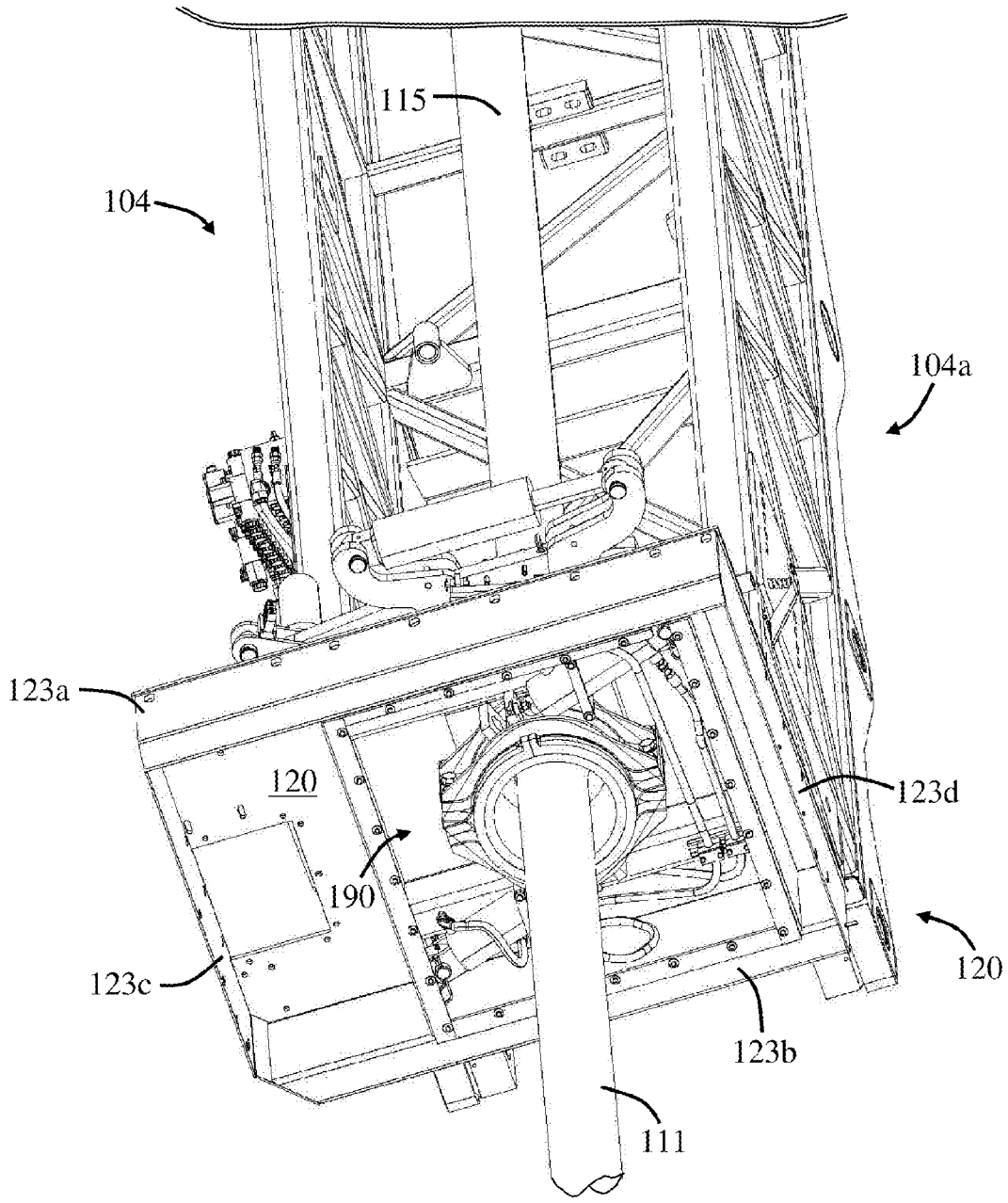

FIGS. 11*d*, 11*e* and 11*f* are perspective views of clamp assembly 150 and tower base 104, wherein clamp pivot assembly 130 is in the extended position so that clamp assembly 150 is towards drill string 110. In particular, clamp pivot assembly 130 is in the extended position so that clamp assembly 150 is towards drill pipe 115, wherein drill pipe 115 is in the upper position. It should be noted that clamp assembly 150 is in the closed position, wherein grippers 154 and 155 are gripping drill pipe 115. Clamp assembly 150 is in the closed position so that grippers 154 and 155 restrict the rotation of drill pipe 115 relative to drill pipe 111, as will be discussed in more detail presently.

Figure 12A:
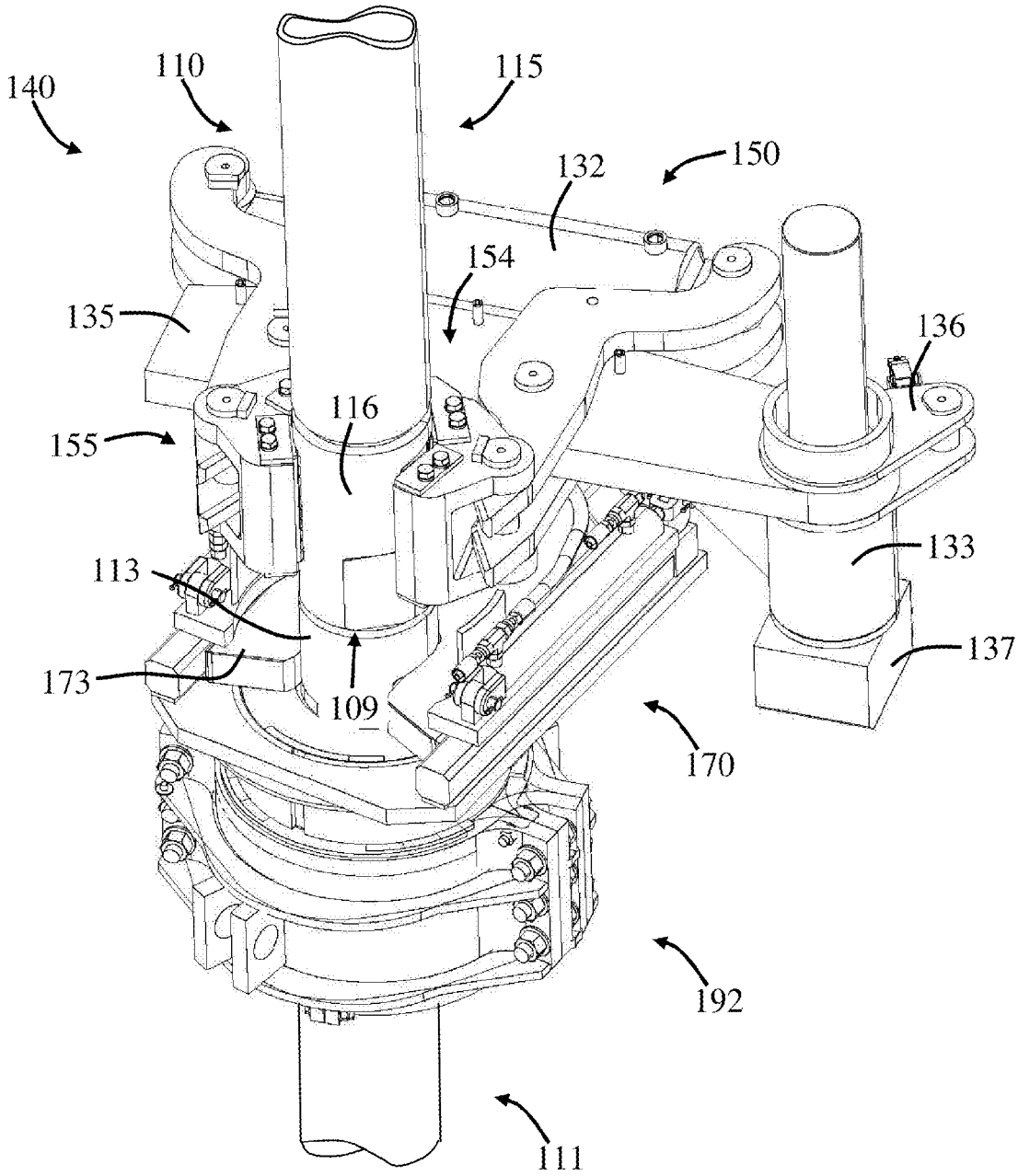
FIGS. 12*a*, 12*b* and 12*c* are perspective views of the break-out assembly of FIG. 1*a*, wherein the clamp assembly of FIGS. 6*a* and 6*b* is in the engaged position with the drill string of FIGS. 1*a*, 1*c* and 1*d*, and the slide wrench assembly of FIGS. 8*a* and 8*b* is in the central position, which is shown in FIG. 10*b*.
Figure 12B:
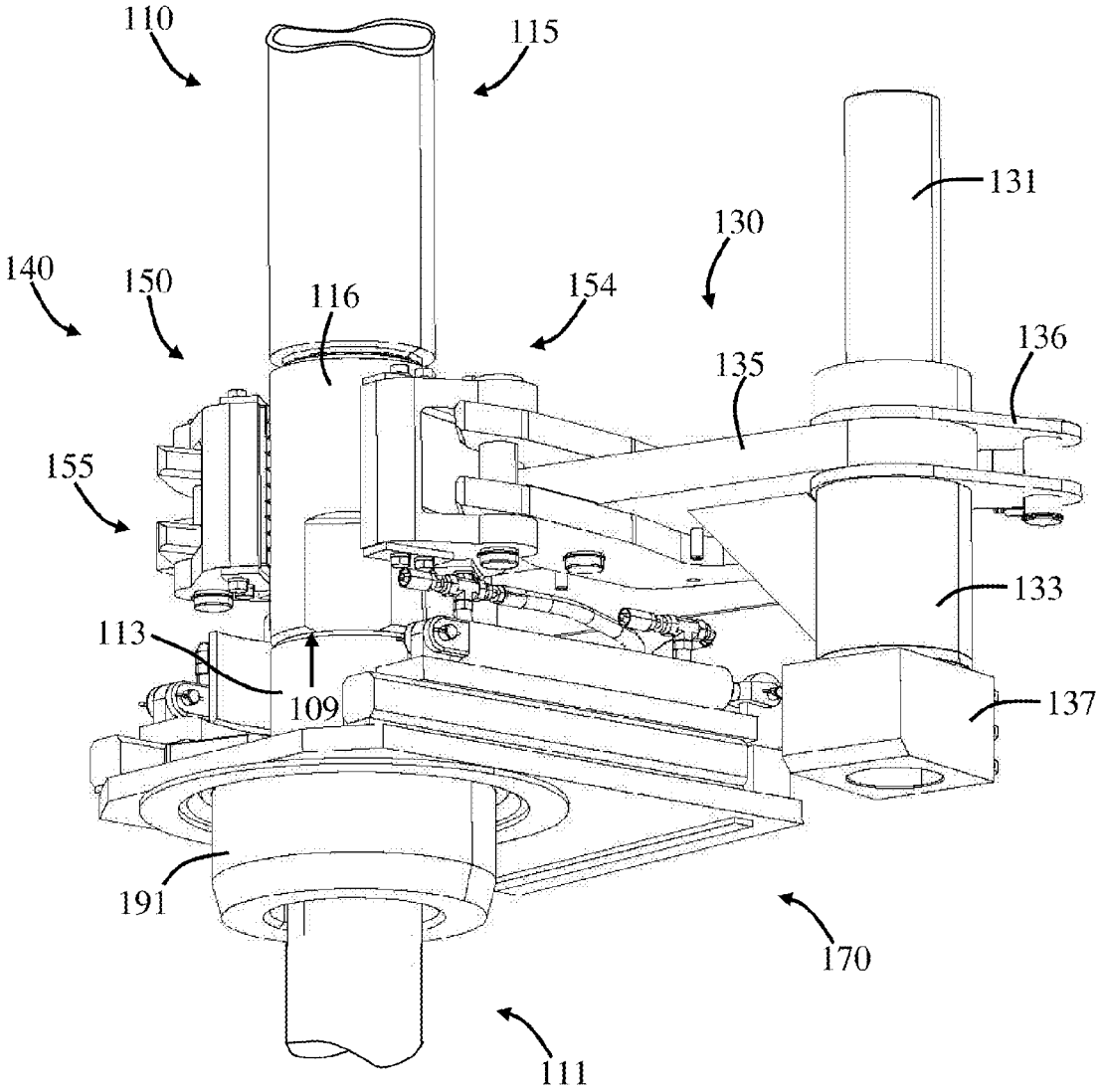
Figure 12C:
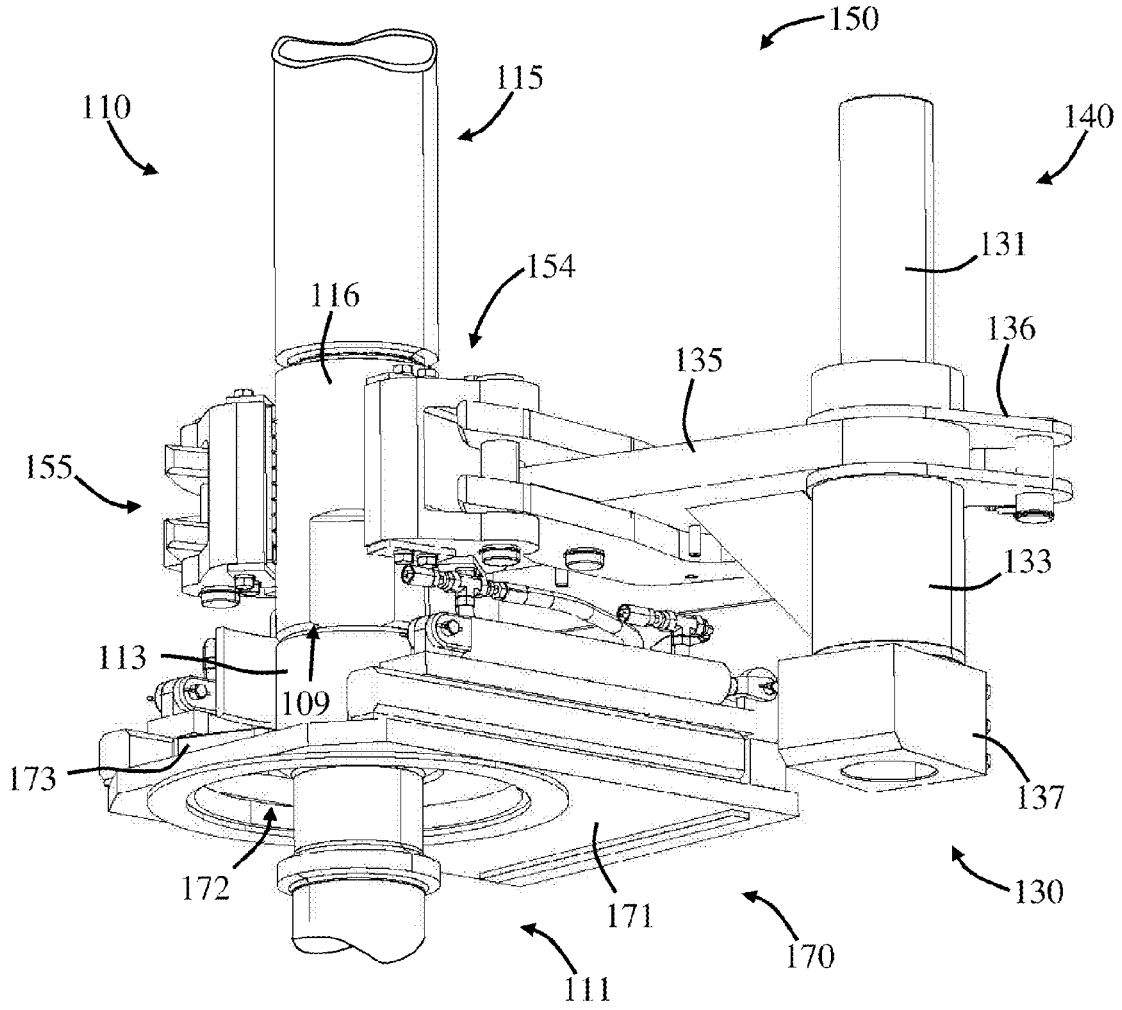

FIGS. 12*a*, 12*b* and 12*c* are perspective views of break-out assembly 140, wherein clamp assembly 150 is in the engaged position with drill string 110. In particular, clamp assembly 150 is engaged with drill string pipe 115, as described in more detail above. Further, slide wrench assembly 170 is in the engaged condition with drill string 110, as described in more detail above. In particular, slide wrench assembly 170 is engaged with drill pipe 111. In some situations, slide wrench assembly 170 is engaged with drill pipe 111 so that slide wrench 173 engages flats 114*a* and 114*b*. Slide wrench assembly 170 is engaged with drill pipe 111 so that slide wrench 173 restricts the ability of drill pipe 111 to rotate relative to slide wrench assembly 170. It should be noted that slide wrench assembly 170, as shown in FIGS. 12*a*-12*c*, is in the central position, which is shown in FIG. 10*b*.

Figure 12D:
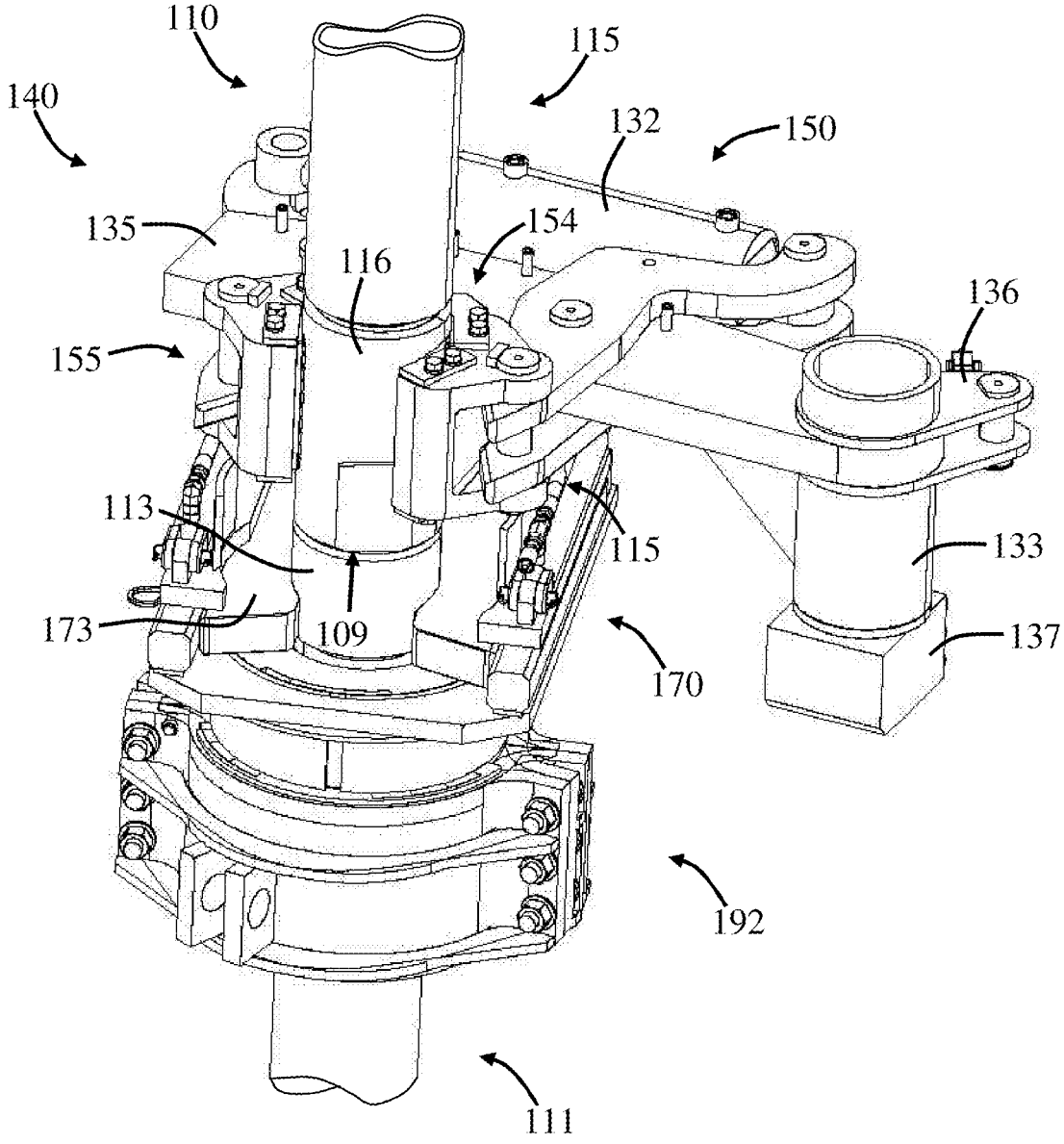
FIGS. 12*d*, 12*e* and 12*f* are perspective views of the break-out assembly of FIG. 1*a*, wherein the clamp assembly of FIGS. 6*a* and 6*b* is in the engaged position with the drill string of FIGS. 1*a*, 1*c* and 1*d*, and the slide wrench assembly of FIGS. 8*a* and 8*b* is in the angled position, which is shown in FIG. 10*a*.
Figure 12E:
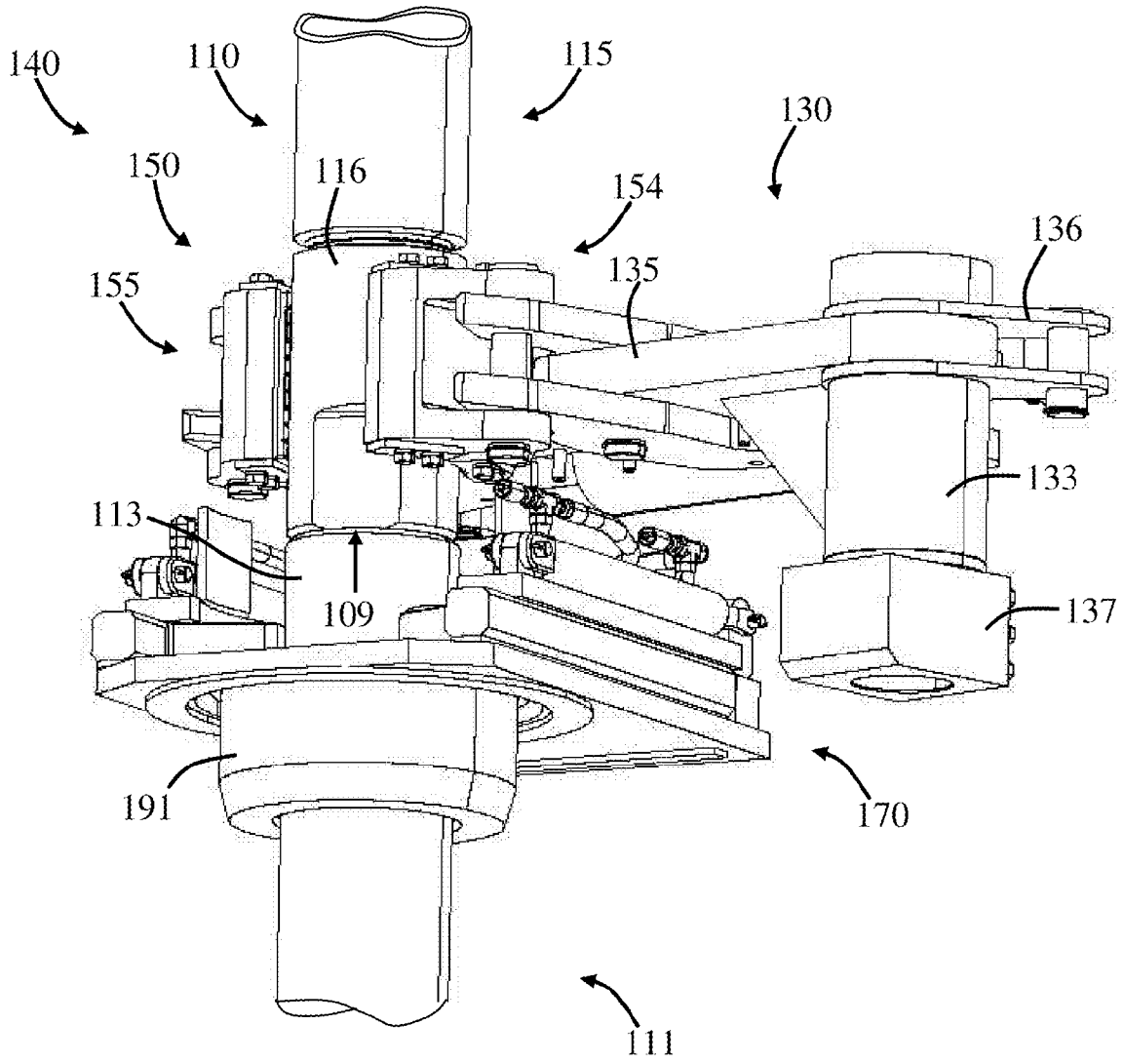
Figure 12F:
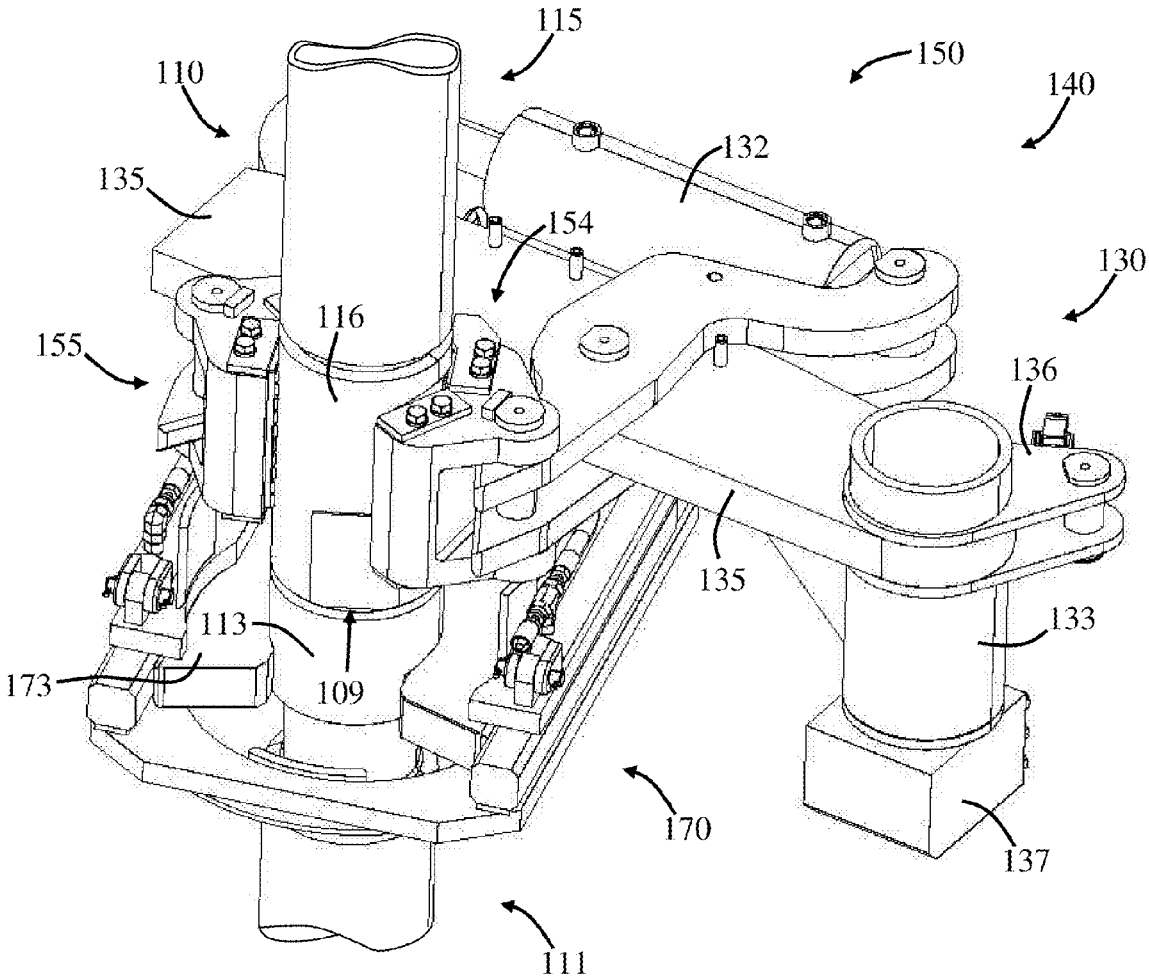

FIGS. 12*d*, 12*e* and 12*f* are perspective views of break-out assembly 140, slide wrench assembly 170 is in the angled position, which is shown in FIG. 10*a*. Drill pipe 111 is rotated relative to drill pipe 115 in response to moving slide wrench assembly 170 from the angled position of FIG. 10*a* to the central position of FIG. 10*b*. Further, drill pipe 111 is rotated relative to drill pipe 115 in response to moving slide wrench assembly 170 from the central position of FIG. 10*b* to the angled position of FIG. 10*c*. In this way, pipe interface 109 is broken and drill pipes 111 and 115 are disconnected from each other. Slide wrench 173 engages flats 114*a* and 114*b* to facilitate the rotation of drill pipe 111 relative to drill pipe 115.

Slide wrench assembly 170 is moved between the central and angled positions in response to moving rotator assembly cylinder 195*a* and rotator assembly cylinder 195*b* between extended and retracted positions, as discussed in more detail above.

Figure 13A:
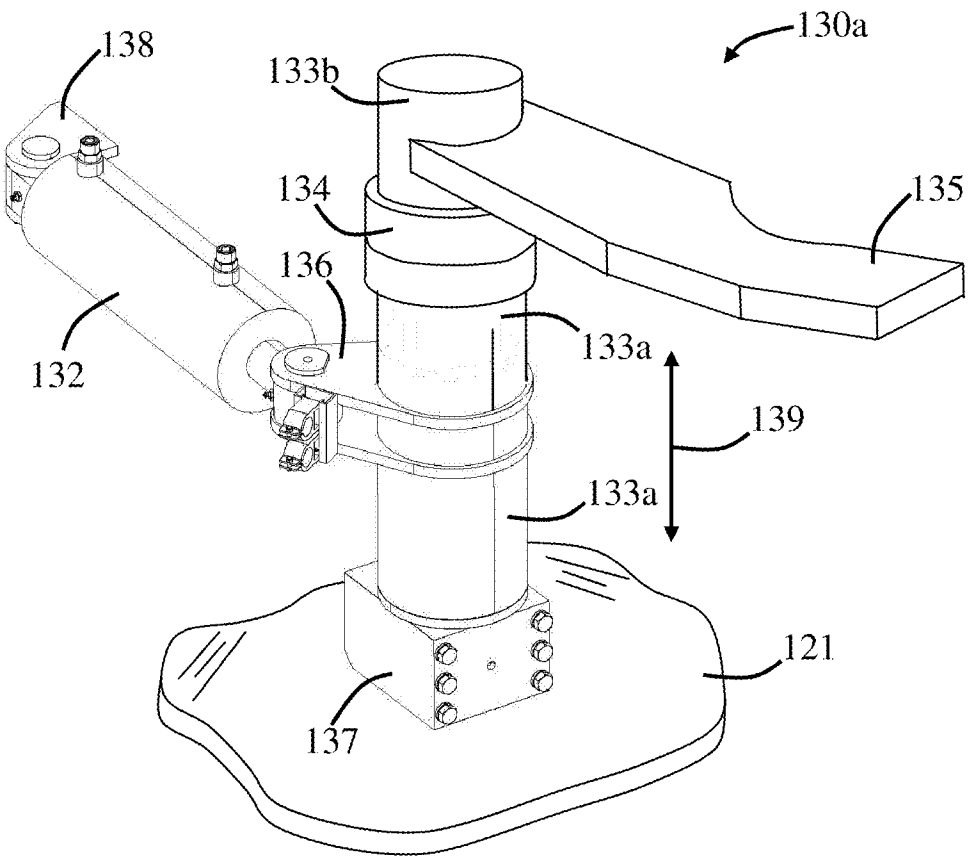
FIG. 13*a* is a perspective view of a table top of the table of FIG. 4*a* carrying another embodiment of a clamp pivot assembly.

FIG. 13*a* is a perspective view of table top 121 carrying another embodiment of a clamp pivot assembly, which is denoted as clamp pivot assembly 130*a*. It should be noted that table top 121 is included with table 120 of FIG. 4*a*, and clamp pivot assembly 130*a* can replace clamp pivot assembly 130. Clamp pivot assembly 130*a* is shown in the retracted position in FIG. 13*a* for illustrative purpose. However, clamp pivot assembly 130*a* is repeatably moveable between the retracted and extended positions, as discussed in more detail above with clamp pivot assembly 130.

In this embodiment, clamp pivot assembly 130*a* includes pivot post stand 137 attached to table top 121, and pivot post 131 which extends upwardly from pivot post stand 137. Clamp pivot assembly 130*a* includes a pivot post sleeve 133*a* rotatably mounted to pivot post 131 (FIGS. 1*b*, 2*a* and 4*a*). In this embodiment, pivot post sleeve 133*a* is rotatably mounted to pivot post 131 in the same way that pivot post sleeve 133 is rotatably mounted to pivot post 131. It should be noted that pivot post 131 is not shown in the view of clamp pivot assembly 130*a* of FIG. 13*a* because it extends through pivot post sleeve 133*a*.

In this embodiment, clamp pivot assembly 130*a* includes pivot post sleeve bracket 136 coupled to pivot post sleeve 133*a*. Clamp pivot assembly 130*a* includes clamp assembly rotation cylinder 132 coupled at one end to pivot post sleeve bracket 136. Bracket 138 is coupled to the other end of clamp assembly rotation cylinder 132. Bracket 138 is attached to tower base 104*a* of tower 104, as shown in FIG. 11*e*. Clamp assembly rotation cylinder 132 is repeatably moveable between extended and retracted positions, as discussed in more detail above with clamp pivot assembly 130. Pivot post sleeve bracket 136 rotates in response to the movement of clamp assembly rotation cylinder 132 between the extended and retracted positions. Further, pivot post sleeve 133*a* rotates in response to the rotation of pivot post sleeve bracket 136.

In this embodiment, clamp pivot assembly 130*a* includes a clamp assembly elevation cylinder 134 carried by pivot post sleeve 133*a*. Clamp assembly elevation cylinder 134 is coupled to pivot post sleeve 133*a* so that clamp assembly elevation cylinder 134 rotates in response to rotation of pivot post sleeve 133*a*. Clamp assembly elevation cylinder 134 is repeatably moveable between extended and retracted positions, as discussed in more detail below.

Clamp assembly elevation cylinder 134 can be of many different types of cylinders, such as a pneumatically or hydraulically driven cylinder. In this embodiment, clamp assembly elevation cylinder 134 is operatively coupled to break-out assembly hydraulic system 119, which is shown in FIGS. 1*b* and 2*a*. Break-out assembly hydraulic system 119 provides, in a well-known manner, energy to move clamp assembly elevation cylinder 134 between the extended and retracted positions.

In some embodiments, clamp assembly elevation cylinder 134 is replaced with an actuator or lifter. There are several different types of actuators and lifters that can be used in clamp pivot assembly 130*a* to replace clamp assembly elevation cylinder 134, such as those disclosed in U.S. Pat. Nos. 3,622,124, 4,624,447, 4,715,180, 4,724,930, 4,900,187 and 5,020,777, the contents of which are incorporated by reference as though fully set forth herein. The size of these actuators and lifters can be adjusted so they can be included in clamp pivot assembly 130*a*. In particular, the size of these actuators and lifters can be adjusted so they can be carried by and coupled to pivot post sleeve 133*a*.

In this embodiment, clamp pivot assembly 130*a* includes a pivot post sleeve 133*b* carried by clamp assembly elevation cylinder 134. Pivot post sleeves 133*a* and 133*b* are positioned on opposed sides of clamp assembly elevation cylinder 134. Pivot post sleeve 133*b* is coupled to clamp assembly elevation cylinder 134 so that pivot post sleeve 133*b* rotates in response to the rotation of clamp assembly elevation cylinder 134.

In this embodiment, clamp pivot assembly 130*a* includes clamp assembly rotation arm 135 coupled to pivot post sleeve 133*b*. Clamp assembly rotation arm 135 moves between retracted and extended positions in response to the rotation of pivot post sleeve 133*b*. As discussed in more detail above, clamp assembly rotation arm 135 carries clamp assembly 150. However, clamp assembly 150 is not shown in FIG. 13*a* for simplicity.

In operation, clamp assembly rotation cylinder 132 rotates pivot post sleeve 133*a* about pivot post 131 in response to moving between the extended and retracted positions. Clamp assembly elevation cylinder 134 and pivot post sleeve 133*b* rotate relative to pivot post 131 in response to the rotation of clamp assembly rotation cylinder 132. As discussed in more detail above, clamp assembly rotation arm 135 is moved towards drill string 110 when clamp pivot assembly 130 is moved to the extended position. In particular, clamp assembly rotation arm 135 is moved towards the upper drill pipe (i.e. drill pipe 115) when clamp pivot assembly 130 is moved to the extended position. Clamp assembly rotation arm 135 is moved away from drill string 110 when clamp pivot assembly 130 is moved to the retracted position. In particular, clamp assembly rotation arm 135 is moved away from the upper drill pipe when clamp pivot assembly 130 is moved to the retracted position. The movement of clamp pivot assembly 130 and clamp assembly rotation arm 135 towards and away from the upper drill pipe is discussed above with FIGS. 11*a*-11*f*.

As mentioned above, clamp assembly elevation cylinder 134 is repeatably moveable between extended and retracted positions. Clamp assembly rotation arm 135 is moved away from and towards table top 121 in response to moving clamp assembly elevation cylinder 134 between the extended and retracted positions, respectively. Clamp assembly rotation arm 135 is repeatably moveable between raised and lowered positions in response to moving clamp assembly elevation cylinder 134 between the extended and retracted positions, respectively. Clamp assembly rotation arm 135 is repeatably moveable away from and towards table top 121 in response to actuating clamp assembly elevation cylinder 134, as will be discussed in more detail presently.

Figure 13B:
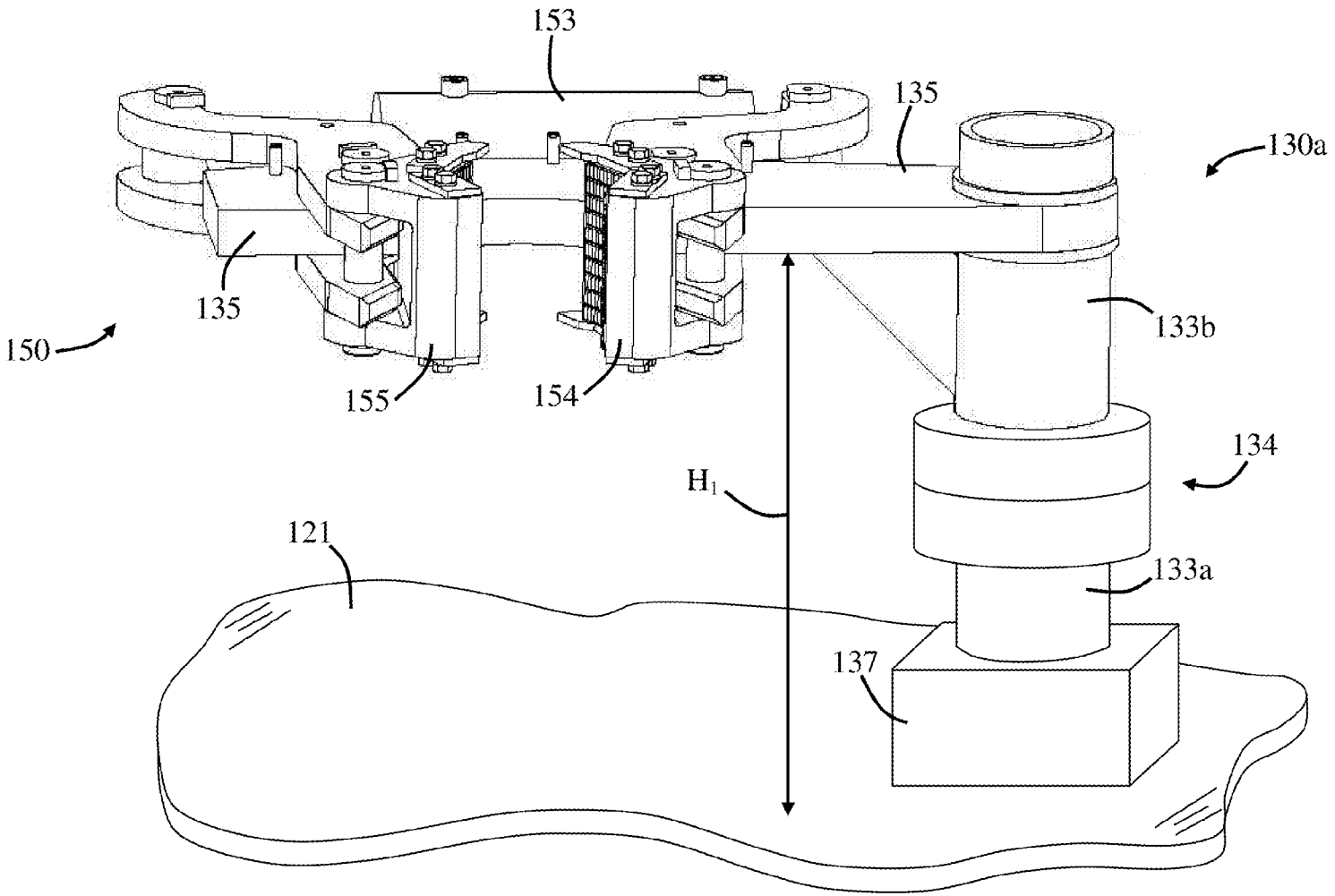
FIGS. 13*b* and 13*c* are perspective views of the clamp assembly rotation arm of the clamp pivot assembly of FIG. 13*a* in positions towards and away from, respectively, the table top.
Figure 13C:
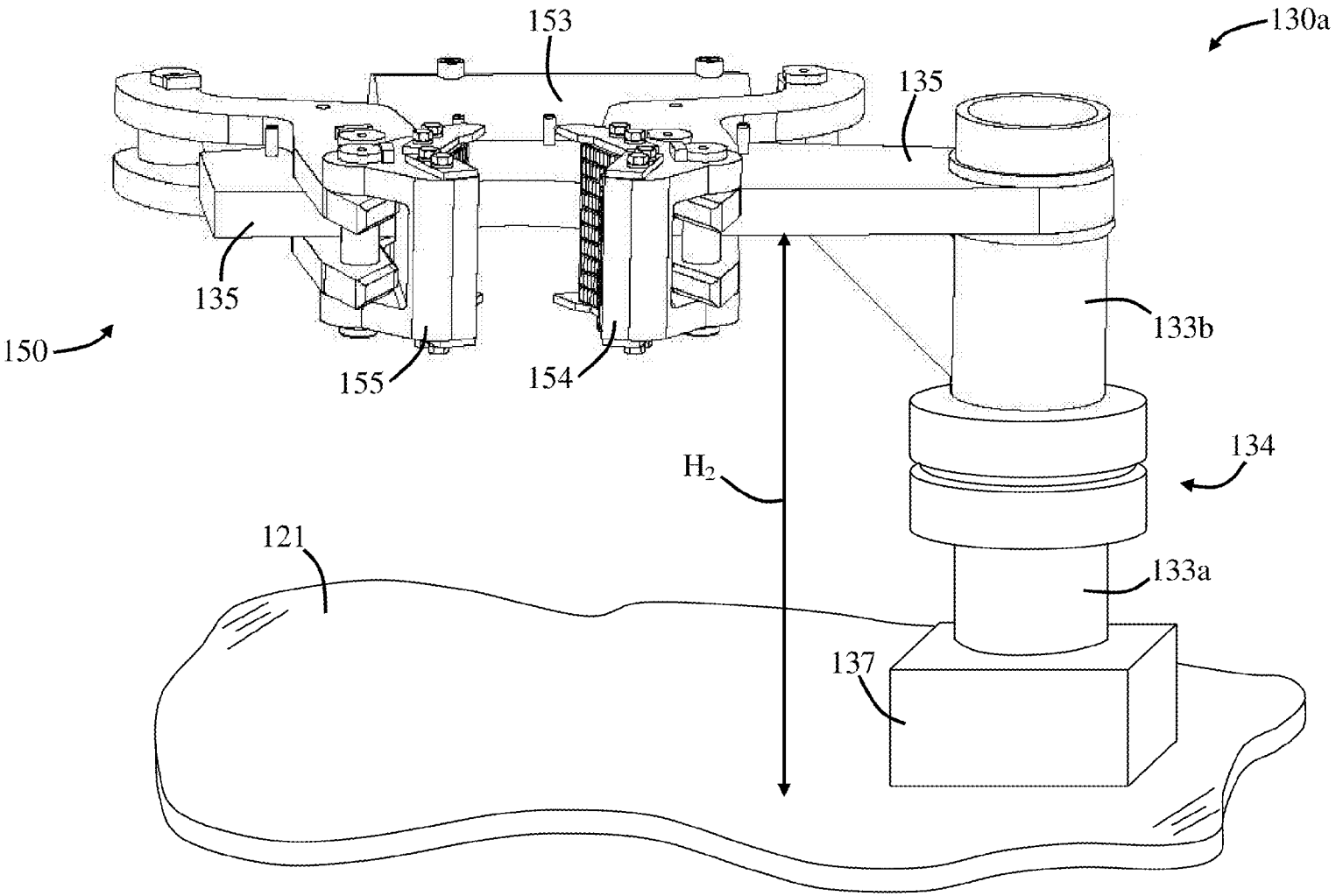

FIGS. 13*b* and 13*c* are perspective views of clamp assembly rotation arm 135 in positions towards and away from, respectively, table top 121. In FIG. 13*a*, clamp assembly rotation arm 135 is a height $H_1$ from table top 121 when clamp assembly elevation cylinder 134 is in the retracted position. In FIG. 13*b*, clamp assembly rotation arm 135 is a height $H_2$ from table top 121 when clamp assembly elevation cylinder 134 is in the extended position, wherein height $H_2$ is greater than height $H_1$. In this way, clamp assembly rotation arm 135 is moved away from and towards table top 121 in response to moving clamp assembly elevation cylinder 134 between the extended and retracted positions. The movement of clamp assembly rotation arm 135 in response to moving clamp assembly elevation cylinder 134 between the extended and retracted positions is indicated by a movement arrow 139 in FIG. 13*a*.

As discussed above with FIG. 13*a*, pivot post sleeve 133*b* is coupled to clamp assembly elevation cylinder 134, and pivot post sleeves 133*a* and 133*b* are positioned on opposed sides of clamp assembly elevation cylinder 134. Hence, pivot post sleeve 133*b* moves away from and towards pivot post sleeve 133*a* in response to moving clamp assembly elevation cylinder 134 between the extended and retracted positions, respectively.

It should be noted that clamp assembly 150 is shown in FIGS. 13*a* and 13*b* as being carried by clamp assembly rotation arm 135. Hence, clamp assembly 150 is moved away from and towards table top 121 in response to moving clamp assembly elevation cylinder 134 between the extended and retracted positions. Clamp assembly 150 is repeatably moveable away from and towards table top 121 in response to actuating clamp assembly elevation cylinder 134.

Clamp assembly 150 is repeatably moveable between raised and lowered positions in response to moving clamp assembly elevation cylinder 134 between the extended and retracted positions, respectively. Clamp assembly 150 is moved to the raised position in response to moving clamp assembly elevation cylinder 134 to the extended position. Clamp assembly 150 is moved to the lowered position in response to moving clamp assembly elevation cylinder 134 to the retracted position.

It should also be noted that clamp assembly 150 can be moved towards and away from table top 121 when clamp assembly 150 is positioned towards the upper drill pipe. Clamp assembly 150 is shown positioned towards the upper drill pipe in several of the figures mentioned above, such as in FIGS. 11*d*-11*f*, as well as FIGS. 12*a*-12*f*. Clamp assembly 150 is positioned towards slide wrench assembly 170 in response to being positioned towards the upper drill pipe. Hence, clamp assembly 150 is moved away from and towards slide wrench assembly 170 in response to moving clamp assembly elevation cylinder 134 between the extended and retracted positions, respectively.

Clamp assembly 150 is repeatably moveable between raised and lowered positions in response to moving clamp assembly elevation cylinder 134 between the extended and retracted positions, respectively, when clamp assembly 150 is positioned towards the upper drill pipe. Clamp assembly 150 is moved away from slide wrench assembly 170 in response to moving clamp assembly elevation cylinder 134 to the extended position. Clamp assembly 150 is moved towards slide wrench assembly 170 in response to moving clamp assembly elevation cylinder 134 to the retracted position. In this way, clamp assembly 150 is repeatably moveable between raised and lowered positions relative to slide wrench assembly 170.

As mentioned above, clamp assembly 150 includes proximal gripper 154 and distal gripper 155. Proximal gripper 154 and distal gripper 155 are moved away from and towards slide wrench assembly 170 in response to moving clamp assembly elevation cylinder 134 between the extended and retracted positions, respectively.

As mentioned above, clamp assembly 150 is repeatably moveable between raised and lowered positions in response to moving clamp assembly elevation cylinder 134 between the extended and retracted positions, respectively, when clamp assembly 150 is positioned towards the upper drill pipe. Proximal gripper 154 and distal gripper 155 are moved away from slide wrench assembly 170 in response to moving clamp assembly elevation cylinder 134 to the extended position. Proximal gripper 154 and distal gripper 155 are moved towards slide wrench assembly 170 in response to moving clamp assembly elevation cylinder 134 to the retracted position.

The embodiments of the invention described herein are exemplary and numerous modifications, variations and rearrangements can be readily envisioned to achieve substantially equivalent results, all of which are intended to be embraced within the spirit and scope of the invention.

The invention claimed is:

1. A break-out assembly, comprising:

a slide wrench assembly comprising a slide wrench; and a slide wrench rotator assembly which rotates the slide wrench assembly in response to actuating first and second rotator assembly cylinders, wherein the slide wrench extends above a table top, and the first rotator assembly cylinder extends below the table top.

2. The assembly of claim 1, wherein the slide wrench rotator assembly includes a central opening dimensioned to receive a drill string.

3. The assembly of claim 2, wherein the slide wrench assembly includes a slide wrench having a slide wrench opening which is repeatably moveable towards and away from the central opening.

4. The assembly of claim 1, wherein the slide wrench rotator assembly carries the slide wrench assembly.

5. The assembly of claim 1, wherein the first and second rotator assembly cylinders are actuated in opposed directions.

6. The assembly of claim 1, further including a clamp assembly which includes opposed arm assemblies that rotate about separate pivot points.

7. The assembly of claim 6, wherein the clamp assembly restricts the rotation of an upper drill pipe of a drill string in response to being in a clamped condition.

8. The assembly of claim 6, wherein the clamp assembly is positioned above the slide wrench rotator assembly.

9. The assembly of claim 6, wherein the clamp assembly is repeatably moveable between raised and lowered positions.

10. The assembly of claim 1, wherein opposed ends of the first rotator assembly cylinder are fixed.

11. The assembly of claim 1, wherein the slide wrench rotator assembly is positioned below the slide wrench assembly.

12. The assembly of claim 1, wherein the slide wrench rotator assembly includes a rotator assembly clamp coupled to a drill string sleeve, wherein the drill string sleeve extends through a table top.

13. The assembly of claim 1, wherein the slide wrench rotator assembly includes a rotator assembly clamp which rotates in response to actuating the first and second rotator assembly cylinders.

14. The assembly of claim 13, wherein an end of the first rotator assembly cylinder is fastened to the rotator assembly clamp, and an opposed end is fastened to a table.

15. The assembly of claim 13, wherein the first rotator assembly cylinder includes an end fastened to a table top and an opposed end fastened to the rotator assembly clamp.

16. The assembly of claim 13, wherein the first rotator assembly cylinder includes a pin repeatably moveable between engaged and disengaged positions with the rotator assembly clamp.

17. The assembly of claim 1, wherein the slide wrench rotator assembly includes a rotator assembly clamp coupled to a drill string sleeve, wherein the first and second rotator assembly cylinders are repeatably moveable between engaged and disengaged positions with the rotator assembly clamp.

18. The assembly of claim 17, wherein the slide wrench assembly includes a slide wrench assembly base plate which is coupled to the drill string sleeve.

19. The assembly of claim 1, wherein the slide wrench assembly includes first and second slide wrench cylinders.

20. The assembly of claim 19, wherein the slide wrench assembly includes a slide wrench, which slides in response to actuating the first and second slide wrench cylinders.

21. The assembly of claim 19, wherein the slide wrench assembly includes a slide wrench having opposed jaws spaced apart by a slide wrench opening, the slide wrench opening being repeatably moveable in response to actuating the first and second slide wrench cylinders.

22. A break-out assembly, comprising:

a slide wrench assembly; and a slide wrench rotator assembly coupled to the slide wrench assembly with a drill string sleeve, wherein the slide wrench rotator assembly rotates the slide wrench assembly, wherein the break-out assembly includes a clamp coupled to the drill string sleeve, wherein the drill string sleeve extends through a table top.

23. The assembly of claim 22, wherein the drill string sleeve includes an opening sized to receive a drill string.

24. The assembly of claim 22, wherein the drill string sleeve carries the slide wrench assembly.

25. The assembly of claim 22, wherein the slide wrench rotator assembly 190 includes first and second rotator assembly cylinders which rotate the drill string sleeve.

26. The assembly of claim 25, wherein the first and second rotator assembly cylinders rotate the drill string sleeve in response to being actuated in opposed directions.

27. The assembly of claim 22, further including a clamp assembly which includes proximal and distal arm assemblies.

28. The assembly of claim 27, wherein the proximal and distal arm assemblies rotate about separate pivot points.

29. A method of disconnecting first and second drill pipes of a drill string comprising:

engaging the first drill pipe of the drill string with a slide wrench assembly, wherein the slide wrench assembly comprises a slide wrench; and rotating, with a slide wrench rotator assembly, the slide wrench assembly in response to actuating first and second rotator assembly cylinders, wherein the slide wrench extends above a table top, and the first rotator assembly cylinder extends below the table top.

30. The method of claim 29, wherein the step of rotating includes actuating the first and second rotator assembly cylinders in opposed directions.

31. The method of claim 29, wherein the step of rotating includes rotating a drill string sleeve which carries the slide wrench assembly.

32. The method of claim 29, further including engaging the second drill pipe of the drill string with a clamp assembly.

33. The method of claim 32, wherein the clamp assembly restricts the rotation of the second drill pipe in response to the actuation of the first and second rotator assembly cylinders.

34. The method of claim 29, wherein the first and second drill pipes are lower and upper drill pipes respectively.

* * * * *